US007701806B2

(12) United States Patent
Oguchi et al.

(10) Patent No.: US 7,701,806 B2
(45) Date of Patent: Apr. 20, 2010

(54) ELECTRONIC TIMEPIECE WITH WIRELESS INFORMATION FUNCTION

(75) Inventors: Isao Oguchi, Nagano-ken (JP); Teruhiko Fujisawa, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 11/924,474

(22) Filed: Oct. 25, 2007

(65) Prior Publication Data

US 2008/0094942 A1 Apr. 24, 2008

Related U.S. Application Data

(62) Division of application No. 10/793,478, filed on Mar. 3, 2004, now Pat. No. 7,433,273.

(30) Foreign Application Priority Data

| | | |
|---|---|---|
| Mar. 4, 2003 | (JP) | 2003-057158 |
| May 8, 2003 | (JP) | 2003-130353 |
| Dec. 26, 2003 | (JP) | 2003-432620 |

(51) Int. Cl.
*G04C 11/02* (2006.01)

(52) U.S. Cl. ..... 368/47

(58) Field of Classification Search ..... 368/10, 368/47

See application file for complete search history.

(56) References Cited

U.S. PATENT DOCUMENTS

| | | | |
|---|---|---|---|
| 4,673,936 | A | 6/1987 | Kotoh |
| 5,014,071 | A | 5/1991 | King |
| 5,331,608 | A | 7/1994 | Umemoto et al. |
| 5,627,552 | A | 5/1997 | Farrar et al. |
| 5,742,564 | A | 4/1998 | Kuschel et al. |
| 5,768,217 | A | 6/1998 | Sonoda et al. |
| 5,798,984 | A | 8/1998 | Koch |
| 6,108,278 | A | 8/2000 | Rochat |
| 6,134,188 | A | 10/2000 | Ganter et al. |
| 6,278,873 | B1 | 8/2001 | Itakura et al. |
| 6,356,512 | B1 | 3/2002 | Martin et al. |
| 6,525,996 | B1 | 2/2003 | Miyazawa |
| 6,538,959 | B1 | 3/2003 | Yamaguchi et al. |
| 6,825,751 | B1 | 11/2004 | Kita et al. |

(Continued)

FOREIGN PATENT DOCUMENTS

| | | |
|---|---|---|
| DE | 93156707 | 2/1995 |

(Continued)

*Primary Examiner*—Felix O Figueroa

(57) ABSTRACT

An electronic timepiece with wireless information function that is small, has good reception performance, and has a construction that improves the freedom of design. Antennae 5A and 5B are disposed inside a short cylindrically-shaped metal case 1 of which both ends along its cylindrical axis $L_1$ are open with the axes $L_{5A}$ and $L_{5B}$ of the antennae 5A and 5B substantially parallel to the cylindrical axis L1 of the case 1. A magnetic-field-passing part capable of passing the magnetic field of radio waves is disposed in an open side of the case 1 along an extension of the antenna axis. Radio waves entering from the open side of the case 1 can therefore be received by the antenna, and the material of the case 1 does not affect the reception performance of the antennae 5A and 5B. The case 1 can therefore be made from metal, increasing the freedom of design and making it possible to improve the appearance.

8 Claims, 32 Drawing Sheets

U.S. PATENT DOCUMENTS

| | | | | |
|---|---|---|---|---|
| 6,885,615 | B1 | 4/2005 | Miyazawa et al. | |
| 6,992,952 | B2 * | 1/2006 | Endo et al. | 368/10 |
| 7,280,438 | B2 * | 10/2007 | Fujisawa | 368/47 |
| 7,355,556 | B2 * | 4/2008 | Abe et al. | 343/788 |
| 7,396,155 | B2 * | 7/2008 | Oguchi | 368/298 |
| 2002/0071346 | A1 * | 6/2002 | Paratte et al. | 368/10 |

FOREIGN PATENT DOCUMENTS

| | | | |
|---|---|---|---|
| DE | 20211848 | U1 | 12/2002 |
| EP | 1065791 | | 1/2001 |
| EP | 1286234 | A1 | 2/2003 |
| JP | 58085186 | | 5/1983 |
| JP | 581787 | | 11/1993 |
| JP | 06273545 | | 9/1994 |
| JP | 08285960 | | 11/1996 |
| JP | 11064547 | | 3/1999 |
| JP | 11223684 | | 8/1999 |
| JP | 2000105285 | | 4/2000 |
| JP | 2000286761 | | 10/2000 |
| JP | 200142064 | | 2/2001 |
| JP | 2001033571 | | 2/2001 |
| JP | 2001042064 | | 2/2001 |
| JP | 2001108770 | | 4/2001 |
| JP | 2001264463 | | 9/2001 |
| JP | 2001305244 | | 10/2001 |
| JP | 2002031690 | | 1/2002 |
| JP | 2002293644 | | 10/2002 |
| JP | 2002341058 | | 11/2002 |
| JP | 2002341059 | | 11/2002 |
| JP | 2003043167 | | 2/2003 |
| JP | 2003050983 | | 2/2003 |
| JP | 2003057366 | | 2/2003 |
| JP | 2003121569 | | 4/2003 |
| JP | 2003-270370 | | 9/2003 |
| JP | 2004-093374 | | 3/2004 |
| WO | 9721153 | | 6/1997 |
| WO | 03003130 | A1 | 1/2003 |

* cited by examiner (A)

(B)

ELECTRONIC TIMEPIECE WITH WIRELESS INFORMATION FUNCTION

CONTINUING APPLICATION DATA

This application is a divisional of U.S. patent application Ser. No. 10/793,478 filed on Mar. 3, 2004. The contents of this prior application are incorporated herein by reference in its entirety.

BACKGROUND OF THE INVENTION

1. Field of the Invention

The present invention relates to an electronic timepiece with a wireless information function, and more particularly to a radio-controlled timepiece.

2. Description of the Related Art

An electronic timepiece with a wireless communication function enabling the timepiece to receive an RF signal and perform a specified operation based on information contained in the received signal is known from the prior art. One such timepiece is a radio-controlled timepiece having an antenna for receiving a standard radio signal carrying time information, and adjusting the time based on the time information received by the antenna. See, for example, Japanese laid-open patent application nos. H8-285960, 2000-105285 and 2001-33571 (hereinafter referred to as ref. 1, ref. 2 and ref. 3, respectively).

A configuration having an antenna assembled in the leather band of a wristwatch and connected to the watch body through a connection terminal formed in the band is provided in ref. 1. Because the antenna is not disposed in the watch body with this configuration, the watch body can be made smaller and signal reception by the antenna can be isolated from the effects of metal parts in the watch body.

The configuration provided in ref. 2 has an antenna disposed in a groove formed on the inside circumference of the case, which is made from a non-metallic material. Because the case is not metal, the standard radio signal is not blocked by the case and signal reception by the antenna is good.

The configuration provided in ref. 3 has a spacer ring made from a non-conductive material disposed inside a metal case, and the antenna is located on the inside of this spacer ring and separated by the spacer ring a specific distance from the case. By separating the antenna this specific distance from the case, signals can be received by the antenna with good reception without the case blocking the signal, and an appearance of high quality can be achieved because the case is made of metal.

One problem with the radio-controlled timepiece in ref. 1, however, is that it is difficult to make the electrical connection between the band and watch body, and the replacement cost of the band is high because assembling the antenna inside the band makes the band expensive. A further problem is that flexing the band increases the likelihood of damage to the assembled antenna.

With the radio-controlled timepiece in ref. 2, the case is limited to non-metallic materials so that signals are not blocked by the case. The problem here is that significant limitations are imposed on the design and appearance by the inability to use a case made of metal.

The problem with separating the antenna and case sufficiently to prevent any effect on signal reception as in the radio-controlled timepiece in ref. 3 is that the watch becomes extremely large. Furthermore, if the case and antenna are proximally disposed, the standard radio signal is blocked by the case, and reception of the standard radio signal by the antenna is not good.

Also known from the literature (PCT published application no. WO 97/21153 and Japanese laid-open patent application no. H11-223684, hereinafter ref. 4 and ref. 5, respectively) are radio-controlled timepieces having an antenna for receiving a standard time signal containing time information and adjusting the time based on the time information received by the antenna, and having photoelectric means for generating electricity from incident light.

This photoelectric means is composed of a photoelectric device with a photoelectric generating function, and a support base for supporting the photoelectric device. The photoelectric device has a transparent conductive film as the electrode layer, and the support base is a metal substrate of stainless steel, for example.

Because the standard time signal could be blocked by the conductive film and support base, an arrangement in which the photoelectric device does not block the standard time signal before it reaches the antenna is required. When the photoelectric means is disposed over the dial as shown in FIG. 3 or FIG. 5 of ref. 4, for example, the antenna must be located externally to the case so that the photoelectric means and antenna do not overlap.

However, if as proposed in ref. 4 and ref. 5, the photoelectric means and antenna cannot be stacked, the timepiece becomes quite large. The problem with this is that it is not compatible with small, portable timepieces such as wristwatches.

On the other hand, if the antenna is located inside the case, the case must be made from a non-conductive and non-magnetic material so that radio signals are not blocked by the case. In other words, a metal case cannot be used, and it becomes difficult to impart a feeling of high quality.

It should be noted that if the photoelectric means and antenna are small, they can be disposed to mutually non-interfering positions, but the problem here is that if the photoelectric means is small, the light-receiving area is small and electrical generating performance drops. A further problem is that the reception performance of the antenna drops if the antenna is small.

An aesthetically pleasing design is desired in timepieces, and an appearance befitting a luxury accessory is essential for wristwatches in particular. One problem, therefore, is that a metallic appearance and compact design are needed. Another problem is that reception by the antenna must be good in a radio-controlled timepiece or other electronic timepiece with wireless information function.

However, if a metal case is used to provide a high quality feel, and the design is small and compact, signals cannot be received by the antenna with good reception.

The related art described above does not simultaneously address the need for good signal reception by the antenna and an improved appearance, and there is therefore a need for an electronic timepiece with a wireless information function that features both good signal reception and an aesthetically pleasing appearance.

OBJECTS OF THE INVENTION

It is therefore, an object of the present invention to solve this problem of the prior art and provide an electronic timepiece with wireless information function that is small, has good reception performance, and improves freedom of design.

Another object of the present invention is to provide an electronic timepiece with wireless information function that has a photoelectric generating function while further improving reception and appearance.

SUMMARY OF THE INVENTION

An electronic timepiece with wireless information function according to the present invention comprises a cylindrically-shaped case having a metal part on at least an outside surface and having an opening in at least one end along its cylindrical axis. An antenna is disposed inside the case so that the antenna axis passes through the opening in the case for receiving a radio signal. A magnetic-field-passing part is positioned in the case such that the antenna axis extends therethrough, and is constructed to enable the magnetic field component of the received radio signal to pass through. A control unit executes a control operation based on information in the radio signal received by the antenna, and a time display presents time.

That the antenna axis passes through an opening in the case means that the antenna axis freely extends outside of the case without obstruction. In other words, the antenna axis and the physical structure of the case do not intersect along the direction in which the antenna axis passes through the case opening.

In passing through an opening in the case, the antenna axis does, however, intersect other components, such as the dial, crystal, and back cover. At least the portion of each of these components that intersects the antenna axis comprises a magnetic-field-passing part. Thus, the antenna axis intersects this magnetic-field-passing part.

The cylindrical axis of the case denotes the axis substantially perpendicular to the surface of the time display (often the dial surface) through the center point of the case opening, which is often coincident with, or substantially parallel to, the axis of the center wheel of the hands. Or the cylindrical axis is an axis equivalent to the axis of symmetrical rotation when the case is rotationally symmetric.

Because radio waves have field fluctuation oscillating perpendicularly to the path of travel, the magnetic field of the signal enters the case through the opening(s) in the case and travels through the magnetic-field-passing part when the cylindrical axis of the case is oriented perpendicularly to the path of the radio signal. The field entering from the case opening(s) then links to the antenna and induces induction voltage. As a result, the signal is received by the antenna.

More specifically, the magnetic field component of the RF signal enters the case through the case opening(s) and travels through the magnetic-field-passing part. The magnetic field component is then received by the antenna. Information from the RF signal received by the antenna is then signal processed by the control unit, and information in the RF signal is decoded. Based on this information the control unit then executes a control operation. Control operations can include, for example, displaying the time on the time display if the radio signal is a standard time signal containing time information, or if the radio signal information is weather or stock information, displaying that information on a particular display.

Because the magnetic field component of the radio signal enters the case through its opening(s), flux linkage to the antenna is not affected by the material of the case. A metal case can therefore be used to provide (i) a luxurious design and improve the appearance of the timepiece, (ii) a more durable timepiece than would a plastic case, as the surface of a metal case is more resistant to scratches than the surface of a plastic case, and (iii) better protection for the internal clock mechanism (movement).

Because the antenna axis is aligned with the magnetic field component entering through the case opening(s), radio signals can be efficiently received by the antenna. The reception performance of the antenna is improved as a result. Furthermore, because antenna reception performance is improved, sufficient reception strength is assured even using a small antenna. The ability to reduce antenna size means that the electronic timepiece with wireless information function can be made smaller. This, in turn, means that such a timepiece can be fashioned into a small, extremely pleasing design that is particularly suited to women's wristwatches.

That the magnetic field component of the radio signal can pass through the magnetic-field-passing part means that the magnetic-field-passing part passes the magnetic field component so that the magnetic field component of an externally transmitted radio signal is pulled in by the antenna, but does not mean that the externally transmitted magnetic field component passes so that it leaks into the case.

The magnetic-field-passing part of this invention includes the portion(s) of all components disposed in a plane imposed over the antenna when seen in plan view (as seen from the dial side). Such components include, for example, the dial, back cover, parting plate, crystal, and photoelectric cell support substrate facing the antenna. The portion imposed over the antenna is able to pass the magnetic field component of the radio signal so that the magnetic field component of the radio signal is pulled in by the antenna. For example, if the main plate and gear train holder are plastic and disposed to intersect the antenna axis, at least the portions over the antenna constitute part of the magnetic-field-passing part.

This magnetic-field-passing part can be a non-conductive and non-magnetic member that does not block the magnetic field component of the radio signal, or a high permeability member isolated from the metal case that guides the magnetic field component of the radio signal to the antenna.

The magnetic-field-passing part of this invention preferably has at least the same surface area as the area of the antenna end. By thus assuring a magnetic-field-passing part at least equivalent in area to the area of the antenna end, more of the signal field can be linked more efficiently to the antenna. More preferably, the area of the magnetic-field-passing part is approximately twice the area of the antenna end. If the area of the magnetic-field-passing part is approximately twice the area of the antenna end, sufficient antenna reception performance can be assured.

Preferably, the radio signal in the present invention is a standard time signal containing time information, the control unit is a timekeeping control unit for keeping current time and adjusting the current time based on the time information received by the antenna, the time display is a display for presenting the current time kept by the timekeeping control unit, and the electronic timepiece with wireless information function is thus a radio-controlled timepiece.

Thus comprised, the antenna receives a standard time signal. The time information from the standard time signal is processed by the timekeeping control unit, and the time information contained in the standard time signal is decoded. The current time is adjusted based on this time information, and the adjusted current time is presented by the time display. Because the time is automatically adjusted based on time information from the standard time signal, a radio-controlled timepiece that always shows the correct current time can be provided.

The current time as used herein includes the time kept by the timekeeping control unit, the time with timekeeping error if the time is counted by a current time counter (current time information storage medium) rendered in the timekeeping control unit, the accurate current time corrected based on the time information by the timekeeping control unit, and, while not desirable, can also include the time erroneously corrected if a standard time signal reception error occurs for some reason. The time display presents the time kept by the timekeeping control unit (current time counter). In this case the time indicated by the time display is the time reflecting timekeeping error, the correctly adjusted time, or, while not desirable, is the erroneously corrected time. It should be noted that because the reception performance of the antenna is improved by the configuration of the present invention, the likelihood of a reception error occurring is extremely low, and the possibility of the time being incorrectly adjusted due to a reception error is thus substantially avoided.

The antenna is preferably positioned toward the center of the case separated from the inside circumference surface of the case, i.e., the physical structure of the case. This configuration makes the magnetic field component of RF signals linking to the antenna even less susceptible to the effect of the case by an amount equivalent to the separation of the antenna from the case. Thus, even when the case is metal or has metal in it, if the antenna is separated from the case, the reception performance of the antenna is improved commensurately to decrease the effect that the case would otherwise have of attracting the signal field thereby reducing the field linkage to the antenna.

If an antenna is disposed with its axis perpendicular to the cylindrical axis of the case, the entering radio signal entering must bend to the direction of the antenna axis, and a gap enabling the magnetic field component of the radio signal to bend must be assured between the antenna and case. This unavoidably increases the size of the timepiece. The present invention avoids this problem. With the present invention it is not necessary to provide space enabling the radio waves to bend and align with the antenna axis, and the gap between the case and antenna can be reduced compared with the prior art. The size of the timepiece can therefore be reduced.

When the antenna axis is divided into a part parallel to the case axis and a part orthogonal to the case axis, the part of the antenna axis that is parallel to the cylindrical axis of the case is greater. The reception performance of the antenna is therefore improved for fields that enter from one opening in the case and exit from the other, and particularly for magnetic field components that enter the case substantially parallel to the cylindrical axis of the case. Design freedom is therefore improved, including being able to use a metal case. Because the reception sensitivity of the antenna is also improved, the antenna can be made smaller. A small electronic timepiece with wireless information function is therefore afforded.

Preferably, the antenna axis intersects the cylindrical axis of the case at between 0° and 45°. More preferably, the antenna axis is inclined at an angle at which the line of the antenna axis does not intersect metal members if a metal member that will block the magnetic field of RF signals is disposed in the case opening. The reception performance of the antenna can thus be improved for radio signals entering the case if the antenna axis is so disposed.

The extension of the antenna axis more preferably crosses the cylindrical axis of the case at an angle of between 0° and 30° and even more preferably between an angle of 0° and 15°. The closer the antenna axis is to being parallel to the cylindrical axis of the case, the greater the flux linkage between the antenna coil and the magnetic field parallel to the cylindrical axis of the case, and the reception performance of the antenna is improved accordingly. That the antenna axis is substantially parallel to the cylindrical axis of the case means that, for example, extensions of both axes form an angle of between 0° and 15°, the closer to 0° the better.

The magnetic flux entering the case from the case openings is greatest when thus comprised so that the field lines of the radio signal are substantially parallel to the cylindrical axis of the case. When the flux strength entering through the case opening is greatest as a result of rendering the antenna axis substantially parallel to the cylindrical axis of the case, flux linkage to the antenna is also greatest. Antenna reception performance is therefore also maximized. Furthermore, because sufficient reception strength is assured, the antenna can be made even smaller.

If the antenna axis is rendered substantially parallel to the cylindrical axis of the case, the footprint of the antenna in a plane perpendicular to the cylindrical axis of the case can be reduced. As a result, the size of the timepiece when viewed along the cylindrical axis of the case can be reduced.

Alternatively, because the section area of the antenna does not affect the thickness of the timepiece if the antenna axis is rendered substantially parallel to the cylindrical axis of the case, the section area of the antenna can be increased. This increases flux linkage and thereby improves the reception sensitivity of the antenna. For example, if the electronic timepiece with wireless information function is rendered as a wristwatch, watch thickness can be made thin, that is, 10 mm or less.

Because the antenna axis passes through the case opening, locating the magnetic-field-passing part in line with the antenna axis imposes no limitation on the case material. Furthermore, because several components, including the main plate, gear train holder, dial, and back cover, are generally disposed in line with the antenna axis, these components can be formed of non-conductive, non-magnetic materials such as plastic, ceramic, or mineral glass without particularly affecting the appearance.

It should be noted that, since the magnetic-field-passing part is constructed so as not to block the magnetic field of the radio waves, the end of the antenna could be exposed directly to the outside of the timepiece without any intervening member in line with the antenna axis.

Preferably, the case has an opening at each of the two ends along the cylindrical axis, and a main plate and gear train holder hold therebetween, in line with the case axis, a gear train for transferring drive power based on drive control by the control unit to the time display, and at least one of the main plate and gear train holder is formed of a non-conductive and non-magnetic member. Thus comprised, at least part of the case opening is covered by the main plate and gear train holder holding the gear train in line with the cylindrical axis of the case. However, because at least one of these is non-conductive and non-magnetic, the radio signal can enter the case through one of the openings. This field then links with the antenna and the signal is received by the antenna.

Further preferably, the main plate and gear train holder are also both made from non-conductive and non-magnetic members. Thus comprised, the signal field is not blocked and enters the case from the case opening. Because more signal flux thus enters the case, flux linkage to the antenna is increased. As a result, the reception performance of the antenna is improved.

If a stepping motor or other drive mechanism that produces a magnetic field when operating is used, the field produced by this drive mechanism must be prevented from reaching the antenna. Therefore, by forming the main plate and gear train holder from non-conductive and non-magnetic members, the magnetic field from the drive mechanism is prevented from passing the main plate and gear train holder and affecting the antenna. As a result, only the magnetic field of the radio signal links to the antenna, and the reception performance of the antenna is improved.

In an arrangement in which the case has an opening at each end along the cylindrical axis, preferably a cover is provided for closing one of the openings. The dial or surface of the time display is disposed across the open side of the case on the opposite side as the cover with the antenna therebetween. The time display surface need not be positioned wholly inside the opening of the case, but may be positioned outside of the opening as defined by the edges of the case opening.

At least one of the dial and cover is a non-conductive and non-magnetic member in this configuration. Because of this, the magnetic field of the radio waves enters the case from the case opening(s) through the non-conductive and non-magnetic member. The magnetic field thus links to the antenna, and the signal is received by the antenna. Preferably, both the dial and back cover are non-conductive and non-magnetic members. This configuration further improves antenna reception performance because the magnetic field of the radio waves enters the case from the case openings without being blocked.

If only one of the main plate and gear train holder is a non-conductive, non-magnetic member, and only one of the dial and back cover is a non-conductive, non-magnetic member, the non-conductive, non-magnetic members must be on the same side relative to the antenna. That is, the main plate and dial must be the non-conductive, non-magnetic members, or the gear train holder and back cover must be the non-conductive, non-magnetic members.

Yet further preferably, the present invention also comprises a rotatable calendar wheel that intersects the antenna axis, and displays at least one of year, day, or week information. The calendar wheel is formed of a non-conductive and non-magnetic member. Thus comprised, the appropriate information is indicated by the calendar wheel. Furthermore, because the calendar wheel is a non-conductive and non-magnetic member, the magnetic field of the radio waves is not blocked along the antenna axis. Because the calendar wheel is generally disposed rotating on a plane below the dial in the case opening, it may be located in line with the antenna axis. However, if the calendar wheel is a non-conductive, non-magnetic member, the calendar wheel will not affect antenna flux linkage even if it is disposed in line with the antenna axis. Generally only part of the calendar wheel can be seen through a window in the dial. Rendering the calendar wheel from a non-conductive, non-magnetic material will therefore not affect the overall appearance.

Preferably, a high permeability member is disposed so as to be electrically isolated from the case and positioned so that at least a portion is intersected by the antenna axis for inducing the magnetic field of the radio signal to the antenna. The high permeability member is preferably disposed at a position corresponding to the antenna, that is, at a position along an extension of the antenna axis, in at least one of the dial and cover. Because the magnetic field is pulled in by the high permeability member with this configuration, nearby magnetic fields are also pulled in addition to the magnetic field of RF signals aligned with the antenna axis. A larger magnetic field is thus inducted by the high permeability member and is picked up by the antenna. Antenna flux linkage is thus increased, and the reception performance of the antenna is improved. Good reception performance is also maintained even if antenna size is reduced because the high permeability member pulls in the magnetic field of the signal and increases antenna flux linkage. To reduce magnetic resistance the high permeability member is preferably made from the same material as the antenna core. Exemplary high permeability materials include pure iron, permalloy, iron, and amorphous alloys of cobalt, for example.

Thus comprised, antenna flux linkage is increased and the reception performance of the antenna is improved due to the large magnetic field inducted by the high permeability member linking the antenna. Furthermore, sufficient flux linkage is assured and reception performance is maintained even when antenna size is reduced because the magnetic field of the radio signal is pulled in by the high permeability member.

A drive mechanism (stepping motor) that produces a magnetic field may be used inside the case. However, because the high permeability member is located at a position opposite the antenna, the high permeability member can be prevented from guiding the magnetic field from the drive means to the antenna by locating the high permeability member and antenna separated a specific distance from the drive mechanism.

In an arrangement in which the case has an opening at each end along the cylindrical axis, a cover closing one of the case openings, a time display dial disposed in the open side of the case on the opposite side as the cover with the antenna therebetween, preferably the dial and cover are high permeability members, and the case is isolated from the dial and cover. Because the magnetic field is pulled in by the high permeability member with this configuration, magnetic fields of signals in the neighborhood of the case opening are also pulled in addition to the magnetic field of signals aligned with the antenna axis. Further, because the case and high permeability member are electrically isolated, the field pulled in by the high permeability member will not flow to the case. A strong magnetic field inducted by the high permeability member thus links the antenna. Antenna flux linkage is thus increased, and the reception performance of the antenna is improved.

The magnetic field of the radio waves is also collected over a wide area when the dial and back cover are high permeability members. A stronger magnetic field is thus guided to the antenna, and reception performance is improved.

Because the magnetic field of the radio waves is pulled in by the high permeability member and antenna flux linkage is increased, sufficient flux linkage can be assured and reception performance maintained even if antenna size is reduced.

If a drive mechanism is used, it is preferably a piezoelectric actuator. Because the dial and back cover are high permeability members, the entire magnetic field in the neighborhood of the dial and back cover is guided to the antenna. However, because a magnetic field is not internally produced if a piezoelectric actuator is used, only the magnetic field of the radio waves links to the antenna, and the radio signal is accurately received by the antenna.

Preferably, the time display has hands that rotate and indicate time on one, e.g., the open, side of the case. The hands are supported for rotation such that they do not overlap the antenna during RF signal reception. This means that during radio signal reception the hands are positioned away from, and do not intersect, the antenna axis. When thus comprised the hands will not interfere with the reception performance of the antenna even if the hands are metal. Thus, metal hands can be used to give the timepiece high quality and appearance, without causing problems with respect to RF signal reception.

Radio-controlled timepieces generally receive the standard time signal once or twice a day. If standard time signal reception is set for 2:00 a.m. to 2:06 a.m., for example, the antenna is located outside of the range of the hand positions during that time. As a result, the magnetic field of the standard time signal is not blocked by the hands along the antenna axis during reception, and the standard time signal can be received by the antenna.

It should be noted that when signal reception is forced by an unconditional reception operation, an escape operation can be automatically executed to remove the hands from the line of the antenna axis as needed.

Yet further preferably in the present invention the time display has hands that turn and indicate time, and a piezoelectric actuator that rotates the hands using oscillation of a piezoelectric element excited by an applied voltage. With this configuration, operating the drive mechanism has no affect on reception by the antenna because the piezoelectric actuator does not produce a magnetic field when driven. Only the magnetic field of the desired radio signal therefore links to the antenna, and the reception performance of the antenna is improved.

Yet further preferably, the present invention also comprises a movement having a gear train composed of gears, a quartz oscillator unit containing a quartz oscillator, and a circuit block containing the control unit, and a battery for supplying power to the movement. In planar arrangement at least one of the gear train, quartz oscillator unit, and circuit block is disposed between the antenna and battery. Thus comprised, space between the battery and antenna can be assured.

Batteries generally have a metal casing, and magnetic fields near the battery can therefore be pulled in to the metal casing. However, by separating the battery and antenna by a specific distance, the antenna is assured sufficient flux linkage and the reception performance of the antenna is improved.

Furthermore, because the gear train, quartz oscillator, and circuit block must be located somewhere inside the case, the space created by separating the battery and antenna can be eliminated by assembling the gear train, quartz oscillator, and circuit block, for example, in this space. Space inside the timepiece can therefore be used more efficiently.

Yet further preferably, the present invention further comprises a photoelectric conversion unit for receiving external light and generating power from the received light, and a support substrate capable of passing the magnetic field component of the radio signal and supporting the photoelectric conversion unit electrically isolated from the case. The antenna is positioned with an axial end thereof within a specific distance opposite the support substrate. Such a support substrate is preferably made from a high permeability material. Examples of such high permeability material include pure iron, permalloy, iron, and amorphous alloys of cobalt.

An end of the antenna being within a specific distance opposite the support substrate includes both arrangements in which the antenna end contacts the support substrate, and arrangements in which the antenna end is disposed proximally to the support substrate. Examples of the specific distance include a distance less than the gap between the support substrate and case, and a distance causing the magnetic field of the radio signal inducted by the support substrate to flow to the antenna and not to the case.

With this configuration the magnetic field of the radio signal is pulled to the support substrate supporting the photoelectric conversion unit because the photoelectric conversion unit is exposed to the outside from the case opening. Furthermore, because the antenna core is disposed opposite the support substrate, the magnetic field inducted to the support substrate flows into the antenna core and links to the antenna. The signal received by the antenna is signal processed by the control unit, information contained in the signal is decoded, and the control unit executes a specific control operation based on the received information.

When the photoelectric conversion unit is exposed to light, it produces power by photoelectric conversion. This generated power is then used for signal reception and the control operations of the control unit.

The magnetic field inducted to the support substrate enters the case from the case opening and links to the antenna. The magnetic flux linking the antenna is therefore completely unaffected by the material of the case.

Flux linked to the antenna is increased as a result of the support substrate pulling in radio waves. For example, the area of the support substrate can be great enough to completely cover the case opening. The magnetic field of RF signals can therefore be pulled in over a large area. While the radio waves will be blocked before reaching the antenna if the support substrate is simply assembled in the case opening, the magnetic field inducted by the support substrate is guided to the antenna when the antenna end is disposed within a specified distance opposite the support substrate. This affords the revolutionary effect of improving the reception performance of the antenna while also providing a photoelectric generating function. Furthermore, because the magnetic field of the RF signals is inducted by the support substrate, sufficient reception performance is assured even when antenna size is reduced. Furthermore, by making the antenna smaller, the electronic timepiece with wireless information function can be made smaller.

Antenna size can also be increased because the antenna can overlap the photoelectric conversion unit, and if antenna size can be increased, reception performance can be further improved.

While the photoelectric conversion unit comprises a dielectric membrane, it is thin enough to pass light (electromagnetic waves), and therefore blocks substantially no radio waves.

Yet further preferably in the present invention the case has an opening at each end along the cylindrical axis, and comprises a high permeability member for inducing the magnetic field component of the radio signal to the antenna being disposed in the opening opposite from the opening in which the photoelectric conversion unit is disposed with the antenna therebetween. The antenna is positioned with the end on the opposite side from the support substrate positioned within a specific distance opposite the high permeability member.

The high permeability member for inducing the magnetic field component of the radio signal to the antenna could be pure iron, permalloy, iron, or an amorphous alloy of cobalt, for example. Thus comprised the magnetic field of the radio waves is pulled in by the high permeability member. The magnetic field inducted by the high permeability member thus links the antenna because the antenna end is disposed opposite the high permeability member. Flux linkage to the antenna is thus increased, and the reception performance of the antenna is improved.

Furthermore, flux induction increases if the area of the high permeability member increases, and antenna flux linkage is further increased. Moreover, because the ends of the antenna are opposite the support substrate and high permeability member, an extremely large magnetic field is guided to the antenna from both ends, and the reception performance of the antenna is dramatically improved.

It should be noted that the high permeability member inducing the magnetic field component of the radio signal to the antenna can be provided separately from the parts of the clock movement, and the parts of the movement can also be used as the high permeability members. For example, the setting lever for stopping movement of the gear train when setting the hands, or the cover over the lever parts of the setting mechanism could also be used as the high permeability member. The reception performance of the antenna can therefore be improved without increasing the part count.

The present invention further preferably also has a cover for closing the case opening, and this cover is desirably non-conductive and non-magnetic. When thus comprised the cover does not block the magnetic field, the magnetic field of the radio waves inducted by the high permeability member can link the antenna, and the reception performance of the antenna is improved.

In an arrangement in which the case has an opening at each end along the cylindrical axis, a cover is rendered for closing the opening opposite from the opening in which the photoelectric conversion unit is disposed with the antenna therebetween, and enabling the magnetic field component of the radio signal to pass. The antenna is rendered with the end on the opposite side from the support substrate positioned within a specific distance opposite the cover.

The cover can be a high permeability member such as pure iron, permalloy, iron, or an amorphous alloy of cobalt. Thus comprised, the magnetic field of the radio signal is pulled in by the cover. Because the end of the antenna is opposite the cover, the magnetic field inducted by the cover links the antenna. Flux linkage to the antenna is thus increased, and the reception performance of the antenna is improved. Furthermore, because the ends of the antenna are opposite the support substrate and cover, a magnetic path is formed passing a magnetic field inflowing from one end of the antenna to the other end. A configuration enabling the magnetic field of the radio waves to link easily to the antenna is thus afforded. In addition, an extremely large magnetic field is guided to the antenna from both ends by the support substrate and cover, and the reception performance of the antenna is dramatically improved.

Preferably, a timepiece according to the present invention has two or more antennae, and two or more support substrates, a different support substrate disposed for each antenna. By providing two or more antennae, this configuration of the invention can render antennae with different reception performance by changing the section diameter of the antennae and the number of winds on the coil. Furthermore, if each antenna is disposed opposite a different support substrate, different flux strength can be inducted to each antenna by varying the area and materials of the support substrates. If each support substrate is optimally matched to the reception performance of the corresponding antenna, the reception performance of each antenna can be optimally adjusted. For example, if the support substrate has a large area, noise and other unwanted components will be pulled in addition to the desired RF signal. However, if the size of the support substrate is optimally matched to the reception performance of the antenna, RF signals can be appropriately received by the antenna.

Yet further preferably, the time display of this invention has a transparent dial disposed opposite from the antenna with the photoelectric generator therebetween. Thus comprised, the time can be displayed by hands that rotate over the time display surface of the dial. Furthermore, because the dial is transparent, light passes through the dial and is incident to the photoelectric conversion unit. Power is thus produced by the photoelectric conversion unit. Because the dial is transparent, the dial does not affect the amount of light incident to the photoelectric conversion unit, and the generating capacity of the photoelectric conversion unit is not impaired.

In one arrangement, the two or more antennae are connected in series. Thus comprised, the signal strength received by each of the antennae is added in series, and the overall reception performance of the antennae is improved. Furthermore, if a plurality of antennae (coils) rendered in different positions are connected in series, the signal strength received by each of the antennae is added in series, and each of the antennae can therefore be smaller. Furthermore, if these small antennae are disposed in gaps inside the case, dead space is eliminated, space is used more efficiently, and the overall size of the electronic timepiece with wireless information function can be reduced.

In another arrangement, the two or more antennae are connected in parallel. Thus comprised, signals received by the different antennae are parallel processed, and the control operation can be correctly executed using the RF signal accurately received by any one of the antennae. The likelihood of accurate control based on an accurately received RF signal is therefore improved.

While RF signals may not be accurately received by an antenna located inside the case near a metal portion or a stepping motor, for example, correct control operation is possible if the signal is accurately received by any one of multiple antennae located in different places inside the case.

DESCRIPTION OF THE PREFERRED EMBODIMENTS

Preferred embodiments of the present invention are described next with reference to the accompanying figures.

First Embodiment

A first embodiment of a radio-controlled timepiece is described below with reference to FIGS. 1 to 5 as an electronic timepiece with wireless information function according to the present invention.

Figure 1:
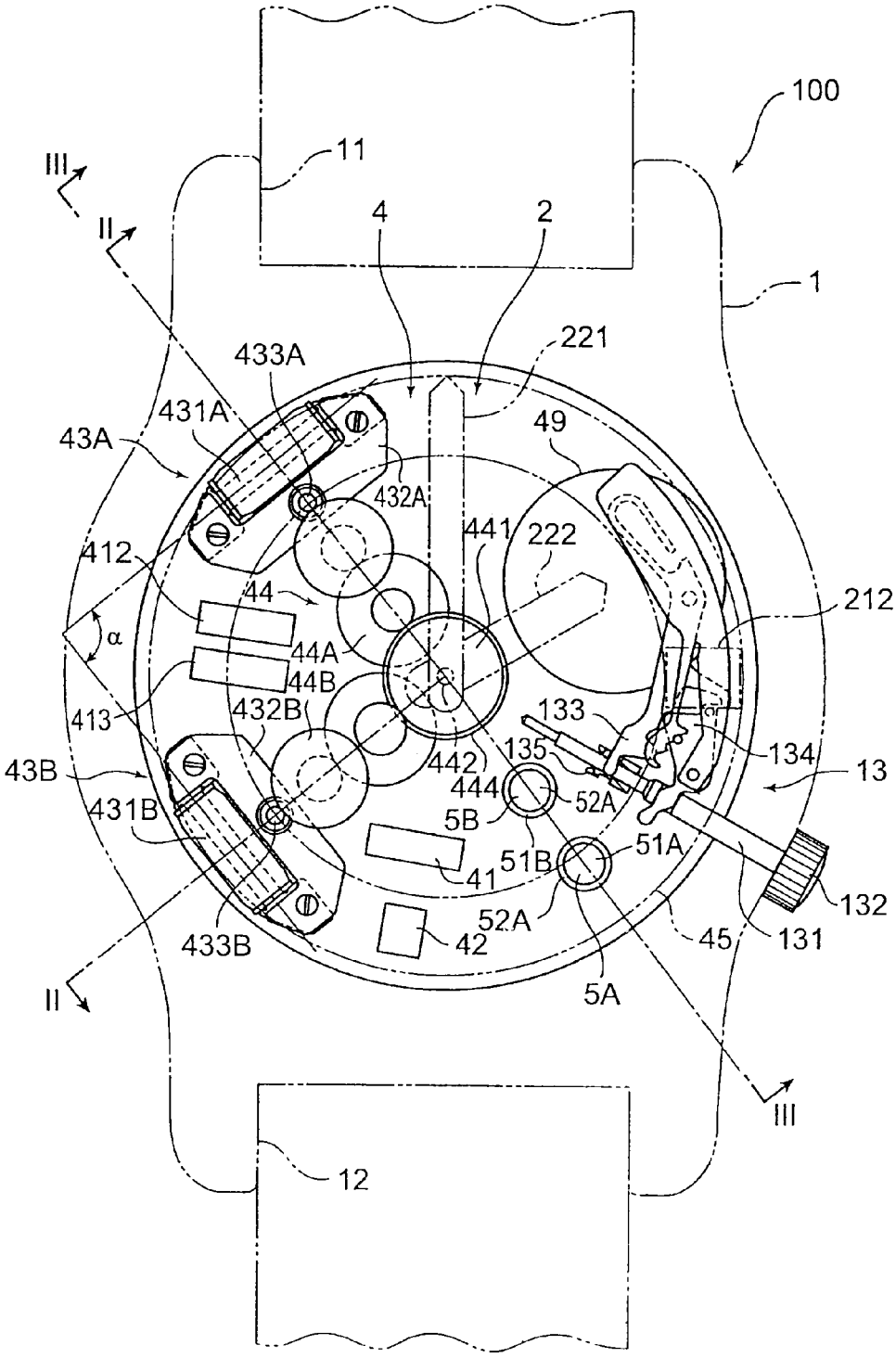
FIG. 1 is a plan view of an electronic timepiece with wireless information function according to a first embodiment of the present invention.
Figure 2:
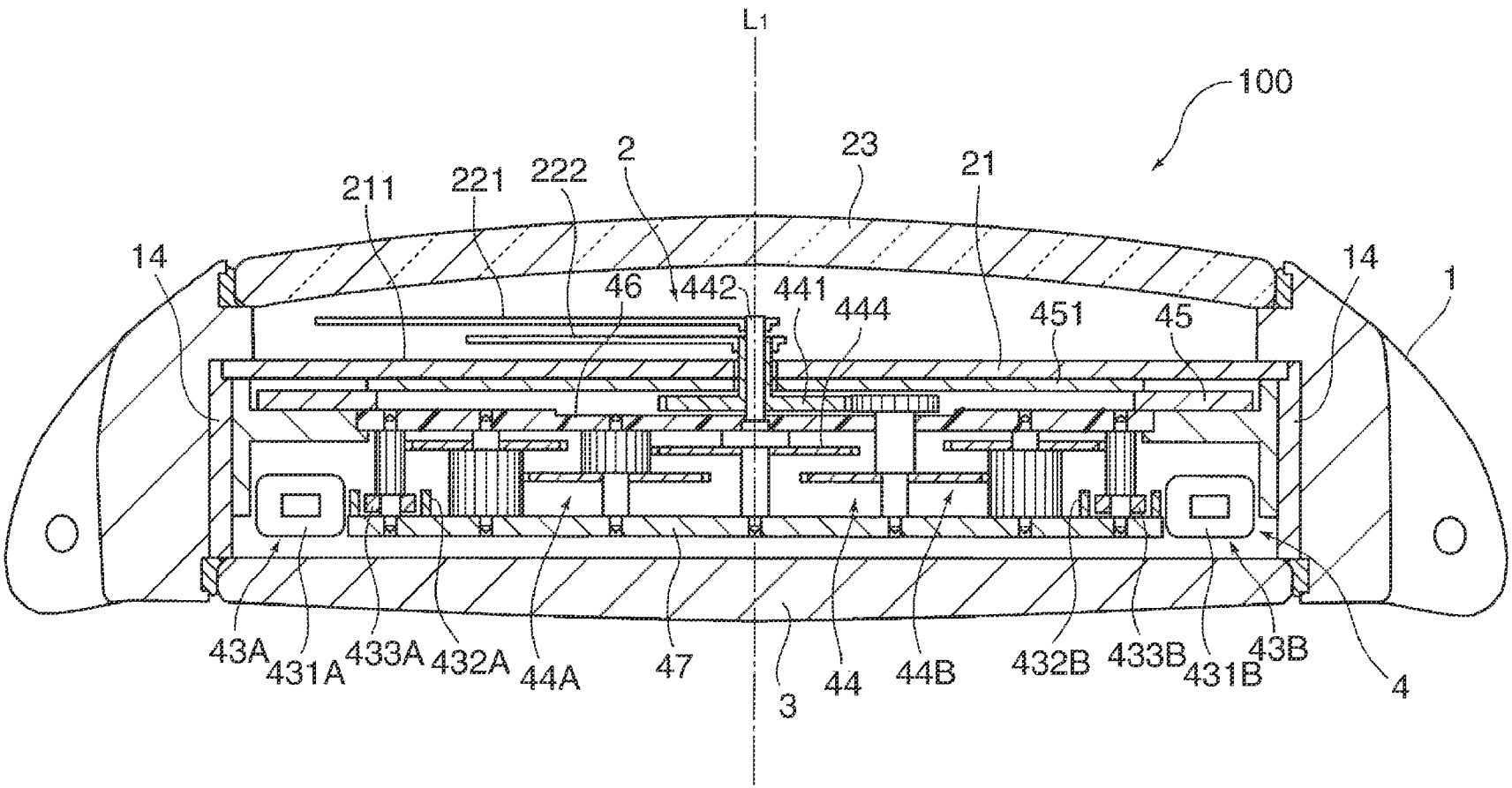
FIG. 2 is a section view of the first embodiment through line II-II in FIG. 1.
Figure 3:
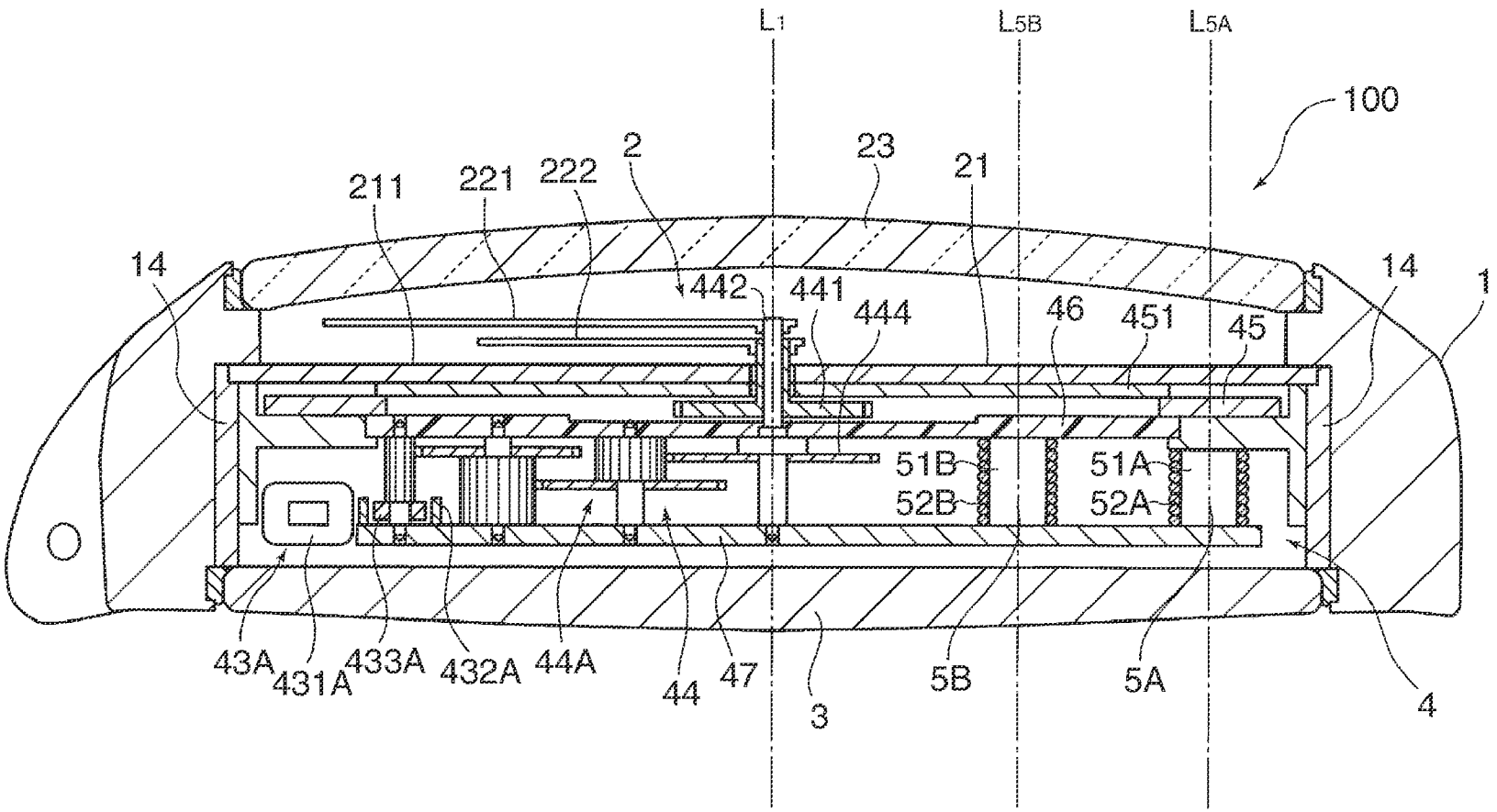
FIG. 3 is a section view of the first embodiment through line III-III in FIG. 1.

FIG. 1 is a plan view seen from the face side of a first embodiment of the invention, FIG. 2 is a section view through line II-II in FIG. 1, and FIG. 3 is a section view through line III-III in FIG. 1.

This radio-controlled timepiece 100 is a wristwatch having a ring-shaped (short cylindrical shape of which both ends are open) case 1 as shown in FIG. 1, FIG. 2, and FIG. 3.

The case 1 is a ring-shaped metal member of which both ends are open in line the cylindrical axis $L_1$, which is the axial direction of the gears that drive the hands (i.e., the axial direction of second wheel 444, for example), and is made from brass, stainless steel, or titanium, for example. The thickness of the case 1 is smaller than the ring diameter, and is a 10 mm or less and preferably 5 mm or less.

Horns 11, 12 for attaching a wristwatch band are formed at mutually opposite positions on the outside circumference of the case 1. As viewed from the center of the case 1, the direction in which one of the pairs of horns 11, 12 is disposed is 12:00, and the other pair of horns 11, 12 is disposed in the direction of 6:00. In FIG. 1 the top of the figure (towards horns 11) is the 12:00 direction, and the bottom of the figure (towards horns 12) is the 6:00 direction.

A stem 131 is disposed as an external operator 13 passing through the body of the case 1 in the approximate direction of 4:00. One end of the stem 131 is outside the case 1 with a crown 132 affixed to said end. The other end of the stem 131 is inside the case 1 with the yoke 133 and setting lever 134 affixed to said end.

The yoke 133 engages the clutch wheel 135, and when the stem 131 is pulled out, the clutch wheel 135 is moved in the axial direction of the stem 131 by way of intervening setting lever 134 and yoke 133. This adjusts the position of the hands or the date wheel 45. The stem 131, yoke 133, setting lever 134, clutch wheel 135 and other parts constitute the setting mechanism.

As shown in FIG. 2 and FIG. 3, a time display 2 is provided in the opening on one side of the case 1, and a back cover 3 is provided at the other open side of the case 1 as a cover closing the opening.

The time display 2 is composed of a dial 21 with a time display surface 211 substantially perpendicular to the cylindrical axis $L_1$ of the case 1 (perpendicular to the surface of the page in FIG. 1), and hands 221, 222 that turn over the surface of the dial 21.

The dial 21 is substantially circular with an area sufficient to close the opening in the case 1. The dial 21 is a non-conductive and non-magnetic member made from mineral glass, plastic, or ceramic, for example. The time display surface 211 faces the outside so that it can be read externally, and numbers (not shown) for indicating the time are printed in a circle around the outside edge of the time display surface 211.

The hands include a minute hand 221 for indicating the minute, and an hour hand 222 for indicating the hour. Both hands 221, 222 are made from metal, such as brass, aluminum, or stainless steel.

A crystal 23 is also provided opposite the dial 21 with the hands 221, 222 therebetween. The area of the crystal 23 is sufficient to close the opening in the case 1. The crystal 23 is a transparent member that is non-conductive and non-magnetic, and is made from mineral glass or organic glass, for example.

The back cover 3 is disposed opposite the dial 21 with a specific gap therebetween, and has area sufficient to close the opening in the case 1. The back cover 3 is a non-conductive and non-magnetic member made of mineral glass or organic glass, for example.

Between the dial 21 and back cover 3 inside the case 1 are disposed a movement 4 with a timekeeping function, a spacer ring 14 for holding the movement 4 inside the case 1, battery 49 for supplying power to the movement 4, and antennae 5A and 5B for receiving a standard radio signal carrying time information.

The movement 4 has a quartz oscillator unit 41 including a quartz oscillator 411; a circuit block 42 as a control unit (timekeeping control unit) with a control function; stepping motors 43A, 43B as drivers for turning the hands 221, 222; gear train 44 for transferring drive power from stepping motors 43A, 43B to the hands 221, 222; date wheel (calendar wheel) 45 for indicating the date; and main plate 46 and gear train holder 47 holding the gear train 44 therebetween in line with the cylindrical axis $L_1$ of the case 1.

The quartz oscillator unit 41 is composed of a quartz oscillator 411 for a clock reference, and a 60-kHz quartz oscillator 412 and a 40-kHz quartz oscillator 413 used to generate tuning signals for tuning to the frequency (60 kHz or 40 kHz) of the standard radio signal. The quartz oscillators 412, 413 for tuning signal generation are disposed in the approximate direction of 9:00.

Figure 4:
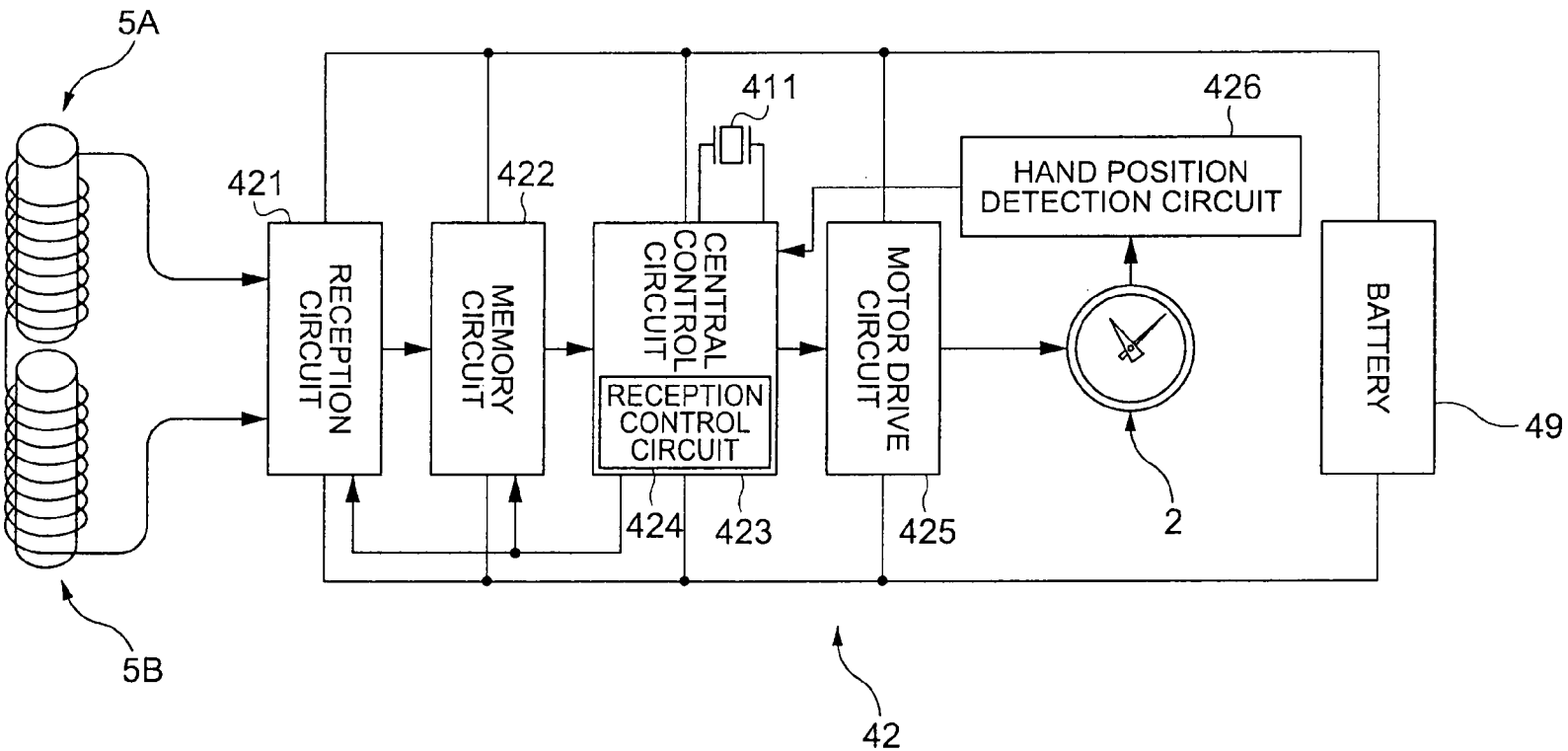
FIG. 4 shows the configuration of the circuit block in the first embodiment of the invention.

The quartz oscillator unit 41 and circuit block 42 are disposed in the approximate direction of 7:00. FIG. 4 is a function block diagram of the quartz oscillator unit 41 and circuit block 42.

The circuit block 42 is composed of a reception circuit 421 for processing the standard radio signal received by the antennae 5A and 5B and outputting time information; a memory circuit 422 for storing the time information output from the reception circuit 421; a central control circuit 423 for keeping the current time based on clock pulses from the quartz oscillator 411 and adjusting the current time using the received time information; a motor drive circuit 425 for driving stepping motors 43A, 43B; and hand position detection circuit 426 for detecting the hand positions.

The reception circuit 421 is composed of an amplifier circuit for amplifying the standard radio signal received by antennae 5A and 5B, a filter for extracting a desired frequency component, a demodulation circuit for demodulating the signal, and a decoder circuit for decoding the signal.

The memory circuit 422 temporarily stores the time information decoded by the reception circuit 421, and determines whether reception was successful by comparing multiple stored time information values.

The central control circuit 423 includes an oscillation circuit, frequency-dividing circuit, current time counter for keeping the current time, and a time-setting circuit for adjusting the value of the current time counter according to the received time information. The central control circuit 423 also has a reception control circuit 424 for storing the reception schedule of the reception circuit 421 and controlling the reception operation, and the reception schedule is set to receive from 2:00 a.m. to 2:06 a.m. When operation of the external operator 13 applies a command telling the reception control circuit 424 to receive the current time information, the reception control circuit 424 applies an output signal telling the reception circuit 421 to receive the standard radio signal.

The motor drive circuit 425 applies a drive pulse to the stepping motors 43A, 43B at the timing indicated by the central control circuit 423.

The hand position detection circuit 426 detects the positions of the hands (minute hand 221, hour hand 222) and outputs the detection result to the central control circuit 423. The detection result from the hand position detection circuit 426 and the value of the current time counter are then compared by the central control circuit 423. Based on the result of this comparison, the motor drive circuit 425 is instructed to output motor pulses to reposition the hands to match the current time counter.

The drive unit includes minute hand stepping motor 43A for turning the minute hand 221, and hour hand stepping motor 43B for turning the hour hand 222.

The stepping motors 43A, 43B each have a drive coil 431A, 431B for producing magnetic force by means of the drive pulses supplied from motor drive circuit 425; a stator 432A, 432B excited by the drive coil 431A, 431B; and a rotor 433A, 433B turned by the magnetic field excited by the stator 432A, 432B.

It should be noted that when seen in plan view as shown in FIG. 1, the drive coil 431A of the minute hand stepping motor 43A and the drive coil 431B of the hour hand stepping motor 43B are disposed such that the center axes thereof are substantially perpendicular to each other (that is, the angle a at which the center axes intersect is substantially 90 degrees). This angle a could be in the range 45 degrees to 135 degrees. The minute hand stepping motor 43A is placed at the outside circumference of the movement 4 in the approximate direction of 11:00, and the hour hand stepping motor 43B is located at the outside circumference of the 4 in the approximate direction of 8:00.

The gear train 44 transfers rotation of the rotor 433A, 433B to the hands 221, 222, and is composed of a minute hand gear train 44A linking the minute hand stepping motor 43A to second wheel 444, which turns in unison with the minute hand arbor 442 to which the minute hand 221 is connected, and hour hand gear train 44B linking the hour hand stepping motor 43B to the center wheel 441 to which the hour hand 222 is connected.

The date wheel 45 is a gear that has an open center and is held inside the case 1 by main plate 46, gear train holder 47, and date wheel presser 451. The date wheel 45 is made from a non-conductive and non-magnetic material such as plastic, mineral glass, or paper. The date wheel 45 engages a gear train (not shown in the figure) connected to the main wheel 441, and is turned at a specific speed by rotation of the main wheel 441. Characters (not shown in the figure) indicating the date are printed on the date wheel 45 opposite the dial 21. As indicated by the dot-dash line in FIG. 1, a window 212 is formed in the dial 21 at approximately 3:00 so that characters on the date wheel 45 can be seen from the outside.

The main plate 46 axially supports the gear train 44 on the dial 21 side, and gear train holder 47 axially supports the gear train 44 on the back cover 3 side. The main plate 46 and gear train holder 47 are non-conductive, non-magnetic members made from ceramic or plastic, for example.

The gear train 44, stepping motors 43A, 43B, and circuit block 42 are unitarily assembled between and with the main plate 46 and gear train holder 47, forming the movement 4.

The spacer ring 14 is a ring-shaped member along the inside circumference of the case 1, and encircles the outside edge of the movement 4. The spacer ring 14 is also made from a non-conductive and non-magnetic material such as ceramic or plastic.

The battery 49 is a primary cell or secondary cell with a metal can. The battery 49 is disposed in the approximate direction of 2:00 and occupies the space from approximately 1:00 to approximately 3:00.

Two antennae, first antenna 5A and second antenna 5B, are disposed inside the movement 4 in the approximate direction of 5:00. The first antenna 5A is located closer to the inside surface of the case 1, and the second antenna 5B is located closer to the center of the movement 4. At least the spacer ring 14 intervenes between the first antenna 5A and case 1, and the first antenna 5A and case 1 are separated a specific distance.

Figure 5:
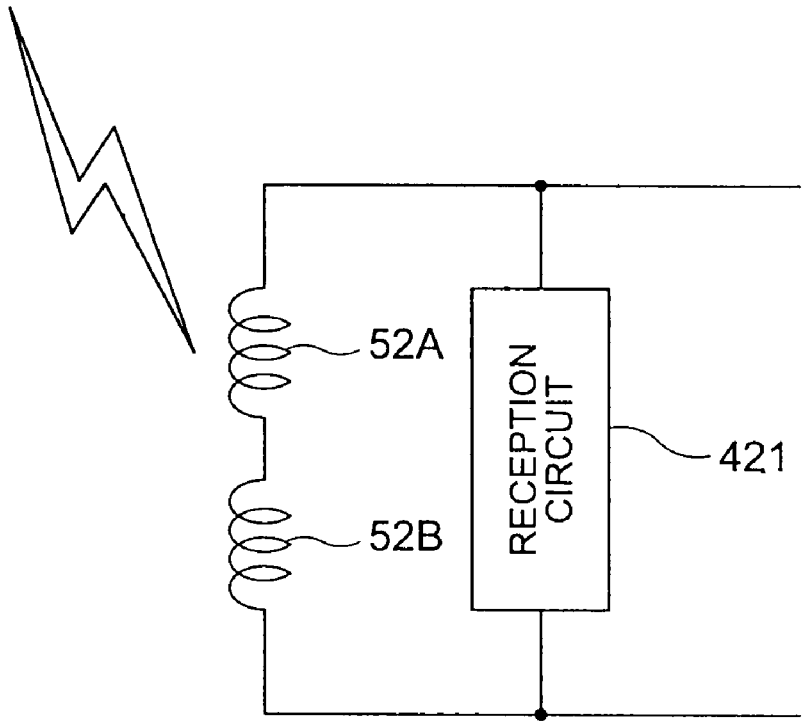
FIG. 5 shows the antenna connection in the first embodiment of the invention.

The first antenna 5A and second antenna 5B are composed of a coil 52A, 52B wound to a core 61A, 51B made from a high permeability rod material such as ferrite, pure iron, or amorphous metal. As shown in FIG. 5, the coil 52A of first antenna 5A and the coil 52B of second antenna 5B are connected in series.

The axes $L_{5A}$ and $L_{5B}$ of first antenna 5A and second antenna 5B are substantially parallel to the cylindrical axis $L_1$ of the case 1. The axes $L_{5A}$ and $L_{5B}$ of the first antenna 5A and second antenna 5B also intersect the dial 21 and back cover 3 disposed in the openings of the case 1, and the angle of intersection is approximately 90 degrees. The axis of the first antenna 5A intersects the date wheel 45 on the dial 21 side. The axial length of the first antenna 5A and second antenna 5B is substantially equal to the distance between the main plate 46 and gear train holder 47.

As shown in plan view in FIG. 1, the quartz oscillator unit 41 and circuit block 42 are disposed between the first and second antennae 5A and 5B and the hour hand stepping motor 43B. External operator 13 is positioned between the first and second antennae 5A and 5B and the battery 49.

The operation of the first embodiment of the invention thus comprised is described next below.

The current time of the time counter rendered in the central control circuit 423 is updated based on a reference clock generated by frequency dividing the oscillation of quartz oscillator 411. The positions of the hands (minute hand 221, hour hand 222) is also detected by the hand position detection circuit 426, and the result is output to central control circuit 423. The central control circuit 423 compares the hand positions with the value of the time counter, and based on the result drives the stepping motors 43A, 43B by way of motor drive circuit 425. The gear train 44 transfers rotation of the rotors 433A, 433B driven by the stepping motors 43A, 43B to the hands 221, 222, and the current time is displayed by the hands 221, 222 pointing to numbers on the time display surface 211.

standard radio signal reception and time adjustment based on the current time information from the standard radio signal are described next.

At 2:00 a.m., which is the reception start time set in the reception control circuit 424, the reception control circuit 424 outputs a start-reception command to the reception circuit 421. The reception control circuit 424 also outputs a start-reception command to the reception circuit 421 when the external operator 13 is operated to unconditionally start reception.

Because the case 1 is open along the cylindrical axis $L_1$, the field component of the standard radio signal enters the case 1 from this opening. The magnetic field of the standard radio signal passes the gear train holder 47, dial 21, date wheel 45, main plate 46, and back cover 3 disposed in the opening and is picked up by the coil 52A, 52B. The standard radio signal is thus received by the antennae 5A and 5B. When the reception circuit 421 receives the start-reception command, power is also supplied from the battery 49 and the reception circuit 421 starts decoding the signal (time information) received by the antennae 5A and 5B.

The decoded time information is temporarily stored in memory circuit 422 for each of multiple received signals (6, for example), and the time information acquired from one signal is compared with the time information from the preceding and following signals to determine reception accuracy. The current time setting of the time counter is then corrected by the time-setting circuit of the central control circuit 423 according to accurately received time information. The hand positions are then corrected according to the value of the time counter, and the time is displayed according to the received time.

This embodiment of the present invention offers the following benefits.

(1) A luxurious appearance is afforded by making the case 1 from metal. Furthermore, making the case 1 from metal has no effect on the reception performance of the antennae 5A and 5B because standard radio signals entering the case 1 from the openings along the cylindrical axis $L_1$ of the case 1 are received by the antennae 5A and 5B.

(2) The standard radio signal field can penetrate the case 1 through the openings in the case 1 along the cylindrical axis $L_1$ because the case 1 is open on both sides along the cylindrical axis $L_1$. In addition, the axes $L_{5A}$ and $L_{5B}$ of the antennae 5A and 5B are substantially parallel to the cylindrical axis $L_1$ of the case 1. The standard radio signal is thus received by the antennae 5A and 5B because the field entering the case 1 passes the core 51A, 51B disposed in the center of each coil 52A, 52B. Moreover, because the lines of the field penetrating the case 1 are substantially parallel to the axes $L_{5A}$ and $L_{5B}$ of the antennae 5A and 5B, flux linkage to the antennae 5A and 5B is maximized and the reception performance of the antennae 5A and 5B is significantly improved.

(3) Because both sides of the case 1 are open along its cylindrical axis $L_1$, the standard radio signal field can enter the case 1 from the case 1 openings without any interference, and the axes $L_{5A}$ and $L_{5B}$ of the antennae 5A and 5B are aligned with the direction in which the field entering the case 1 varies. The reception performance of the antennae 5A and 5B is thus improved because the field of the standard radio signal entering the case 1 links directly with the antennae 5A and 5B.

Because the reception performance of the antennae 5A and 5B is improved, sufficient reception performance is assured even if the size of the antennae 5A and 5B is reduced. The size of the radio-controlled timepiece 100 can therefore also be reduced because smaller antennae 5A and 5B can be used.

(4) The dial 21, 23, back cover 3, main plate 46, gear train holder 47, and date wheel 45 are also made from materials that are both non-conductive and non-magnetic. The standard radio signal is therefore not blocked along the cylindrical axis $L_1$ of the case 1. As a result, field fluctuations in the standard radio signal can enter the case 1 along the cylindrical axis $L_1$ of the case 1.

(5) When seen in plan view the stem 131 is disposed between the antennae 5A and 5B and battery 49, and the circuit block 42 is disposed between the hour hand stepping motor 43B and antennae 5A, 5B. The battery 49, which has a metal case, and the stepping motor 43B, which produces a magnetic field, could affect signal reception by the antennae 5A and 5B, but sufficient distance is assured between the antennae 5A and 5B and the battery 49 and stepping motor 43B by rendering the stem 131 and circuit block 42 therebetween. The antennae 5A and 5B can therefore receive the standard radio signal without being affected by the battery 49 and stepping motor 43B.

(6) The spacer ring 14 is made from a non-conductive, non-magnetic material, and is disposed between the antennae 5A and 5B and the case 1. If the antennae 5A and 5B are located adjacent to the case 1, the standard radio signal field will flow to the metal case 1 instead of to the antennae 5A and 5B, and the reception performance of the antennae 5A and 5B could drop. The reception performance of the antennae 5A and 5B is maintained in this embodiment of the invention, however, because distance between the case 1 and antennae 5A and 5B is assured by the non-conductive, non-magnetic spacer ring 14.

(7) Because the antennae 5A and 5B are located at the 5:00 position and the time signal is received at 2:00 a.m., the hands 221, 222 are not positioned over the axis of the antennae 5A and 5B when the time signal is received. Reception of the standard radio signal by the antennae 5A and 5B is therefore not affected even though the hands 221, 222 are metal, and the metal hands 221, 222 make it possible to improve the appearance and render a luxurious design.

(8) Because the first antenna 5A and second antenna 5B are connected in series, reception performance can be improved by combining the signals received by the first antenna 5A and second antenna 5B.

(9) A minute hand stepping motor 43A and hour hand stepping motor 43B are disposed, and the minute hand 221 and hour hand 222 are driven separately by the respective stepping motors 43A, 43B. When the time is adjusted based on the received time information, the minute hand 221 and hour hand 222 can therefore be driven independently, and the hand positions can be adjusted immediately. For example, compared with advancing the hour hand 222 one index in conjunction with advancing the 221 one revolution, the hour can be adjusted more quickly and less power is consumed to adjust the hour hand because the hour hand 222 can be driven directly.

(10) The drive coils 431A, 431B of the stepping motors 43A, 43B are disposed at a 90 degree angle to each other. The magnetic flux of one coil therefore does not interfere with the flux of the other coil, and there is no interference with the rotational control of the rotors 433A, 433B. The hands 221, 222 can therefore be driven accurately.

Second Embodiment

A second embodiment of a radio-controlled timepiece is described below as an electronic timepiece with wireless information function according to the present invention with reference to FIGS. 6 to 8.

Figure 6:
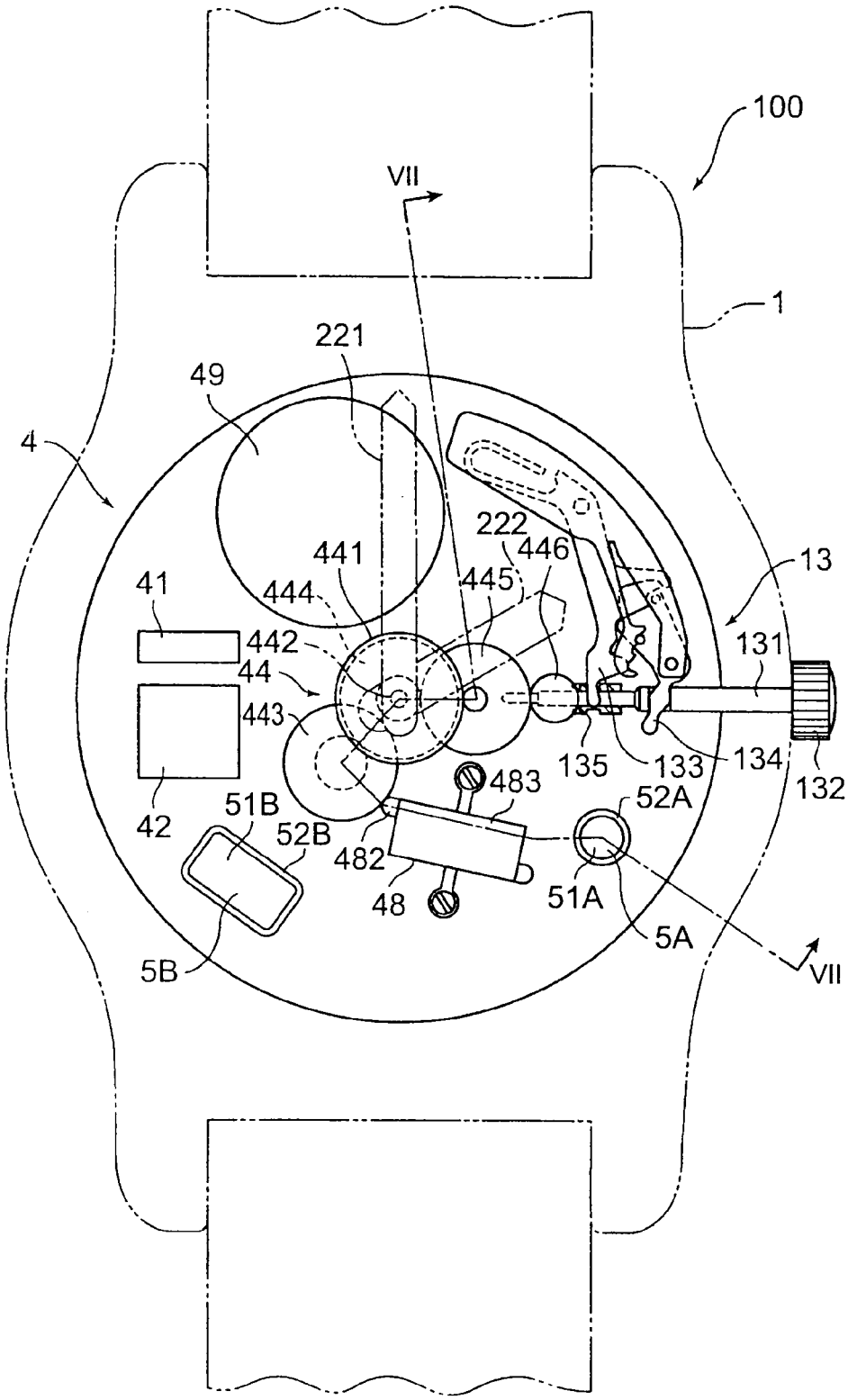
FIG. 6 is a plan view of an electronic timepiece with wireless information function according to a second embodiment of the present invention.
Figure 7:
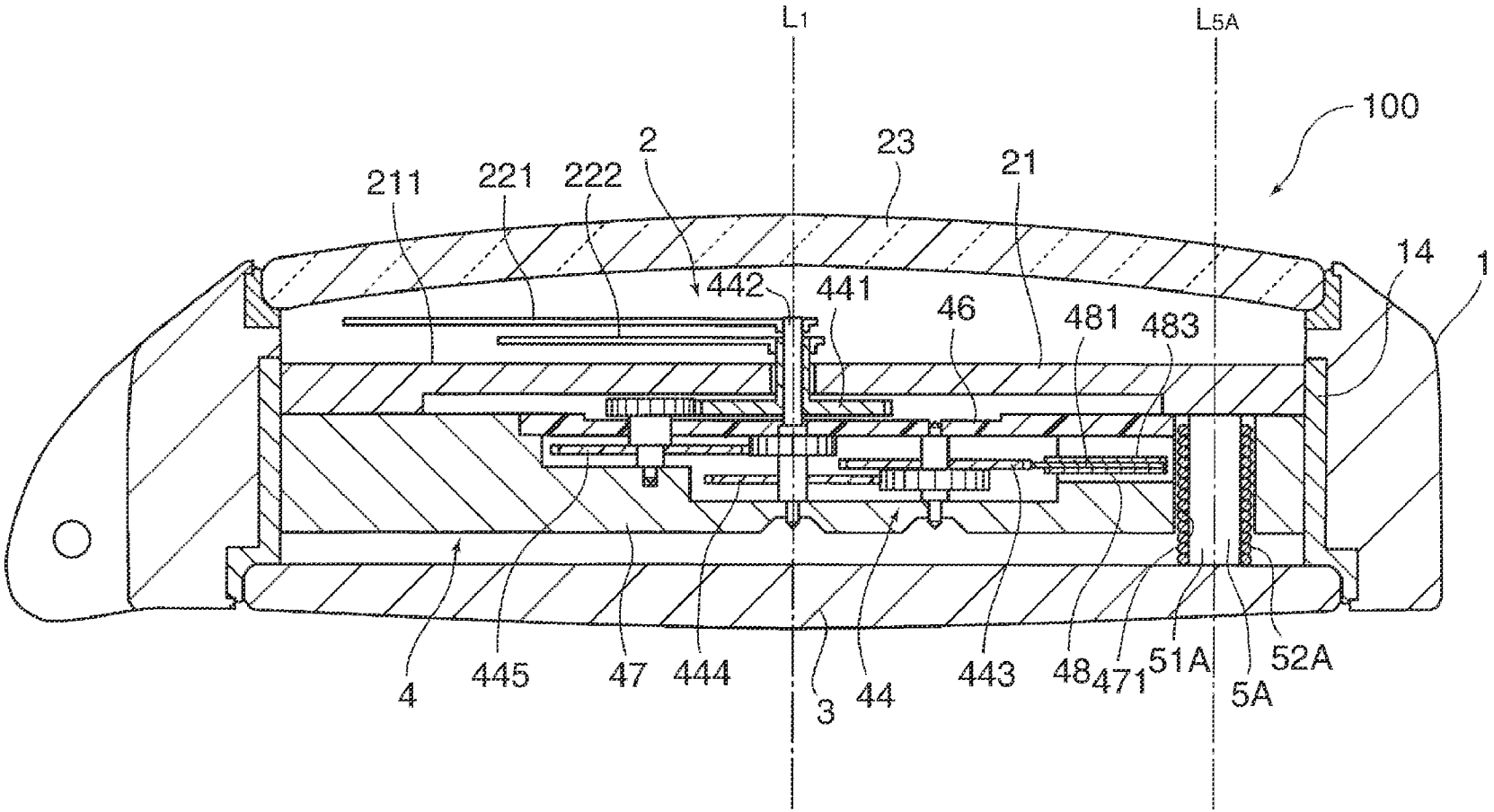
FIG. 7 is a section view of the second embodiment through line VII-VII in FIG. 6.
Figure 8:
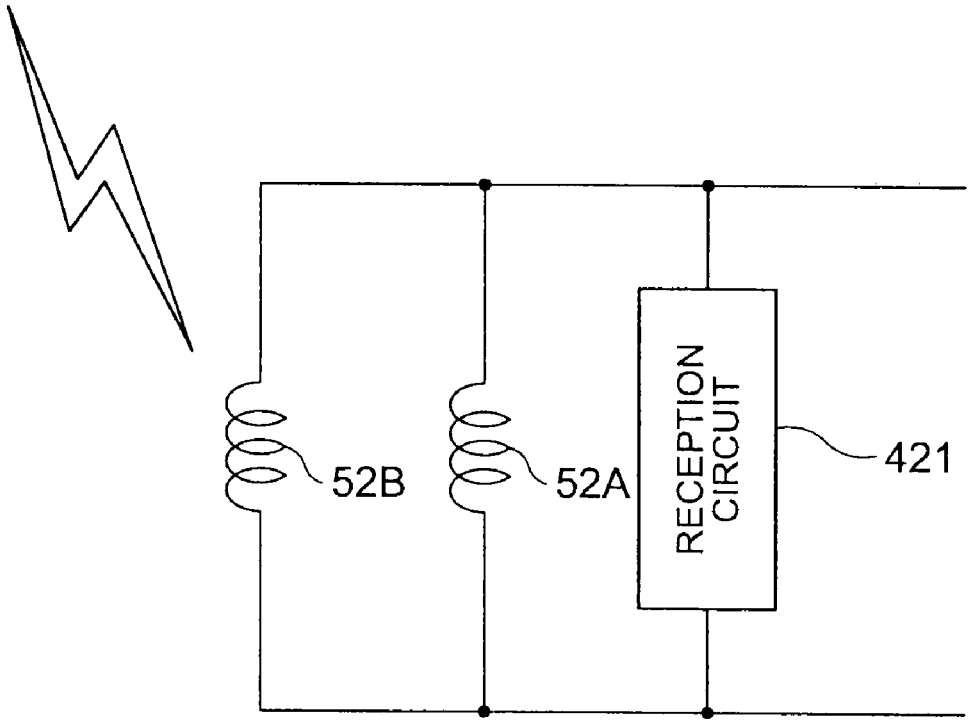
FIG. 8 shows the antenna connection in the second embodiment of the invention.

FIG. 6 is a plan view of this second embodiment from the dial side, FIG. 7 is a section view through line VII-VII in FIG. 6, and FIG. 8 shows the antenna connection.

The basic configuration of this second embodiment (including the basic construction and part materials) is the same as in the first embodiment. This second embodiment differs from the first embodiment in the material of the dial 21 and back cover 3, the configuration of the movement 4, and the placement of the antennae 5A and 5B.

The dial 21 and back cover 3 are rendered as in the first embodiment except that this dial 21 and back cover 3 are made from a high permeability material such as pure iron, permalloy, or amorphous metal (such as amorphous Fe or Co).

The dial 21 and back cover 3 are isolated from the case 1, which is made of metal as in the first embodiment, by the spacer ring 14, which is made from plastic or other non-conductive material.

The movement 4 is composed of a quartz oscillator unit 41 including a quartz oscillator 411, a circuit block 42 having a control function, piezoactuator 48 as a drive unit for rotating the hands 221, 222, a gear train 44 for transferring power from the piezoactuator 48 to the hands 221, 222, and a main plate 46 and gear train holder 47 holding the gear train 44 therebetween along the cylindrical axis $L_1$ of the case 1.

The quartz oscillator unit 41 and circuit block 42 are disposed in the approximate direction of 9:00. The quartz oscillator unit 41 and circuit block 42 are configured as in the first embodiment.

The drive unit is composed of piezoactuator 48. The piezoactuator 48 is composed of a rectangular, flat reinforcing plate 481, piezoelectric element 483 affixed to front and back sides of the reinforcing plate 481, and electrodes (not shown in the figure) rendered on the surface of the piezoelectric element 483. The piezoelectric element 483 is excited by an AC voltage applied to the electrodes, causing bumps 482 formed at diagonally opposite corners of the reinforcing plate 481 to move in a substantially circular path.

The gear train 44 is composed of first wheel 443, which is pushed by the bumps 482 of the piezoactuator 48 and rotated by the circular motion of the bumps 482; second wheel 444, which meshes with the first wheel 443 and rotates in unison with the minute hand arbor 442 to which the minute hand 221 is connected; day wheel 445, which speed reduces rotation of the second wheel 444 to a specified frequency; and center wheel 441, which meshes with the day wheel 445 and to which the hour hand 222 is connected.

A set wheel 446 engages the day wheel 445, and when the stem 131 is pulled out, the clutch wheel 135 disposed to the one end of the stem 131 is pushed by the yoke 133 and engages the set wheel 446.

Two antennae, first antenna 5A and second antenna 5B, are rendered as in the first embodiment, except that the first antenna 5A is located in the approximate direction of 4:00 and the second antenna 5B is located in the approximate direction of 7:00.

As in the first embodiment, the first antenna 5A and second antenna 5B are composed of a coil 52A, 52B wound to a core 51A, 51B, which is a rod made from a high permeability material such as ferrite, pure iron, or amorphous metal.

The ferrite core 51B of the second antenna 5B has a rectangular section. The coil 52A of first antenna 5A and the coil 52B of second antenna 5B are parallel connected as shown in FIG. 8.

Note that the coil 52A of first antenna 5A and the coil 52B of second antenna 5B could be connected in series as shown in FIG. 5.

The first antenna 5A and second antenna 5B are disposed with their axes $L_{5A}$ and $L_{5B}$ substantially parallel to the cylindrical axis $L_1$ of the case 1, and the ends of the first antenna 5A and second antenna 5B touch the dial 21 and back cover 3.

Through-holes 471 through which pass the first antenna 5A and second antenna 5B are formed in the gear train holder 47.

It should be noted that if the ends of the first antenna 5A and second antenna 5B are sufficiently close to the dial 21 and back cover 3, the ends of the antennae 5A and 5B do not need to touch the dial 21 or back cover 3.

The dial 21 and back cover 3 are made from the same material as the antenna cores 51A, 51B in order to reduce the magnetic resistance to the antenna cores 51A, 51B.

Operation of this second embodiment thus comprised is described next.

The piezoactuator 48 is driven by way of the motor drive circuit 425 based on comparison of the hand positions and the value of the time counter. Drive from the piezoactuator 48 is transferred by way of gear train 44 to the hands 221, 222, and the current time is displayed by the hands 221, 222 pointing to numbers on the time display surface 211.

The high permeability of the dial 21 and back cover 3 draws the magnetic field of the standard radio signal to the dial 21 and back cover 3. The field pulled to the dial 21 and back cover 3 then passes the core 51A, 51B of antennae 5A and 5B and is picked up by the coil 52A, 52B so that the standard radio signal is received by the antennae 5A and 5B. The time is then adjusted according to the time information received by the antennae 5A and 5B.

In addition to the same benefits (1) to (7) of the previous embodiment described above, this second embodiment of the invention affords the following benefits.

(11) Because the dial 21 and back cover 3 are made from a high permeability material, the magnetic field of the standard radio signal is guided to the antennae 5A and 5B by the large surfaces of the dial 21 and back cover 3. The reception performance of the antennae 5A and 5B is thus improved.

(12) Because the dial 21 and back cover 3 made of a high permeability material are isolated from the case 1, the field component of the standard radio signal inducted by the dial 21 and back cover 3 does not dissipate into the case 1. The entire field component of the standard radio signal inducted by the dial 21 and back cover 3 is thus guided to the antennae 5A and 5B, and the reception performance of the antennae 5A and 5B is improved.

(13) The piezoactuator 48 does not produce a magnetic field even when driven, and the reception performance of the antennae 5A and 5B is therefore not affected even if the piezoactuator 48 is disposed proximally to the antennae 5A and 5B.

If the dial 21 and back cover 3 are made from a high permeability material when a stepping motor, for example, that generates a magnetic field is used, the field produced by the stepping motor will flow through the dial 21 and back cover 3 to the antennae 5A and 5B. However, by using a piezoactuator 48 that does not produce a magnetic field, the high permeability dial 21 and back cover 3 in this embodiment of the invention can pull in the standard radio signal, and the reception performance of the antennae 5A and 5B can be improved.

(14) A setting mechanism (hands adjusting unit) composed of the stem 131, yoke 133, setting lever 134, and clutch wheel 135 is rendered between the first antenna 5A and battery 49, and the quartz oscillator unit 41 and circuit block 42 are disposed between the second antenna 5B and battery 49. Because the case of the battery 49 is metal, magnetic flux inducted by the dial 21 and back cover 3 near the battery 49 is easily inducted by the battery 49 case. However, positioning the stem 131 and circuit block 42, for example, between the battery 49 and antennae 5A and 5B separates the antennae 5A and 5B from the battery 49. As a result, sufficient flux linkage to the antennae 5A and 5B is assured, and the reception performance of the antennae 5A and 5B is improved.

(16) Because the antennae 5A and 5B are parallel connected, the time can be adjusted using the time information received by either one of the antennae 5A and 5B. The likelihood of successful reception can therefore be improved.

Third Embodiment

A third embodiment of a radio-controlled timepiece is described below as an electronic timepiece with wireless information function according to the present invention with reference to FIGS. 9 and 10.

Figure 9:
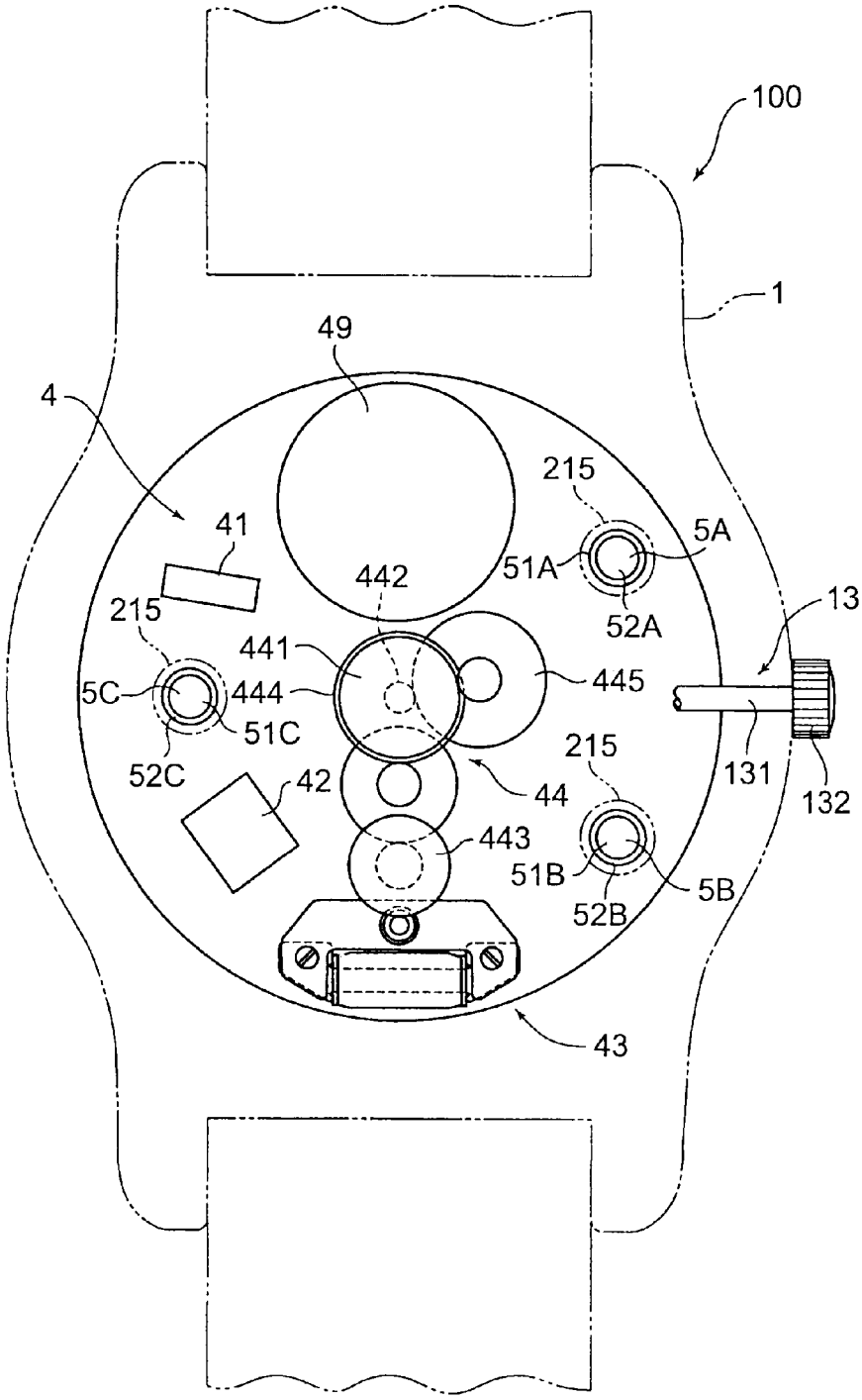
FIG. 9 is a plan view of an electronic timepiece with wireless information function according to a third embodiment of the present invention.
Figure 10:
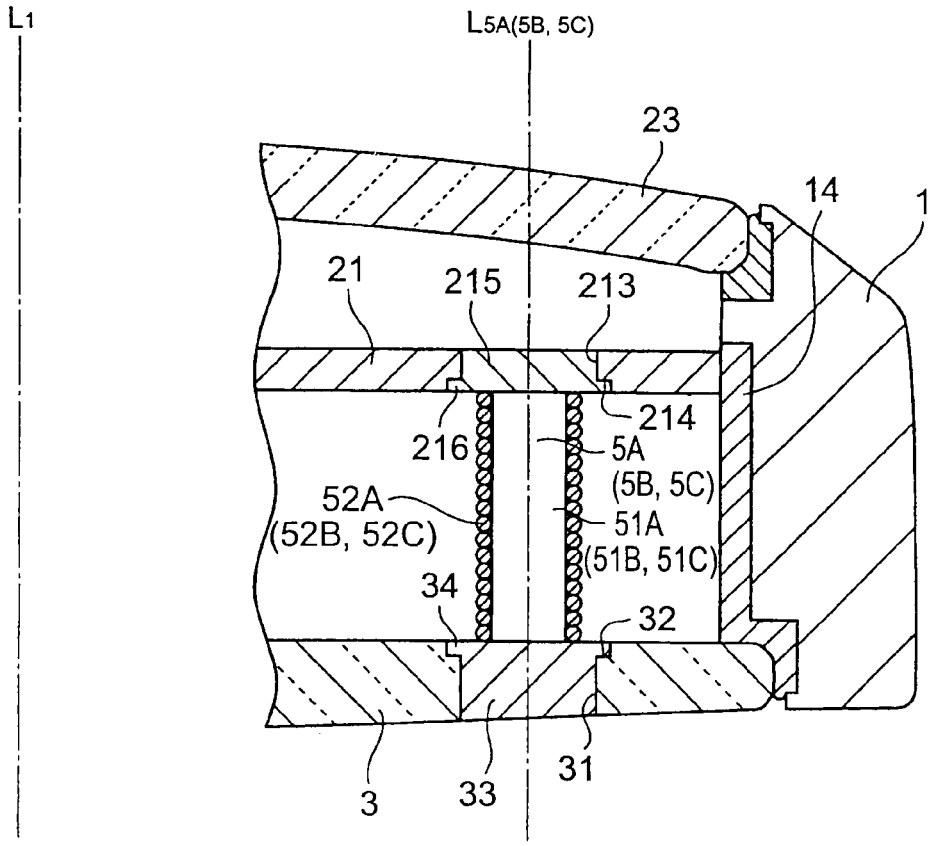
FIG. 10 is a partial section view of a third embodiment of the invention.

FIG. 9 is a plan view of the main components seen from the dial side of this third embodiment, and FIG. 10 is a partial section view of the antenna area.

The basic configuration of this third embodiment (including the basic construction and part materials) is the same as in the first embodiment, but is differentiated therefrom in the number and arrangement of the antennae, and the dial and back cover.

As in the first embodiment, the case 1 is metal.

There are three antennae, first antenna 5A, second antenna 5B, and a third antenna 5C. The first antenna 5A is disposed in the approximate direction of 2:00, the second antenna 5B in the approximate direction of 4:00, and the third antenna 5C in the approximate direction of 9:00. The first, second, and third antennae 5A, 5B, 5C could be all connected in series or parallel connected. A combination of parallel and serial connections is also possible. For example, first antenna 5A and second antenna 5B could be series connected while third antenna 5C is parallel connected to first antenna 5A and second antenna 5B.

The axes $L_{5A,\ 5B,\ 5C}$ of antennae 5A, 5B, 5C are also substantially parallel to the cylindrical axis $L_1$ of case 1.

There is only one stepping motor 43, and the gear train 44 is composed of first wheel 443, which is rotationally driven by the stepping motor 43; a second wheel 444, which the first wheel 443 turns in unison with the minute hand arbor 442; a day wheel 445 that speed reduces rotation of the minute hand arbor 442 to a specified frequency; and center wheel 441, which meshes with the day wheel 445 and to which the hour hand 222 is connected.

The stepping motor 43 is disposed in the approximate direction of 6:00.

A quartz oscillator unit 41 and circuit block 42 are also provided, the quartz oscillator unit 41 disposed to approximately 10:00 and the circuit block 42 to approximately 8:00. The third antenna 5C is positioned between the quartz oscillator unit 41 and circuit block 42.

The dial 21 and back cover 3 are both made of a non-conductive and non-magnetic material such as mineral glass or ceramic. As shown in FIG. 10, through-holes 213, 31 are rendered in the dial 21 and back cover 3 at locations corresponding to the core 51A to 51C of antennae 5A to 5C. Each of the through-holes 213, 31 has a shoulder 214, 32 increasing the hole diameter on the inside of the case 1. A high permeability member 215, 33 (such as pure iron, permalloy, or amorphous metal) is embedded in the through-holes 213, 31. The high permeability members 215, 33 have a flange 216, 34 that sits on the shoulder 214, 32 of the through-hole 213, 31. The high permeability members 215, 33 are pressed into the through-holes 213, 31 from the inside of the case 1, and are pushed toward the outside by pressure from the core 51A to 51C of the antennae 5A to 5C. That is, the high permeability member 215, 33 contacts the core 51A to 51C of the antennae 5A to 5C. It should be noted that to lower the magnetic resistance to the antenna core 51A to 5C, the high permeability members 215, 33 are made from the same material as the antenna core 51A to 5C.

In addition to the benefits numbered (1) to (3) and (6) of the preceding embodiments, this third embodiment of the invention affords the following benefits.

(16) The standard radio signal field is inducted to the antennae 5A to 5C by the high permeability member 215, 33 axially disposed to the antennae 5A to 5C. As a result, the flux linkage of the antennae 5A to 5C is increased and the reception performance of the antennae 5A to 5C is improved.

(17) Because the high permeability members 215, 33 are positioned axially only to the antennae 5A to 5C, the possibility of the magnetic field produced by the stepping motor 43 driving the hands 221, 222 through intervening gear train 44 being guided to the antennae 5A to 5C can be reduced. The likelihood that much of the magnetic field generated by the stepping motor 43 will be guided to the antennae 5A to 5C is higher if the dial 21 and back cover 3 are made completely from a high permeability material. However, because the high permeability members 215, 33 are disposed only axially to the antennae 5A to 5C and the high permeability member 215, 33 do not overlap the plane area of the stepping motor 43, the likelihood of the magnetic field from the stepping motor 43 traveling through the high permeability member 215, 33 and affecting the antennae 5A to 5C can be reduced.

(18) The quartz oscillator unit 41 is located between the third antenna 5C and battery 49, and the circuit block 42 is located between the third antenna 5C and stepping motor 43. The effect of the battery 49 and stepping motor 43 on the third antenna 5C is therefore small, and high reception performance can be maintained.

(19) Because a rigid high permeability member 215, 33 is disposed at a position contacting the ends of antennae 5A and 5B [sic], the core 51A to 51C of antennae 5A to 5C can be supported by the high permeability member 215, 33 even when it is difficult to support the antennae 5A, 5B, 5C with only a dial 21 and back cover 3 made of mineral glass or ceramic.

Fourth Embodiment

Figure 11:
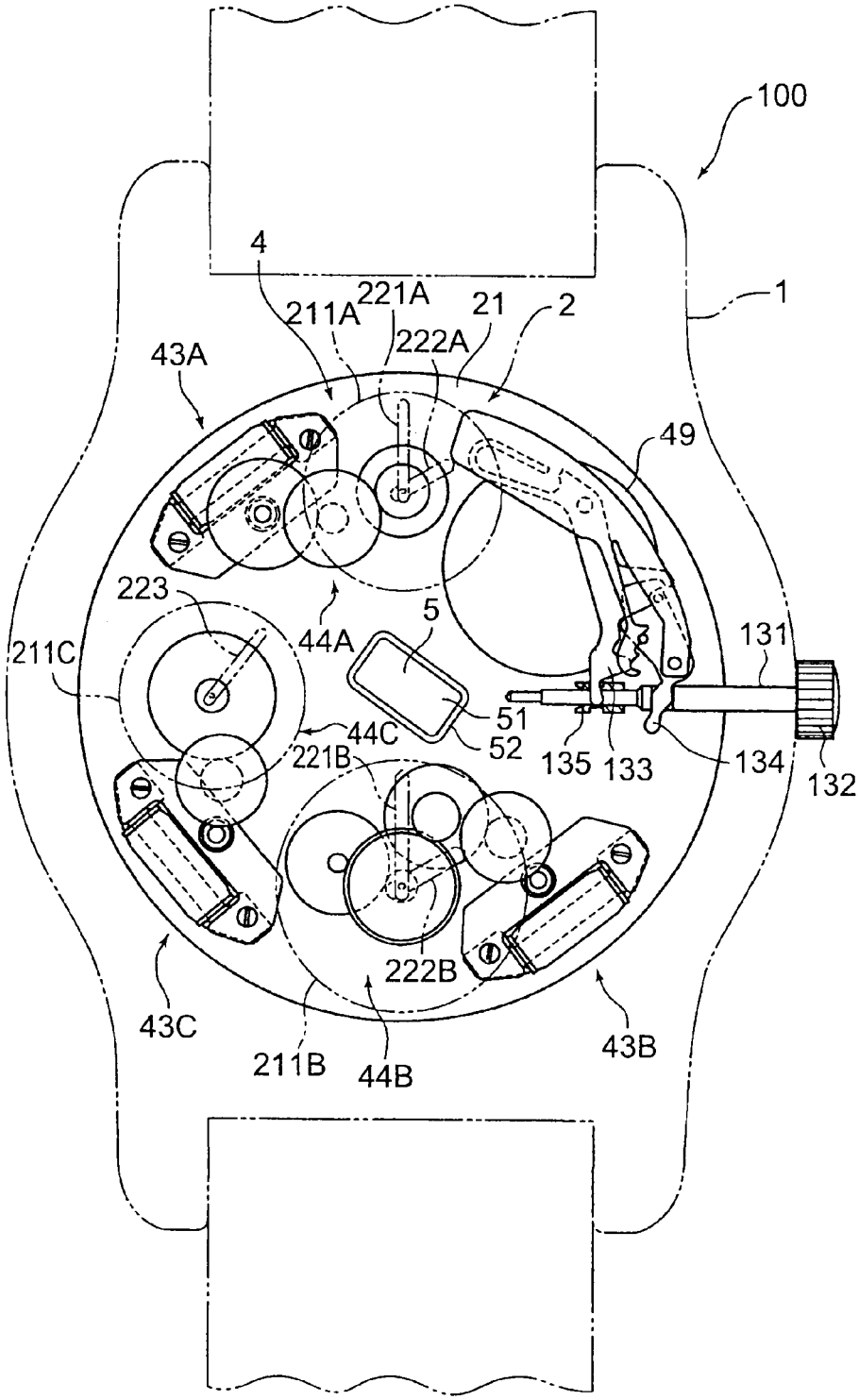
FIG. 11 is a plan view of an electronic timepiece with wireless information function according to a fourth embodiment of the present invention.

A fourth embodiment of a radio-controlled timepiece is described below as an electronic timepiece with wireless information function according to the present invention with reference to FIG. 11, which is a plan view showing the arrangement of the major components seen from the dial side of this fourth embodiment.

The basic configuration of this fourth embodiment (including the basic construction and part materials) is the same as in the first embodiment, but is differentiated therefrom in the configuration of the movement and the antennae placement.

As in the first embodiment, a time display 2 is disposed to one of the openings in the metal case 1. This time display 2 is composed of a dial 21 with a time display surface 211 substantially perpendicular to the cylindrical axis of the case 1 (perpendicular to the surface of the page of FIG. 11), and hands that rotate over the surface of this dial 21.

There are three subdials 211 on the dial 21. One subdial 211A is disposed in the approximate direction of 12:00 near the outside edge of the dial and displays the alarm time, one subdial 211B is disposed in the approximate direction of 6:00 near the outside edge of the dial and displays the current time, and the remaining one subdial 211C is disposed in the approximate direction of 9:00 near the outside edge of the dial and displays the seconds.

Rotating hands are respectively disposed to each of the subdials 211A to 211C. More specifically, hour hand 222A and minute hand 221A for the alarm are disposed to the subdial 211A in the approximate direction of 12:00, hour hand 22B and minute hand 221B for showing the current time are disposed to the subdial 211B in the approximate direction of 6:00, and second hand 223C for indicating the second is disposed to the subdial 211C in the approximate direction of 9:00.

The movement 4 is composed of a quartz oscillator unit (not shown in the figure) containing a quartz oscillator, a circuit block (not shown in the figure) with a control function, stepping motors 43A to 43C as the drive unit for turning the hands, gear trains 44A to 44C for transferring drive power from the stepping motors 43A to 43C to the hands, and a main plate (not shown in the figure) and gear train holder (not shown in the figure) holding the gear trains 44A to 44C therebetween along the cylindrical axis of the case 1.

Three stepping motors 43A to 43C are provided as the drive unit. Alarm stepping motor 43A drives the hour and minute hands 221A, 222A for the alarm; current time stepping motor 43B drives the hour and minute hands 221B, 222B for indicating the current time; and second hand stepping motor 43C for driving the second hand 223.

The alarm stepping motor 43A is disposed in the approximate direction of 10:00, the current time stepping motor 43B in the approximate direction of 4:00, and the second hand stepping motor 43C in the approximate direction of 8:00. The stepping motors 43A to 43C are disposed near the outside edge of the movement 4 held in the case 1.

The gear trains include a gear train 44A for transferring rotation from the alarm stepping motor 43A to the alarm hands, a gear train 44B for transferring rotation from the current time stepping motor 43B to the hands for showing the current time, and a gear train 44C for transferring rotation from the second hand stepping motor 43C to the second hand.

The battery 49 is disposed in the approximate direction of 2:00.

The antenna 5 is composed of a coil 52 wound to a core 51 that is rectangular in section, and is disposed near the center of the case. The axis of the antenna 5 (perpendicular to the surface of FIG. 11) is substantially parallel to the cylindrical axis of the case 1.

In addition to the benefits numbered (1) to (5) of the preceding embodiments, this fourth embodiment of the invention affords the following benefits.

(20) A large space is left in the center by disposing the stepping motors 43A to 43C and gear trains 44A to 44C near the outside edge of the movement 4, and the surface area of the antenna 5 can be increased by locating the antenna 5 in the center of the movement 4. As a result, flux linkage to the antenna 5 can be increased, and the reception performance of the antenna 5 can be improved.

Fifth Embodiment

A fifth embodiment of a radio-controlled timepiece is described below as an electronic timepiece with wireless information function according to the present invention with reference to FIG. 12, which is a partial section view of the antenna and neighborhood in this fifth embodiment.

The basic configuration of this fifth embodiment (including the basic construction and part materials) is the same as in the first embodiment, but is differentiated therefrom in the orientation of the antennae axes.

Figure 12:
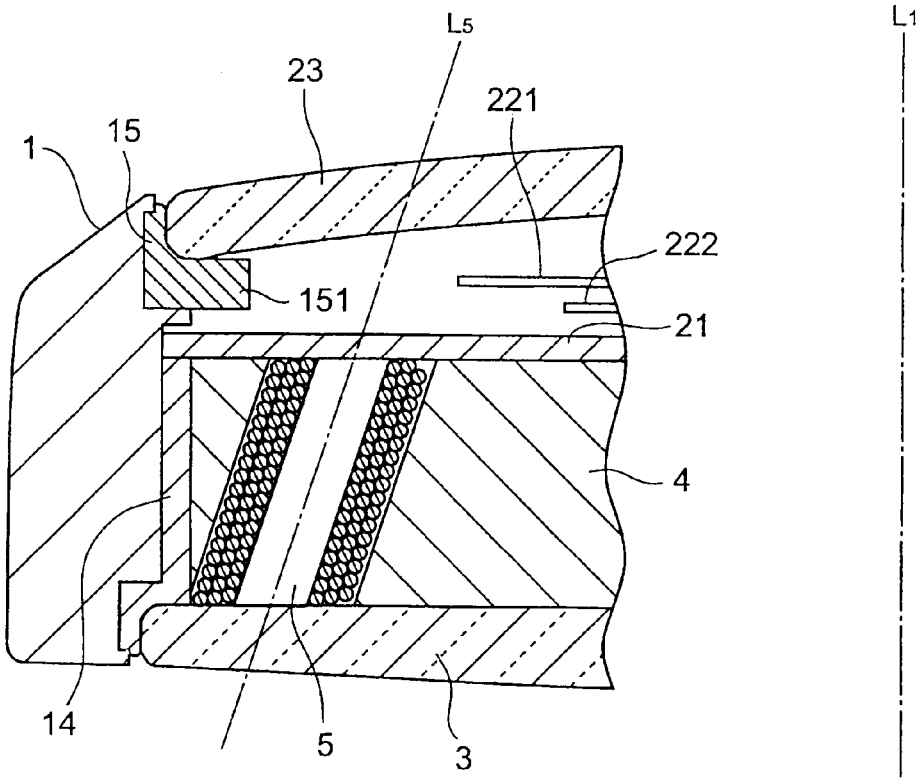
FIG. 12 is a partial section view of an electronic timepiece with wireless information function according to a fifth embodiment of the present invention.

As shown in FIG. 12, the case 1 is made of metal as in the first embodiment, and has a metal dial ring 15 disposed between the case 1 and crystal 23. The dial ring 15 has a flange 151 projecting slightly from the opening edge into the center of the opening in the case 1. The shape of the edge of the dial 21 as seen from the hands side of the dial is determined by the dial ring 15, and the design can be improved by the decorativeness of the dial ring 15 and the decorativeness of the dial.

The antenna 5 is held between the dial 21 and back cover 3, and is rendered adjacent to the case 1 with the plastic spacer ring 14 therebetween. The antenna 5 axis $L_5$ is inclined slightly relative to the cylindrical axis $L_1$ of the case 1. More specifically, the end of the antenna 5 on the dial 21 side is offset toward the center of the case 1 a slight distance sufficient for the axis $L_5$ of the antenna 5 to be offset from the flange 151 of the dial ring 15. The inclination angle of the antenna 5 is not specifically limited, and could be any angle, such as 45 degrees, 30 degrees, 15 degrees, 10 degrees, or 5 degrees, offsetting the axis $L_5$ of the antenna 5 slightly from the dial ring 15 and within the range where the axis $L_5$ of the antenna 5 passes the openings in the case 1.

The dial 21 and back cover 3 are made from a non-conductive and non-magnetic material.

In addition to the benefits numbered (1) to (6) of the preceding embodiments, this fifth embodiment of the invention affords the following benefits.

(21) Inclining the axis of the antenna 5 prevents the antenna 5 axis $L_5$ from intersecting a metal member (dial ring 15) disposed inside the opening of the case 1. The magnetic field of the standard radio signal is therefore not blocked by said metal member (dial ring 15) along the antenna 5 axis $L_5$, and the field component of the standard radio signal entering from the case 1 opening can be picked up by the antenna 5. The reception performance of the antenna 5 is thereby improved.

Sixth Embodiment

A sixth embodiment of a radio-controlled timepiece is described below as an electronic timepiece with wireless information function according to the present invention with reference to FIG. 13, which is a plan view of major components showing the plane arrangement of the antenna 5 in this sixth embodiment.

The basic configuration of this sixth embodiment (including the basic construction and part materials) is the same as in the first embodiment, but is differentiated therefrom in the configuration and placement of the antenna.

The antenna 5 is rendered in the movement 4 in an arc along the outside edge of the movement 4, and is composed of a coil 52 wound to a core 51 that is arc-shaped in section conforming to the inside circumference of the case 1. The antenna 5 is disposed at the outside edge of the movement 4.

A spacer ring 14 holding the movement 4 to the case 1 is disposed on the inside of the case 1. The spacer ring 14 is a non-conductive, non-magnetic member such as plastic. Because this spacer ring 14 intervenes between the antenna 5 and case 1, the antenna 5 is separated from the case 1, and the antenna 5 and case 1 are electrically isolated by the spacer ring 14.

Figure 13:
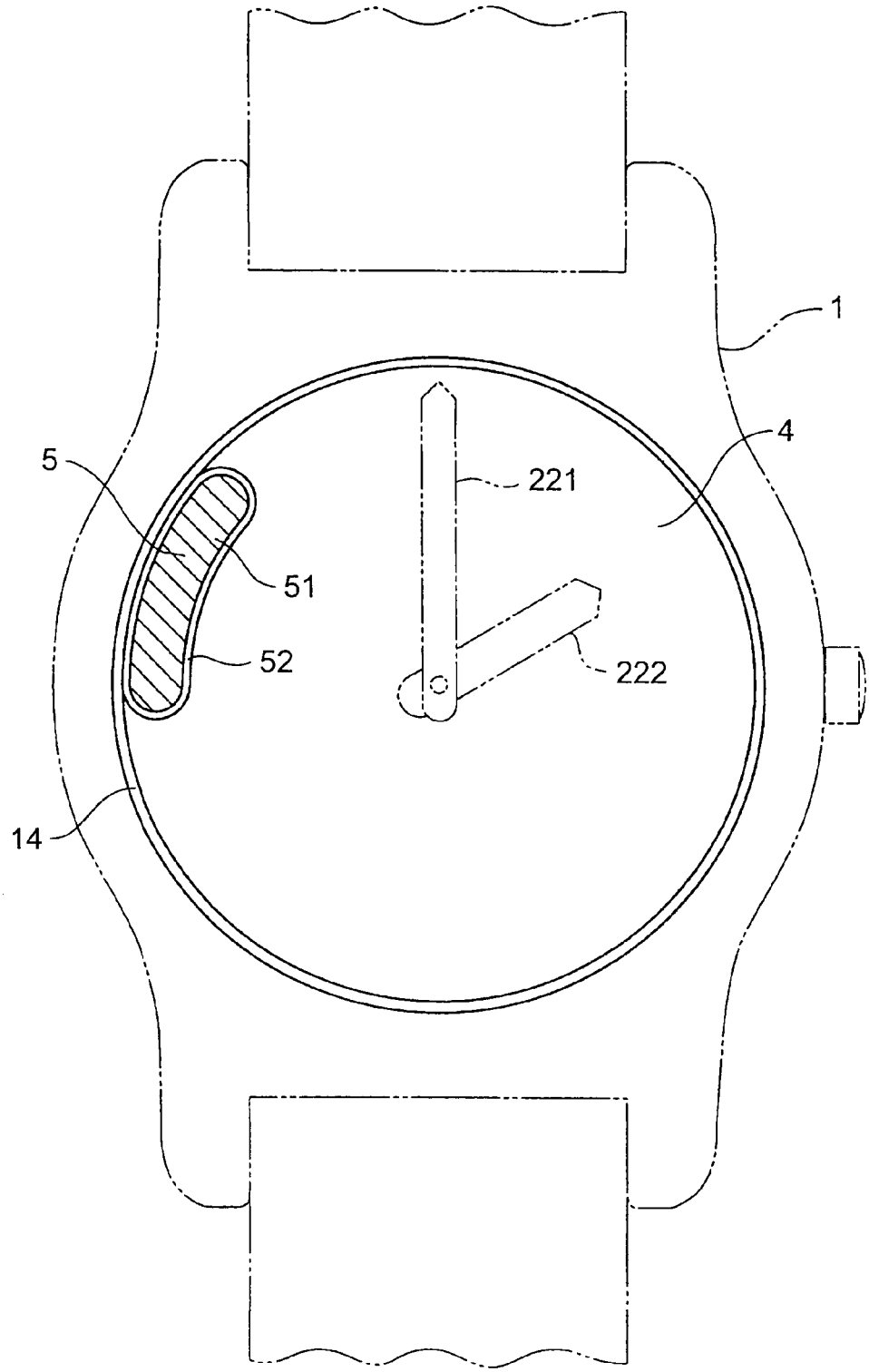
FIG. 13 is a plan view of an electronic timepiece with wireless information function according to a sixth embodiment of the present invention.

The axis of the antenna 5 (perpendicular to the surface of FIG. 13) is substantially parallel to the cylindrical axis of the case 1 (also perpendicular to the surface of FIG. 13).

In addition to the benefits numbered (1) to (6) of the preceding embodiments, this sixth embodiment of the invention affords the following benefits.

(22) Because the antenna 5 located between the outside edge of the movement 4 and the case 1, the movement 4 can be assembled to the large space in the center of the case 1. Furthermore, because the antenna 5 is shaped according to the inside circumference of the case 1, dead space is eliminated and space can be used more efficiently.

Seventh Embodiment

Figure 14:
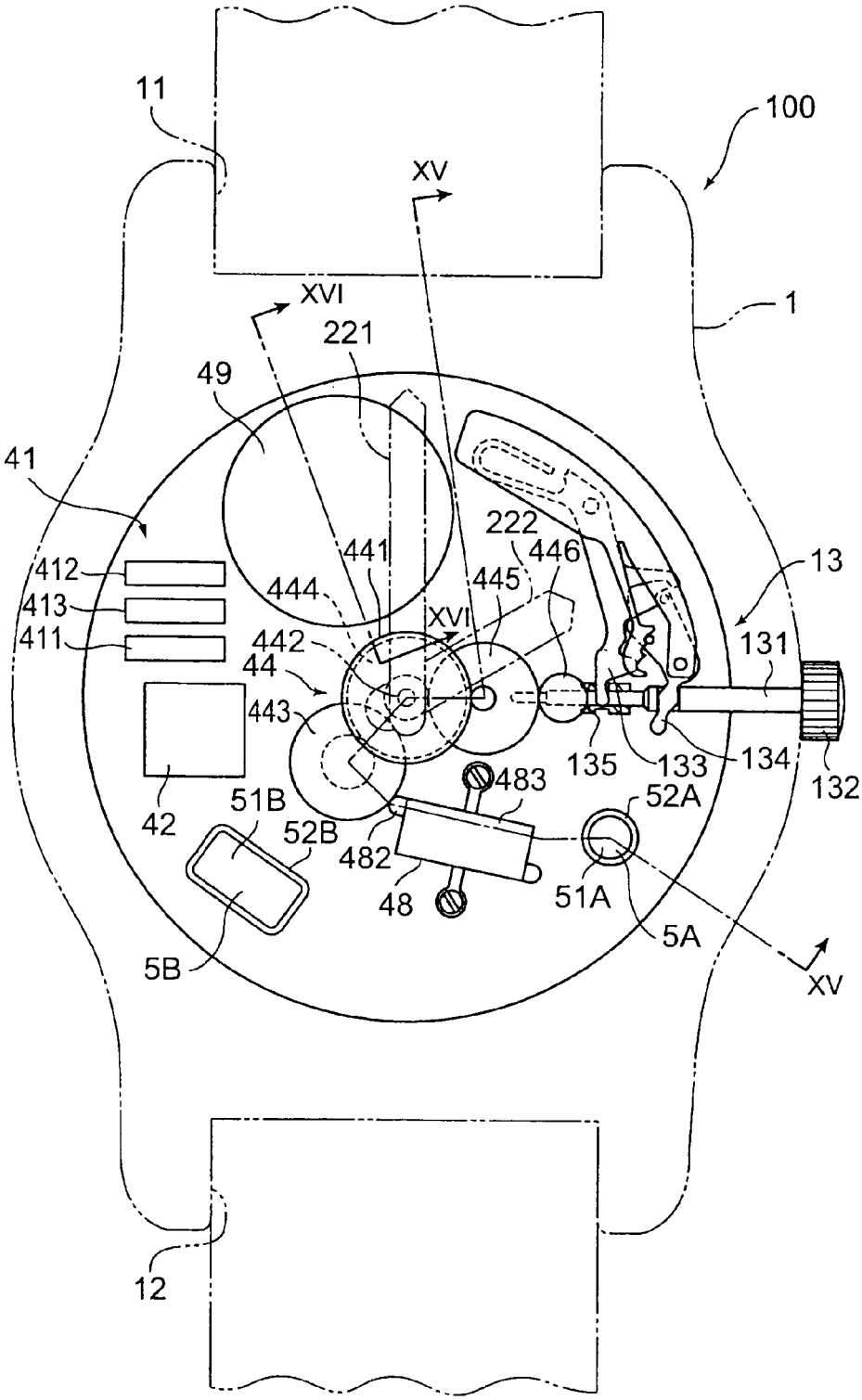
FIG. 14 is a plan view of an electronic timepiece with wireless information function according to a seventh embodiment of the present invention.

A seventh embodiment of a radio-controlled timepiece is described below as an electronic timepiece with wireless information function according to the present invention with reference to FIGS. 14 to 17. FIG. 14 is a plan view from the dial side of this seventh embodiment, FIG. 15 is a section view through line XV-XV in FIG. 14, and FIG. 16 is a section view through line XVI-XVI in FIG. 14.

Figure 15:
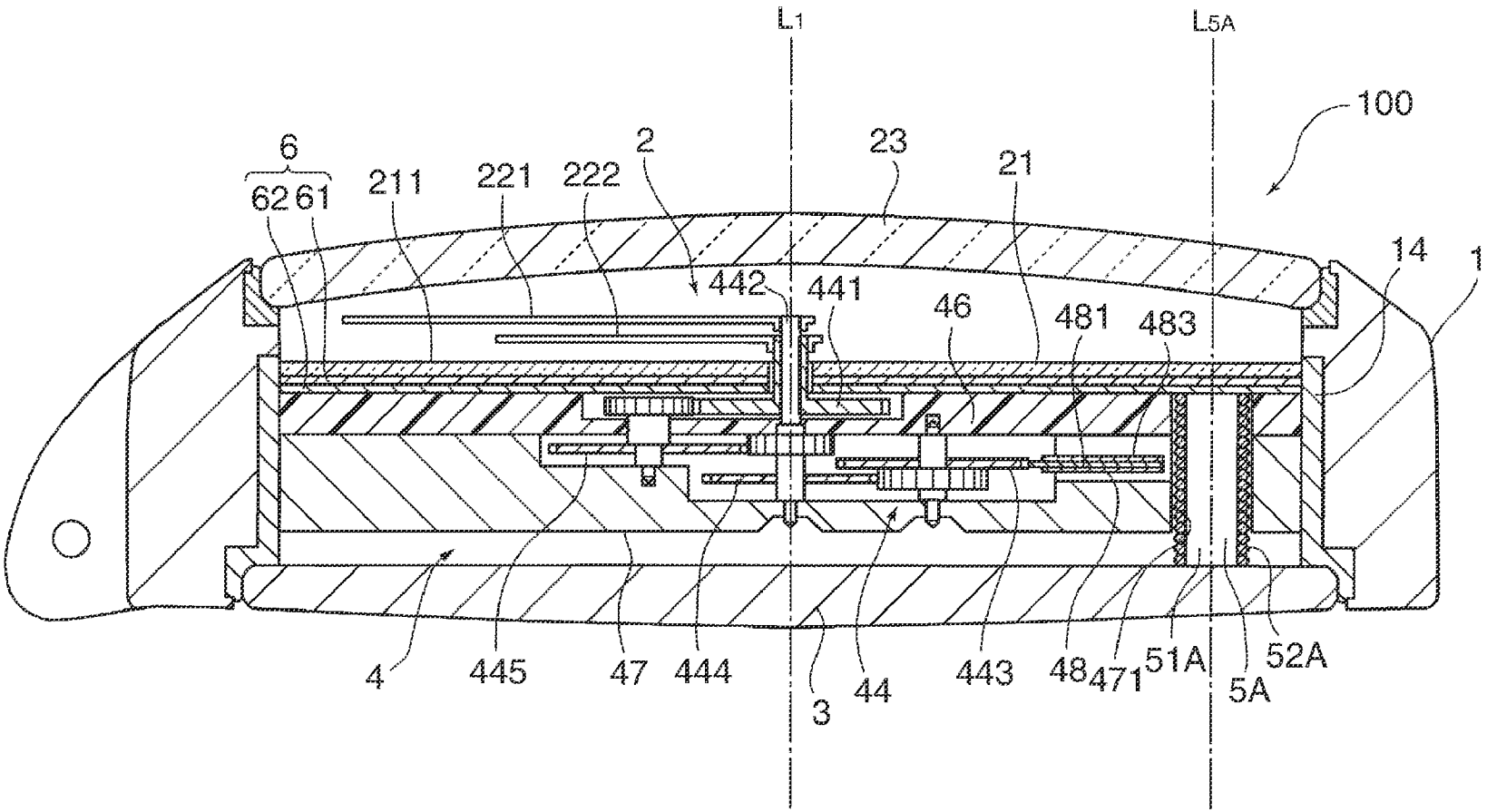
FIG. 15 is a section view of the seventh embodiment through line XV-XV in FIG. 14.
Figure 16:
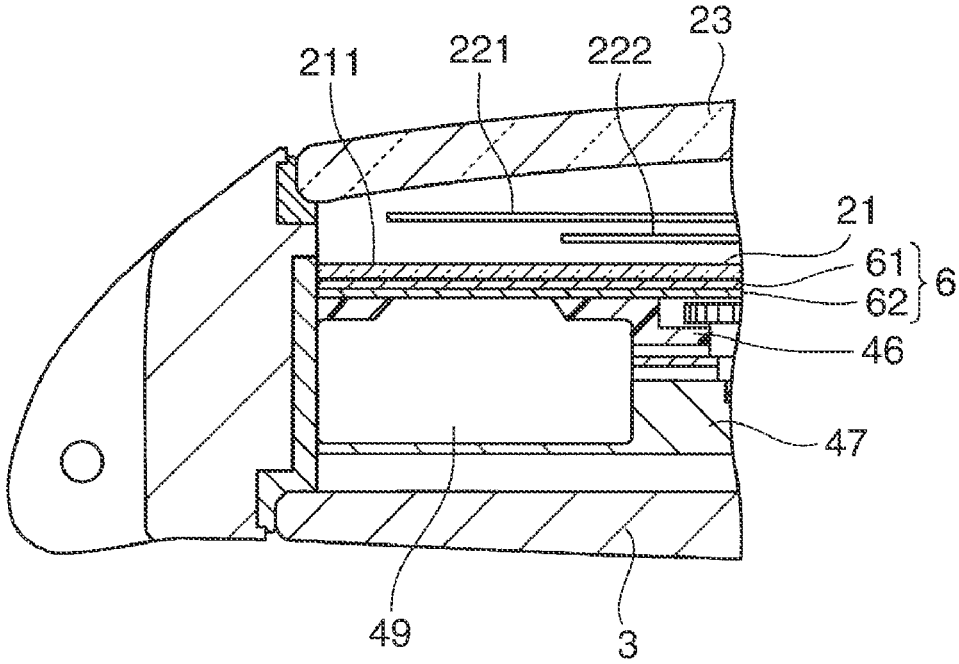
FIG. 16 is a section view of the seventh embodiment through line XVI-XVI in FIG. 14.

This radio-controlled timepiece 100 is a wristwatch having a ring-shaped (a short tube of both ends are open) case 1 as shown in FIG. 14, FIG. 15, and FIG. 16.

The case 1 is a ring-shaped metal member of which both ends are open in line the cylindrical axis $L_1$, which is the axial direction of the gears that drive the hands (i.e., the axial direction of second wheel 444, for example), and is made from brass, stainless steel, or titanium, for example. The thickness of the case 1 is smaller than the ring diameter, and is a 10 mm or less and preferably 5 mm or less. Horns 11, 12 for attaching a wristwatch band are formed at mutually opposite positions on the outside circumference of the case 1. As viewed from the center of the case 1, the direction in which one of the pairs of horns 11, 12 is disposed is 12:00, and the other pair of horns 11, 12 is disposed in the direction of 6:00. In FIG. 14 the top of the figure (towards horns 11) is the 12:00 direction, and the bottom of the figure (towards horns 12) is the 6:00 direction.

A stem 131 is disposed as an external operator 13 passing through the body of the case 1 in the approximate direction of 3:00. One end of the stem 131 is outside the case 1 with a crown 132 affixed to said end. The other end of the stem 131 is inside the case 1 with the yoke 133 and setting lever 134 affixed to said end.

The yoke 133 engages the clutch wheel 135, and when the stem 131 is pulled out, the clutch wheel 135 is moved in the axial direction of the stem 131 by way of intervening setting lever 134 and yoke 133. This adjusts the position of the hands or the date wheel (not shown in the figure). The stem 131, yoke 133, setting lever 134, clutch wheel 135, and other parts constitute the setting mechanism.

As shown in FIG. 15 and FIG. 16, a time display 2 and photoelectric cell are provided in the opening on one side of the case 1, and a back cover 3 is provided at the other open side of the case 1 as a cover closing the opening.

The time display 2 is composed of a dial 21 with a time display surface 211 substantially perpendicular to the cylindrical axis $L_1$ of the case 1 (perpendicular to the surface of the page in FIG. 14), and hands 221, 222 that turn over the surface of the dial 21.

The dial 21 is substantially circular with an area sufficient to close the opening in the case 1. The dial 21 is a made from a transparent, non-conductive, non-magnetic member such as mineral glass, plastic, paper, or ceramic. The time display surface 211 faces the outside so that it can be read externally, and numbers (not shown) for indicating the time are printed in a circle around the outside edge of the time display surface 211. A pattern, coating, or other surface finish could be applied to the time display surface 211.

The hands include a minute hand 221 for indicating the minute, and an hour hand 222 for indicating the hour. Both hands 221, 222 are made from metal, such as brass, aluminum, or stainless steel.

A crystal 23 is also provided opposite the dial 21 with the hands 221, 222 therebetween. The area of the crystal 23 is sufficient to close the opening in the case 1. The crystal 23 is a transparent member that is non-conductive and non-magnetic, and is made from mineral glass or organic glass, for example.

A photoelectric generator 6 is disposed on the opposite side of the dial 21 as the time display surface 211. This photoelectric generator 6 is composed of a photoelectric converter 61 as a photoelectric converter for producing power by means of photoelectric conversion, and a support substrate 62 on which the photoelectric converter 61 is mounted and supported.

The photoelectric converter 61 is a panel with approximately the same area as the dial 21, and is composed of, in order from the dial 21 surface, a transparent electrode layer (TOC), semiconductor layer, and a transparent electrode layer. Transparent electrode layer materials include, for example, $SnO_2$, ZnO, and ITO (indium tin oxide). The semiconductor layer is a PIN photodiode with a pn junction construction made from microcrystal or amorphous silicon. The photoelectric converter 61 is exposed to the outside through the transparent dial 21.

The support substrate 62 is made from a magnetic material such as stainless steel, or a high permeability material such as pure iron, Permalloy, an amorphous alloy of which the primary constituent is cobalt, or an amorphous alloy of which the primary constituent is iron. The support substrate 62 is a flat member with approximately the same area as the photoelectric converter 61, and is bonded to the photoelectric converter 61 on the opposite side as the dial 21.

It should be noted that the shape and area of the photoelectric converter 61 and support substrate 62 can be as desired, including, for example, round, rectangular, triangular, or the shape of a logo or character.

The back cover 3 is disposed opposite the dial 21 with a specific gap therebetween, and has area sufficient to close the opening in the case 1. The back cover 3 is made from a high permeability material such as ferrite, pure iron, or amorphous metal, for example.

Between the photoelectric generator 6 and back cover, 3 inside the case 1 are disposed a movement 4 with a timekeeping function, a spacer ring 14 for holding the movement 4 inside the case 1, battery 49 for supplying power to the movement 4, and antennae 5A and 5B for receiving a standard radio signal carrying time information.

The movement 4 has a quartz oscillator unit 41 including a quartz oscillator 411; a circuit block 42 as a control unit (timekeeping control unit) with a control function; a piezoactuator 48 as a drive unit for turning the hands 221, 222; gear train 44 for transferring drive power from piezoactuator 48 to the hands 221, 222; date wheel (calendar wheel) 45 for indicating the date; and main plate 46 and gear train holder 47 holding the gear train 44 therebetween in line with the cylindrical axis $L_1$ of the case 1.

The quartz oscillator unit 41 is composed of a quartz oscillator 411 for a clock reference, and a 60-kHz quartz oscillator 412 and a 40-kHz quartz oscillator 413 used to generate tuning signals for tuning to the frequency (60 kHz or 40 kHz) of the standard radio signal. The quartz oscillators 412, 413 for tuning signal generation are disposed in the approximate direction of 9:00.

Figure 17:
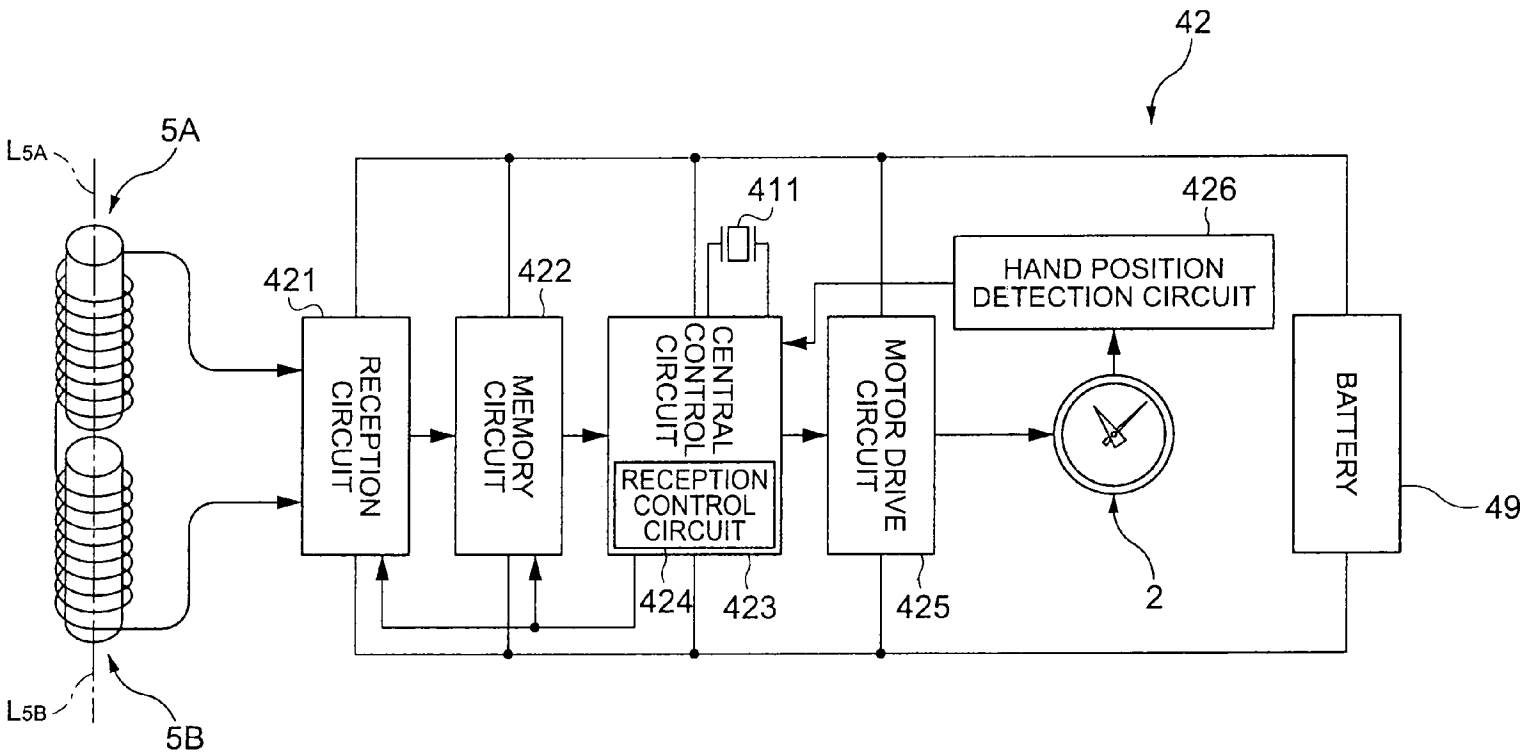
FIG. 17 shows the circuit block configuration in the seventh embodiment of the invention.

The quartz oscillator unit 41 and circuit block 42 are disposed in the approximate direction of 9:00. FIG. 17 is a function block diagram of the quartz oscillator unit 41 and circuit block 42.

The circuit block 42 is composed of a reception circuit 421 for processing the standard radio signal received by the antennae 5A and 5B and outputting time information; a memory circuit 422 for storing the time information output from the reception circuit 421; a central control circuit 423 for keeping the current time based on clock pulses from the quartz oscillator 411 and adjusting the current time using the received time information; a drive circuit 425 for driving piezoactuator 48; and hand position detection circuit 426 for detecting the hand positions.

The reception circuit 421 is composed of an amplifier circuit for amplifying the standard radio signal received by antennae 5A and 5B, a filter for extracting a desired frequency component, a demodulation circuit for demodulating the signal, and a decoder circuit for decoding the signal.

The memory circuit 422 temporarily stores the time information decoded by the reception circuit 421, and determines whether reception was successful by comparing multiple stored time information values.

The central control circuit 423 includes an oscillation circuit, frequency-dividing circuit, current time counter for keeping the current time, and a time-setting circuit for adjusting the value of the current time counter according to the received time information. The central control circuit 423 also has a reception control circuit 424 for storing the reception schedule of the reception circuit 421 and controlling the reception operation, and the reception schedule is set to receive from 2:00 a.m. to 2:06 a.m. When operation of the external operator 13 applies a command telling the reception control circuit 424 to receive the current time information, the reception control circuit 424 applies an output signal telling the reception circuit 421 to receive the standard radio signal.

The motor drive circuit 425 applies a drive pulse to the piezoactuator 48 at the timing indicated by the central control circuit 423.

The hand position detection circuit 426 detects the positions of the hands (minute hand 221, hour hand 222) and outputs the detection result to the central control circuit 423. The detection result from the hand position detection circuit 426 and the value of the current time counter are then compared by the central control circuit 423. Based on the result of this comparison, the motor drive circuit 425 is instructed to output motor pulses to reposition the hands to match the current time counter.

The drive unit is composed of piezoactuator 48. The piezoactuator 48 is composed of a rectangular, flat reinforcing plate 481, piezoelectric element 483 affixed to front and back sides of the reinforcing plate 481, and electrodes (not shown in the figure) rendered on the surface of the piezoelectric element 483. The piezoelectric element 483 is excited by an AC voltage applied to the electrodes, causing bumps 482 formed at diagonally opposite corners of the reinforcing plate 481 to move in a substantially circular path.

The gear train 44 is composed of first wheel 443, which is pushed by the bumps 482 of the piezoactuator 48 and rotated by the circular motion of the bumps 482; second wheel 444, which meshes with the first wheel 443 and rotates in unison with the minute hand arbor 442 to which the minute hand 221 is connected; day wheel 445, which speed reduces rotation of the second wheel 444 to a specified frequency; and center wheel 441, which meshes with the day wheel 445 and to which the hour hand 222 is connected.

A set wheel 446 engages the day wheel 445, and when the stem 131 is pulled out, the clutch wheel 135 disposed to one end of the stem 131 is pushed by the yoke 133 and engages the set wheel 446.

The main plate 46 axially supports the gear train 44 on the dial 21 side, and gear train holder 47 axially supports the gear train 44 on the back cover 3 side. The main plate 46 and gear train holder 47 are non-conductive, non-magnetic members made from ceramic or plastic, for example. Note that the photoelectric generator 6 is held between the main plate 46 and dial 21 with the support substrate 62 pushed to the dial side to fix the position of the photoelectric generator. The position of the photoelectric generator 6 could alternatively be fixed by screwing the support substrate 62 to the main plate 46.

The gear train 44, piezoactuator 48, and circuit block 42 are unitarily assembled between and with the main plate 46 and gear train holder 47, forming the movement 4.

The spacer ring 14 is a ring-shaped member along the inside circumference of the case 1, and encircles the outside edge of the movement 4. The spacer ring 14 is also made from a non-conductive and non-magnetic material such as ceramic or plastic. The spacer ring 14 also intervenes between the photoelectric generator 6 and case 1, and between the back cover 3 and case 1, isolating the support substrate 62 and case 1 and isolating the back cover 3 and case 1. Rubber packing or other like substance could alternatively be used to isolate the support substrate 62 and case 1, or to isolate the back cover 3 and case 1.

The battery 49 is a secondary cell for storing power produced by the photoelectric generator 6, and has a metal can. The battery 49 is positioned in the approximate direction of 11:00 and occupies the area from approximately 10:00 to approximately 12:00. As shown in FIG. 16, the photoelectric generator 6 is disposed between the battery 49 and dial 21.

Two antennae, first antenna 5A and second antenna 5B, are provided, the first antenna 5A in the approximate direction of 4:00 and the second antenna 5B in the approximate direction of 7:00. The first antenna 5A and second antenna 5B are rendered in the movement 4 near the inside circumference of the case.

The spacer ring 14, however, intervenes between the first antenna 5A and second antenna 5B and the case 1, and the first antenna 5A and second antenna 5B and the case 1 are thus separated a specified distance.

The first antenna 5A and second antenna 5B are composed of a coil 52A, 52B wound to a core 51A, 51B made from a high permeability rod material such as ferrite, pure iron, or amorphous metal. As shown in FIG. 17, the coil 52A of first antenna 5A and the coil 52B of second antenna 5B are connected in series.

One example of a configuration for connecting the coils 52A, 52B in series is through a circuit board (not shown in the figure) held between the main plate 46 and gear train holder 47 inside the movement 4. For example, the coils 52A, 52B of the antennae 5A and 5B could be connected to a conductive pattern formed on the circuit board surface.

Note that the terminals of the quartz oscillators 411, 412, 413 and the terminals of the circuit block 42 could be connected to a conductive pattern on the circuit board and electrically energized. Furthermore, the circuit block 42 and other electrical components could be mounted as integrated circuits (IC) on the circuit board, and electrically connected to other electrical components (antennae 5A and 5B, quartz oscillators 411, 412, 413, and battery 49) through a conductive pattern.

The core 51A of the first antenna 5A is circular in section, and the core of second antenna 5B is rectangular in section. The core 51A of first antenna 5A and the core 51B of second antenna 5B are laminates of multiple thin plates of a high permeability material having length in the axial direction. The individual thin plates are bonded to each other with a dielectric adhesive such as epoxy.

The first antenna 5A and second antenna 5B are disposed with their axes $L_{5A}$ and $L_{5B}$ substantially parallel to the cylindrical axis $L_1$ of the case 1, and the ends of the first antenna 5A and second antenna 5B touch the support substrate 62 and back cover 3.

The support substrate 62 is formed deflected with a bulge protruding slightly towards the back cover 3, and the back cover 3 is formed deflected with a bulge protruding slightly towards the support substrate 62, so that when the first antenna 5A and second antenna 5B are assembled therebetween the cores 51A, 51B are held firmly between the support substrate 62 and back cover 3. As a result, the cores 51A, 51B firmly contact the support substrate 62 and back cover 3 due to the restoring force of the support substrate 62 and back cover 3.

It should be noted that if the ends of the first antenna 5A and second antenna 5B are sufficiently close to the support substrate 62 and back cover 3, they do not necessarily need to touch.

Through-holes 471 through which pass the first antenna 5A and second antenna 5B are formed in the gear train holder 47.

Operation of this seventh embodiment thus comprised is described next.

The current time of the time counter is updated based on a reference clock generated by frequency dividing the oscillation of quartz oscillator 411. The positions of the hands (minute hand 221, hour hand 222) is also detected by the hand position detection circuit 426, and the result is output to central control circuit 423. The hand positions and the value of the time counter are compared, and based on the result the piezoactuator 48 is driven by way of motor drive circuit 425. The gear train 44 transfers rotation from the piezoactuator 48 to the hands 221, 222, and the current time is displayed by the hands 221, 222 pointing to numbers on the time display surface 211.

Standard radio signal reception and time adjustment based on the current time information from the standard radio signal are described next.

At 2:00 a.m., which is the reception start time set in the reception control circuit 424, the reception control circuit 424 outputs a start-reception command to the reception circuit 421. The reception control circuit 424 also outputs a start-reception command to the reception circuit 421 when the external operator 13 is operated to unconditionally start reception.

Because the case 1 is open along the cylindrical axis $L_1$, the field component of the standard radio signal enters the case 1 from this opening. The standard radio signal field is then pulled in by the support substrate 62 and back cover 3 due to the high permeability of the support substrate 62 and back cover 3. The magnetic field pulled in to the dial 21 and back cover 3 then passes the cores 51A, 51B of the antennae 5A and 5B, and links the coils 52A, 52B. The standard radio signal is thus received by the antennae 5A and 5B.

When the reception circuit 421 receives the start-reception command, power is also supplied from the battery 49 and the signal (time information) received by the antennae 5A and 5B is decoded.

The decoded time information is temporarily stored in memory circuit 422 for each of multiple received signals (6, for example), and the time information acquired from one signal is compared with the time information from the preceding and following signals to determine reception accuracy. The current time setting of the time counter is then adjusted by the time-setting circuit according to accurately received time information. The hand positions are then corrected according to the value of the time counter, and the time is displayed according to the received time.

When the dial 21 is exposed to light, the light passes the crystal 23 and dial 21 and is incident to the photoelectric converter 61. The light is then photoelectrically converted by the photoelectric converter 61 to electrical power, and the generated power (current) is supplied from the transparent electrodes to the battery 49 and stored.

This seventh embodiment of the present invention offers the following benefits.

(23) A luxurious appearance is afforded by making the case 1 from metal. Furthermore, making the case 1 from metal has no effect on the reception performance of the antennae 5A and 5B because standard radio signals entering the case 1 along the cylindrical axis $L_1$ of the case 1 are received by the antennae 5A and 5B.

(24) The standard radio signal field can enter the case 1 through the openings in the metal case 1 along the cylindrical axis $L_1$ because the case 1 is open on both sides along the cylindrical axis $L_1$. In addition, the axes $L_{5A}$ and $L_{5B}$ of the antennae 5A and 5B are substantially parallel to the cylindrical axis $L_1$ of the case 1. The standard radio signal is thus received by the antennae 5A and 5B because the field entering the case 1 passes the core 51A, 51B disposed in the center of each coil 52A, 52B. Moreover, because the lines of the field penetrating the case 1 are substantially parallel to the axes $L_{5A}$ and $L_{5B}$ of the antennae 5A and 5B, flux linkage to the antennae 5A and 5B is maximized and the reception performance of the antennae 5A and 5B is significantly improved.

(25) Because both sides of the case 1 are open along its cylindrical axis $L_1$, the standard radio signal field can enter the case 1 from the case 1 openings, and the axes $L_{5A}$ and $L_{5B}$ of the antennae 5A and 5B are aligned with the direction in which the field entering the case 1 varies. The reception performance of the antennae 5A and 5B is thus improved because the field of the standard radio signal entering the case 1 links directly with the antennae 5A and 5B.

Because the reception performance of the antennae 5A and 5B is improved, sufficient reception performance is assured even if the size of the antennae 5A and 5B is reduced. The size of the radio-controlled timepiece 100 can therefore also be reduced because smaller antennae 5A and 5B can be used.

Furthermore, because the axes $L_{5A}$ and $L_{5B}$ of the antennae 5A and 5B are substantially parallel to the cylindrical axis $L_1$ of the case 1, the size of the sectional area of the antennae 5A and 5B is not affected by the thickness of the case 1. The case 1 can therefore be formed sufficiently thin even if, for example, the section area of the antennae 5A and 5B is increased to increase flux linkage.

(26) The field of the standard radio signal is guided to the axis of the antennae 5A and 5B by the wide area of the back cover 3 and support substrate 62 made from a high permeability material. The flux linkage of the antennae 5A and 5B is thus increased, and the reception performance of the antennae 5A and 5B is improved.

(27) The photoreception area is maximized relative to the size of the timepiece because the photoelectric converter 61 of the photoelectric generator 6 is made substantially the same size as the dial 21, and electrical generation is thereby increased. The reception performance of the antennae 5A and 5B is also further improved even when the photoelectric generator 6 is large because the standard radio signal is guided to the antennae 5A and 5B by the support substrate 62. Power generation is thereby maximized and the reception performance of the antennae 5A and 5B is improved to the highest level for the timepiece construction.

(28) Because the antennae 5A and 5B are located towards approximately 4:00 and 7:00 and the time signal is received at 2:00 a.m., the hands 221, 222 are not positioned over the axis of the antennae 5A and 5B when the time signal is received. Reception of the standard radio signal is therefore not affected by the hands 221, 222. As a result, the hands 221, 222 can be made of metal, and the appearance can be improved to render a luxurious design.

(29) Because the first antenna 5A and second antenna 5B are connected in series, reception performance can be improved by combining the signals received by the first antenna 5A and second antenna 5B.

(30) The piezoactuator 48 does not produce a magnetic field even when driven, and the reception performance of the antennae 5A and 5B is therefore not affected even if the piezoactuator 48 is disposed proximally to the antennae 5A and 5B.

If the support substrate 62 and back cover 3 are made from a high permeability material when a stepping motor, for example, that generates a magnetic field is used, the field produced by the stepping motor will flow through the support substrate 62 and back cover 3 to the antennae 5A and 5B. However, by using a piezoactuator 48 that does not produce a magnetic field, other noise (such as a magnetic field from the stepping motor) does not flow to the support substrate 62 and back cover 3, and only the field of the standard radio signal is collected by the high permeability support substrate 62 and back cover 3. As a result, the field component of the standard radio signal is inducted to the antennae 5A and 5B by the support substrate 62 and back cover 3, and the reception performance of the antennae 5A and 5B is improved.

(31) A setting mechanism (hands adjusting unit) composed of the stem 131, yoke 133, setting lever 134, and clutch wheel 135 is rendered between the first antenna 5A and battery 49, and the quartz oscillator unit 41 and circuit block 42 are disposed between the second antenna 5B and battery 49.

Because the case of the battery 49 is metal, magnetic flux inducted by the support substrate 62 and back cover 3 near the battery 49 could be inducted to the battery 49 case. However, positioning the stem 131 and circuit block 42, for example, between the battery 49 and antennae 5A and 5B separates the antennae 5A and 5B from the battery 49. As a result, sufficient flux linkage to the antennae 5A and 5B is assured, and reception performance is improved.

(32) The antenna cores 51 are formed by laminating multiple thin plates mutually isolated by an epoxy resin. The eddy current produced in each thin plate is therefore small. When the standard radio signal field is inducted by the support substrate 62 and back cover 3, extremely high flux is linked to the antennae 5A and 5B, and core loss could increase. Suppressing the eddy current also suppresses core loss, however, and reception performance by the antennae 5A and 5B is thereby improved.

Eighth Embodiment

An eighth embodiment of a radio-controlled timepiece is described below as an electronic timepiece with wireless information function according to the present invention with reference to FIGS. 18 to 20.

Figure 18:
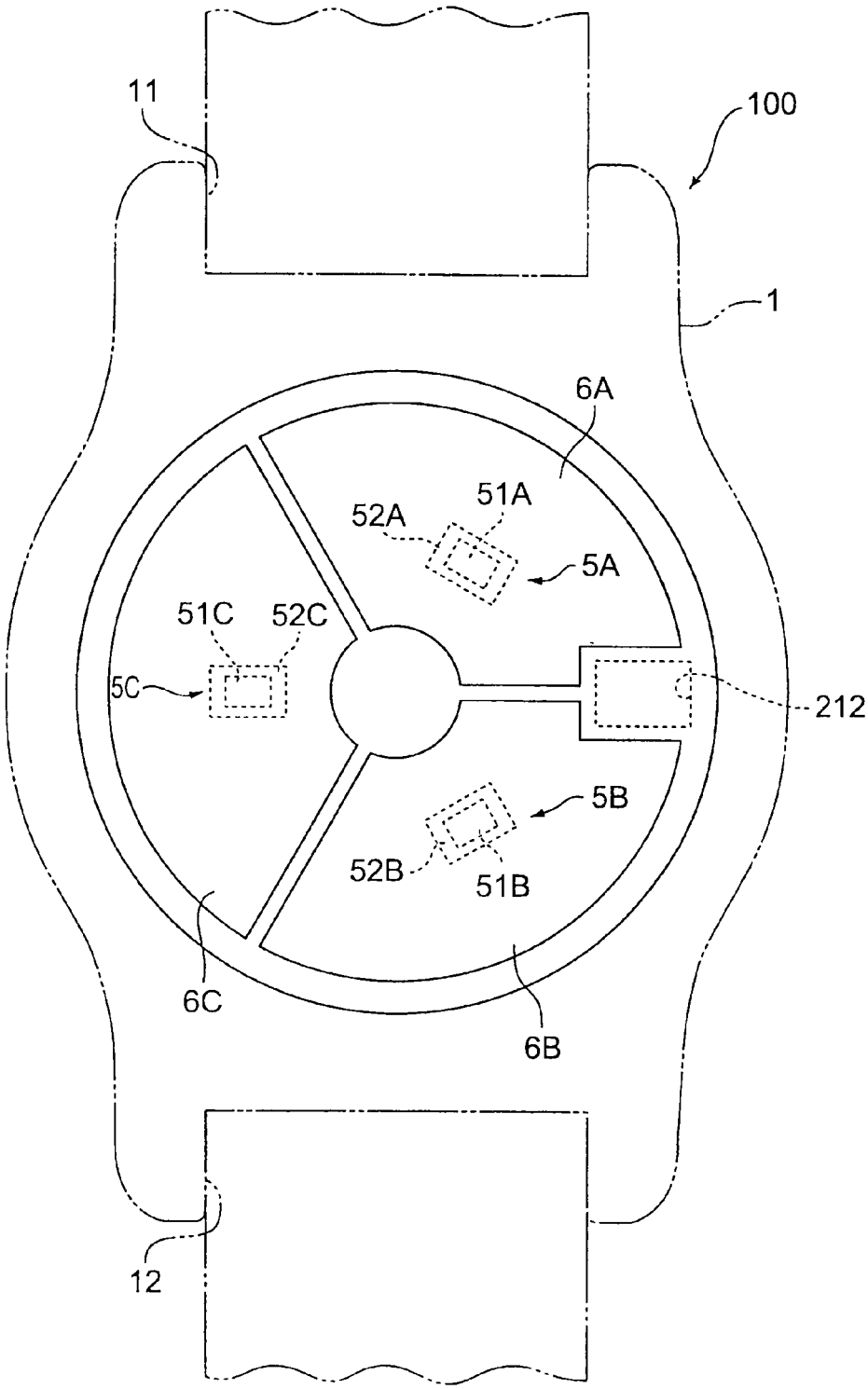
FIG. 18 is a plan view of an electronic timepiece with wireless information function according to an eighth embodiment of the present invention.
Figure 19:
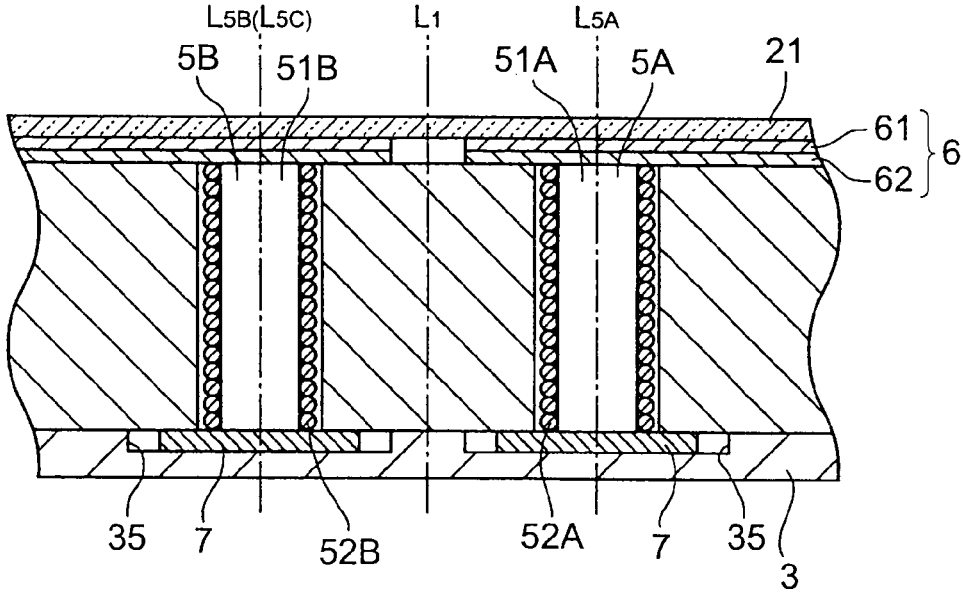
FIG. 19 is a section view of major parts in the eighth embodiment of the invention.
Figure 20:
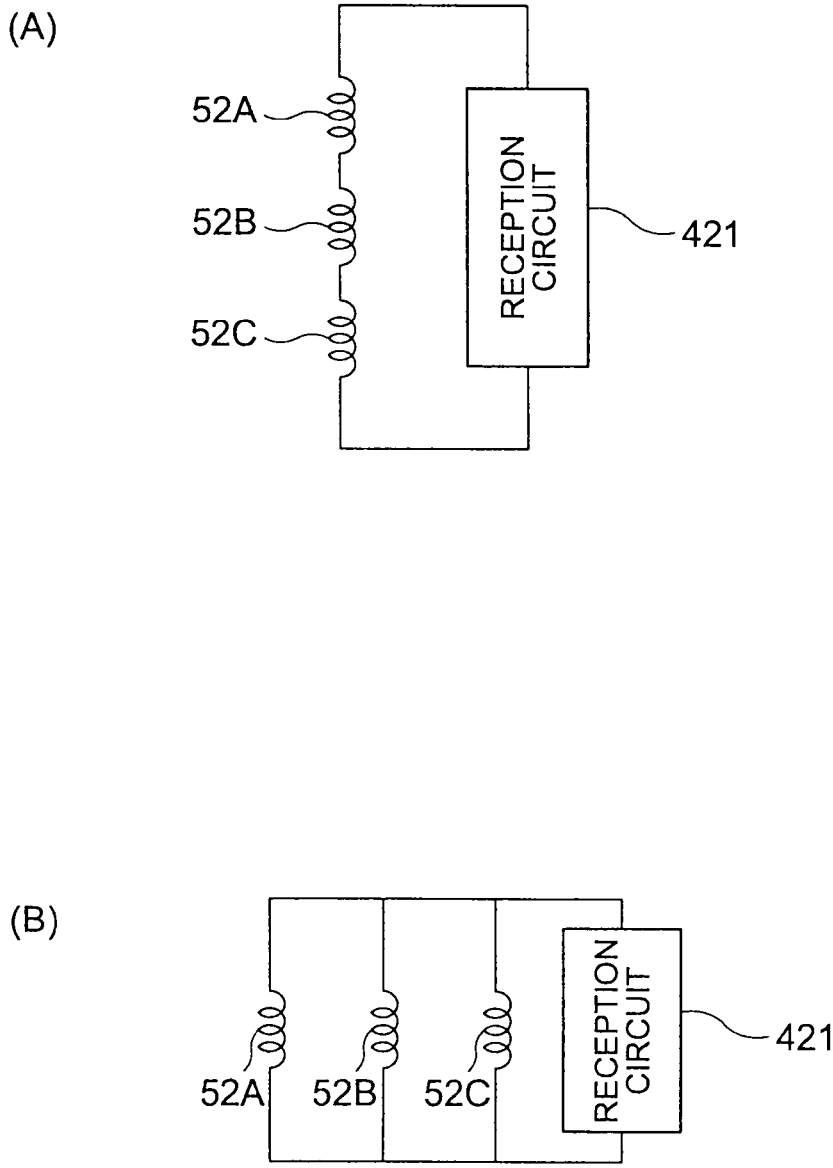
FIGS. 20(*a*) and (*b*) show the antenna connection in the eighth embodiment of the invention.

FIG. 18 is a plan view of this second embodiment as seen from the dial side, FIG. 19 is a section view through a line connecting antennae, and FIG. 20 shows antennae connections.

The basic configuration (including the basic construction and part materials) of this eighth embodiment is the same as the seventh embodiment, but this eighth embodiment is characterized by the photoelectric generator 6 being divided into multiple parts.

A photoelectric generator 6 is provided as in the seventh embodiment, but this photoelectric generator 6 is composed of three photoelectric cell blocks 6A to 6C. Each photoelectric cell block is fan-shaped with an approximately 120 degree center angle, and as in the seventh embodiment is composed of a photoelectric converter 61 and support substrate 62. Each photoelectric cell block is an independent photoelectric generator, meaning that each photoelectric cell block is composed of a discrete photoelectric converter 61 and support substrate 62. The three photoelectric cell blocks are substantially identical in shape, and the blocks are arranged with the center angle parts thereof in proximity to each other so that together the three blocks form a circle.

Referring to FIG. 18, the first photoelectric cell block 6A is disposed from approximately 11:00 to approximately 3:00, the second photoelectric cell block 6B is disposed from approximately 3:00 to approximately 7:00, and the third photoelectric cell block 6C is disposed from approximately 7:00 to approximately 11:00. The first photoelectric cell block 6A, second photoelectric cell block 6B, and third photoelectric cell block 6C are electrically connected in series, and the power (current) produced by each of the blocks is serially combined and stored to battery 49.

A date window 212 is formed in the dial 21 in the approximate direction of 3:00 between the first photoelectric cell block 6A and second photoelectric cell block 6B so that the date wheel (not shown in the figure) disposed below the dial 21 with the photoelectric generator 6 disposed therebetween can be seen from the window 212. A notch is formed from the outside edge in the support substrate 62 of first photoelectric cell block 6A and second photoelectric cell block 6B so that the numbers on the date wheel can be seen through the window 212.

The center angle parts of the photoelectric cell blocks 6A to 6C are also cut away so that the center of the three blocks form a hole through which passes the hand arbor.

There are three antennae, first antenna 5A, second antenna 5B, and a third antenna 5C, and the axes $L_{5A, 5B, 5C}$ of antennae 5A, 5B, 5C are substantially parallel to the cylindrical axis $L_1$ of case 1.

The first antenna 5A is disposed in the approximate direction of 1:00, the second antenna 5B in the approximate direction of 5:00, and the third antenna 5C in the approximate direction of 9:00.

As shown in FIGS. 18 and 19, the antennae 5A to 5C are disposed substantially in the center of the corresponding photoelectric cell block 6A to 6C with one end of the antenna core 51A to 51C contacting the photoelectric cell block 6A to 6C.

The other end of the core 51A to 51C contacts a magnetic plate 7 made from a high permeability material. As is the support substrate 62, the magnetic plate 7 is made from a magnetic material such as stainless steel, or a high permeability material such as an amorphous alloy of pure iron, permalloy, cobalt, or iron, and can also be used as a parts cover for covering, for example, a lever of the setting mechanism or a setting lever for stopping the gear train action when setting the hands. A discrete magnetic plate 7 is separately disposed for each antennae 5A to 5C. The magnetic field of the standard radio signal is pulled in by the magnetic plate 7.

The base elements (such as the main plate 46 and gear train holder 47) of the back cover 3 and movement 4 are made from a non-conductive, non-magnetic material. Recesses 35 in which the magnetic plate 7 are fit are also formed in the back cover 3.

The coils 52A, 52B, 52C of the first, second, and third antennae 5A, 5B, 5C can be connected in series as shown in FIG. 20(A), or in parallel as shown in FIG. 20(B). Alternatively, a combination of serial and parallel connections could be used. For example, the coil 52A of first antenna 5A and the coil 52B of second antenna 5B could be connected in series, and the coil 52C of third antenna 5C could be parallel connected to coil 52A and coil 52B. The serial or parallel connection of the coils could also be accomplished through a conductive pattern formed on a circuit board as described in the seventh embodiment.

In addition to the benefits numbered (23) to (32) of the seventh embodiment described above, this eighth embodiment of the invention affords the following benefits.

(33) There are three antennae, and the photoelectric generator 6 is segmented into three photoelectric cell blocks 6A to 6C corresponding to antennae 5A to 5C. A discrete magnetic plate 7 is also provided for each antennae 5A to 5C. Because the antennae 5A to 5C are rendered separately from the others, the standard radio signal is received separately by each antennae 5A to 5C. The probability of successfully receiving the standard radio signal is thus improved because reception by only one of the antennae 5A to 5C needs to succeed.

(34) Because the magnetic field of the standard radio signal is inducted by the support substrate 62 and magnetic plate 7, reception performance by one antenna is improved. The probability of successful reception is thus improved because the signal strength received by any one antenna is sufficient to adjust the time and it is only necessary for one antenna to successfully receive the standard radio signal.

(35) Any desirable material can be used for the back cover 3 because magnetic plates 7 are provided and the magnetic field of the standard radio signal is inducted by the magnetic plates 7. If the back cover 3 is isolated from the metal case 1, the back cover 3 could be made from a high permeability material, or from a non-conductive, non-magnetic material such as mineral glass or ceramic, or from a metal such as brass or titanium alloy.

(First Variation)

A first variation of a radio-controlled timepiece as an electronic timepiece with wireless information function according to the present invention is described below.

The basic configuration of this first variation (including the basic construction and part materials) is the same as in the second embodiment, but is differentiated therefrom in the antennae core 51A, 51B and dial 21 being unitarily formed.

Figure 21:
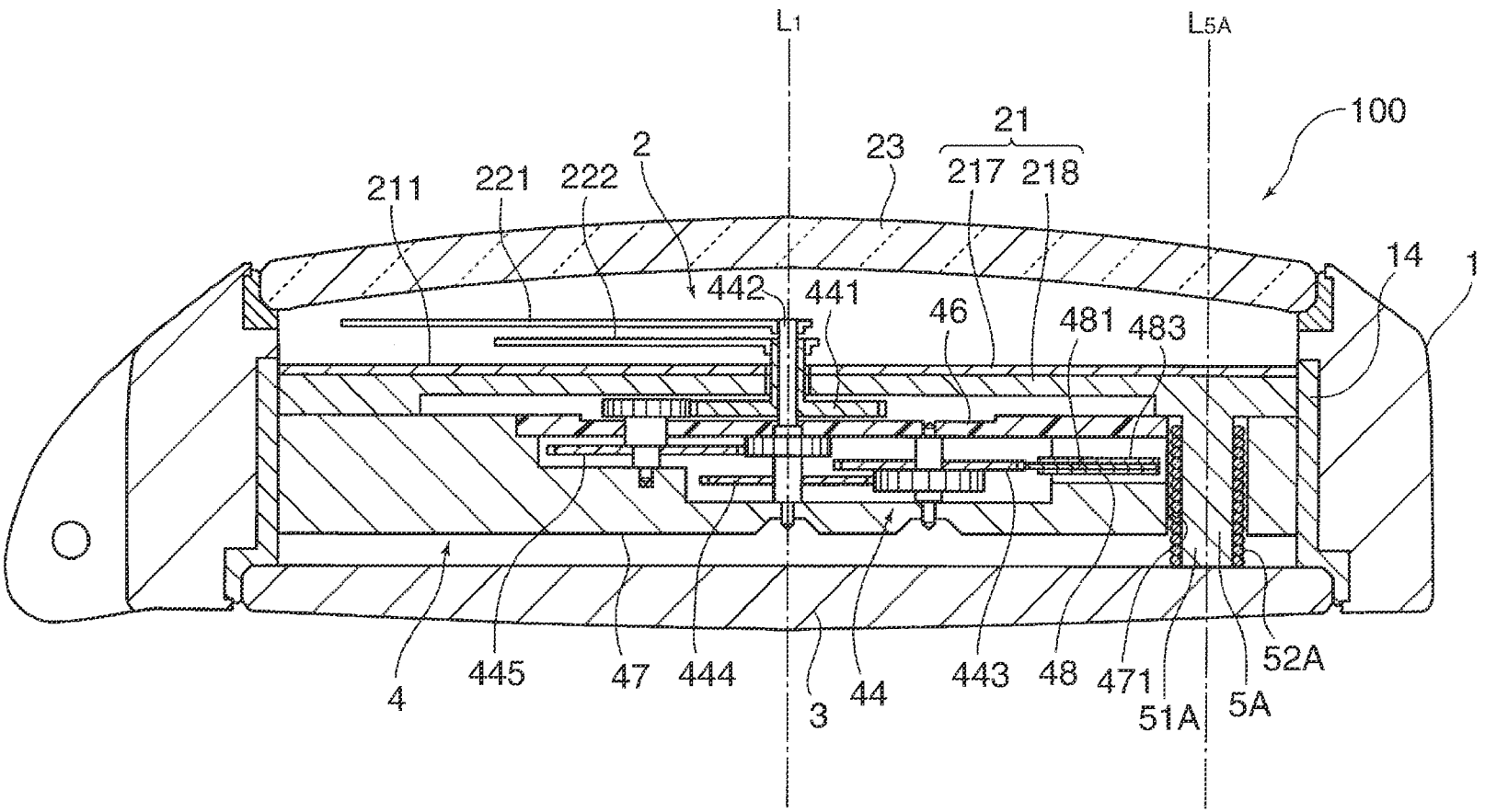
FIG. 21 shows a first variation of an electronic timepiece with wireless information function according to the present invention in which the dial and antenna core are unified.

As shown in FIG. 21, for example, the dial 21 is composed of a dial top plate 217 on one side of which is imparted the ornamentation of the time display surface 211, and a dial bottom plate 218 bonded unitarily to the bottom surface of the dial top plate 217. The dial top plate 217 and dial bottom plate 218 are made from a high permeability material. An antenna core 51A is formed projecting contiguously from and unitarily to the dial bottom plate 218. Methods for thus unitarily forming the dial bottom plate 218 and core 51A include diecasting and forging.

The dial top plate 217 could be made from a non-conductive and non-magnetic material such as mineral glass, ceramic, or plastic.

With this configuration the dial bottom plate 218 and core 51A are formed from a single part, thereby reducing the part count and making assembly easier. Furthermore, because there is no joint between the dial bottom plate 218 and core 51A, the magnetic field of the standard radio signal inducted by the dial bottom plate 218 links directly to antenna 5A without resistance. The flux linkage of antenna 5A is thus increased, and reception performance by the antenna 5A is improved.

Furthermore, if there are two antennae, the core of both antennae could be formed unitarily to the dial bottom plate 218, or the core of only one antenna could be formed to the dial bottom plate 218.

Furthermore, because the core 51A, dial 21, and back cover 3 can be made from a high permeability material, the core 51A and back cover 3, for example, could be formed unitarily, or the core 51A, dial 21, and back cover 3 could all be formed unitarily. However, only one of the dial 21 and back cover 3 is preferably formed unitarily with the core 51A so that the coil 52A can be wound efficiently to the core 51A.

(Second Variation)

A second variation of a radio-controlled timepiece as an electronic timepiece with wireless information function according to the present invention is described below with reference to FIG. 22.

The basic configuration of this second variation is the same as in the second embodiment, but is characterized by a recess for fitting the ends of the antenna 5 being rendered in the dial 21 and back cover 3 where the ends of the antenna 5 are positioned.

Figure 22:
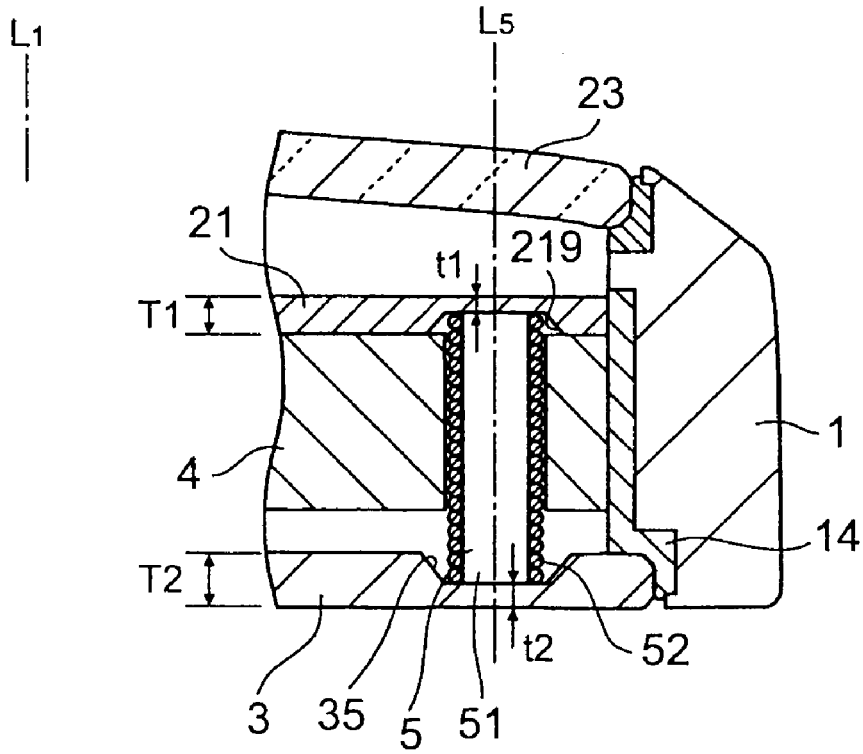
FIG. 22 is a partial section view of a second variation of an electronic timepiece with wireless information function according to the present invention.

FIG. 22 is a partial section view of this second variation showing the major parts in the antenna area. This second variation is composed of a case 1 of which both ends are open along its cylindrical axis $L_1$, a crystal 23 made of mineral glass or organic glass, a movement 4, a plastic spacer ring 14, a dial 21 disposed in one opening of the case 1, a back cover 3 as a cap in the other opening of the case 1, and an antenna 5 disposed between and with the axial ends thereof contacting the dial 21 and back cover 3 inside the case 1. A first recess 219 in which one end of the antenna 5 is fit is rendered in the dial 21, and a second recess 35 in which the other end of the antenna 5 is fit is rendered in the back cover 3.

The case 1 is made from a conductive metal such as brass, titanium alloy, stainless steel, or aluminum. In addition to the antenna 5, a movement 4 is also disposed inside the case 1.

The dial 21 and back cover 3 are made from a high permeability material, and the magnetic field of the standard radio signal can pass through the dial 21 and back cover 3. The dial 21 and back cover 3 are isolated from the case 1 by the intervening spacer ring 14.

The first recess 219 is rendered in the dial 21 opening into the case 1. That is, this first recess 219 is rendered facing the back cover 3. The depth of this first recess 219 is greater than half the thickness ($T_1$) of the dial 21 such that the thickness ($t_1$) of the thin wall part from the bottom of the first recess 219 to the other side of the dial (the time display side) preferably satisfies the equation:

$$t_1 <= T_1/2$$

and yet further preferably satisfies the equation:

$$t_1 <= T_1/3$$

It should be noted that the depth of the first recess 219 is not specifically limited, and the thickness ($t_1$) of the thin wall part could be half or more of the thickness ($T_1$) of the dial. Further, the minimum thickness ($t_1$) of the thin wall part is also not specifically limited, and the first recess 219 can be formed more deeply insofar as the strength of the dial 21 can be maintained.

The area of the opening in the first recess 219 is slightly greater than the section area of the antenna 5 core, such as just wide enough to insert the end of the antenna 5 with the coil 52 wound to the core 51. The sides of the first recess 219 could also be tapered from the bottom to the outside of the recess.

The second recess 35 is rendered in the back cover 3 opening into the case 1, that is, facing the dial 21. The depth of the second recess 35 relative to the thickness ($T_2$) of the back cover 3 preferably satisfies the following equation.

$$t_2 <= T_2/2$$

where $t_2$ is the thickness of the thin wall part from the bottom of the second recess 35 to the other side of the back cover 3.

Yet further preferably, the depth of the second recess 35 satisfies the following equation.

$$t_2 <= T_2/3$$

As described with respect to the first recess 219, the depth of this second recess 35 is also not specifically limited.

The area of the second recess 35 opening is wide enough to insert the end of the antenna 5, and the sides of the second recess 35 could also be tapered from the bottom to the outside of the recess.

The antenna 5 is rendered with its axis $L_5$ substantially parallel to the cylindrical axis $L_1$ of the case 1. The antenna 5 is disposed with one end of the core 51 inserted to the first recess 219 in the dial 21 with the end firmly contacting the bottom of the first recess 219. The antenna 5 is further disposed with the other end of the core 51 inserted to the second recess 35 in the back cover 3 with the end firmly contacting the bottom of the second recess 35. The dial 21 and back cover 3 are formed bulging slightly toward the inside of the case 1, and the antenna 5 is held between the dial 21 and back cover 3 to assure firm contact between the ends of the antenna 5 and the dial 21 and back cover 3 as described in the seventh embodiment.

Thus comprised, the magnetic field of the standard radio signal is inducted by the high permeability dial 21 and back cover 3, and the magnetic field of the standard radio signal passes from the dial 21 and back cover 3 links to the antenna 5. Flux linkage to the antenna 5 is thereby increased, and the reception performance of the antenna 5 can be improved.

The position of the antenna 5 is fixed because the antenna 5 is held between the dial 21 and back cover 3 with the ends of the antenna 5 fit into the first recess 219 and second recess 35.

Because the length of the antenna 5 can be increased by the depth of the first recess 219 and second recess 35, the winds of the coil 52 can be increased commensurately to the increased length of the antenna 5. This increases the ampere-turns, and thereby improves the reception sensitivity of the antenna 5.

(Third Variation)

A third variation of a radio-controlled timepiece as an electronic timepiece with wireless information function according to the present invention is described below with reference to FIGS. 23 and 24.

The basic configuration of this third variation is the same as in the third embodiment, but is differentiated therefrom in the shape of the through-holes 213, 31 formed in the dial 21 and back cover 3, and the shape of the high permeability members 215, 33 implanted in the through-holes 213, 31.

Figure 23:
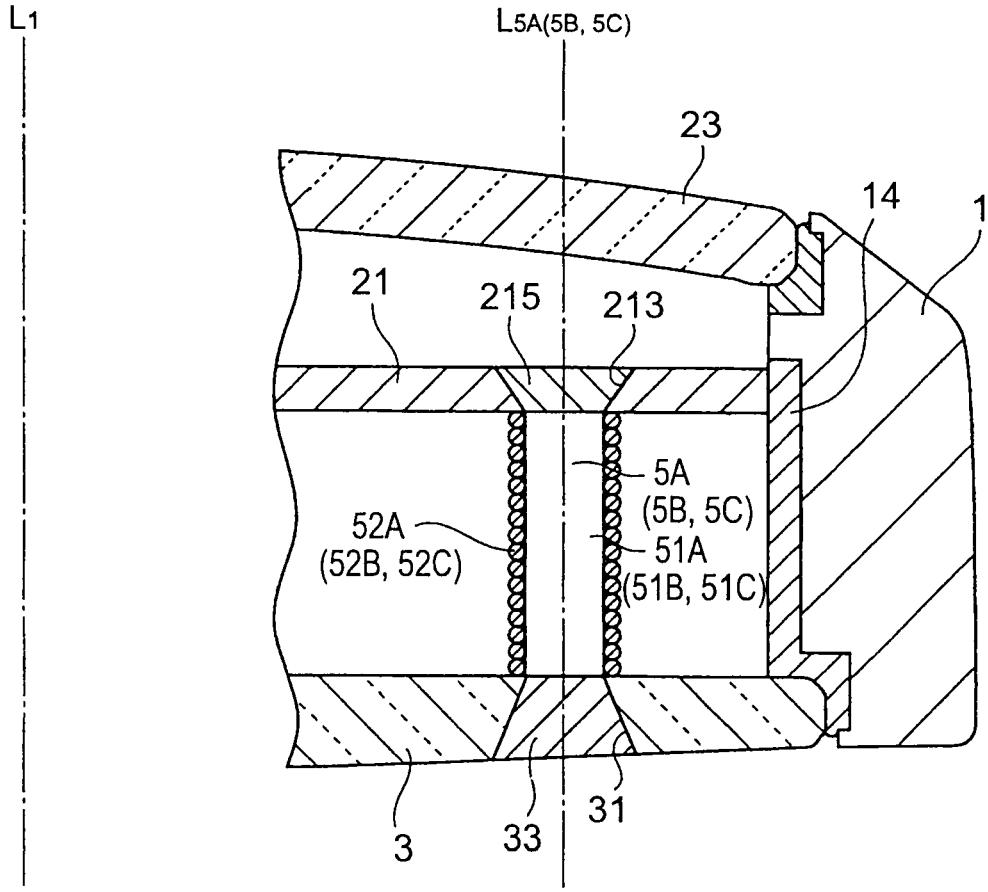
FIG. 23 shows a third variation of an electronic timepiece with wireless information function according to the present invention, and shows an example of the shape of through-holes formed in the dial and back cover, and the shape of the high permeability members.

As shown in FIG. 23, the through-holes 213, 31 formed in dial 21 and back cover 3 are tapered such that the through-holes 213, 31 increase in diameter from inside to outside. The high permeability members 215, 33 fit into the through-holes 213, 31 are also tapered to match the shape of the through-holes 213, 31. The high permeability members 215, 33 are also pressed firmly against the ends of the core 51A (51B, 51C). This can be done by, for example, forming the dial 21 curved with the convex side towards the antenna cores 51A to 51C, and pressing the high permeability member 215 to the end of the antenna cores 51A to 51C by means of the elastic force of this curve.

Figure 24:
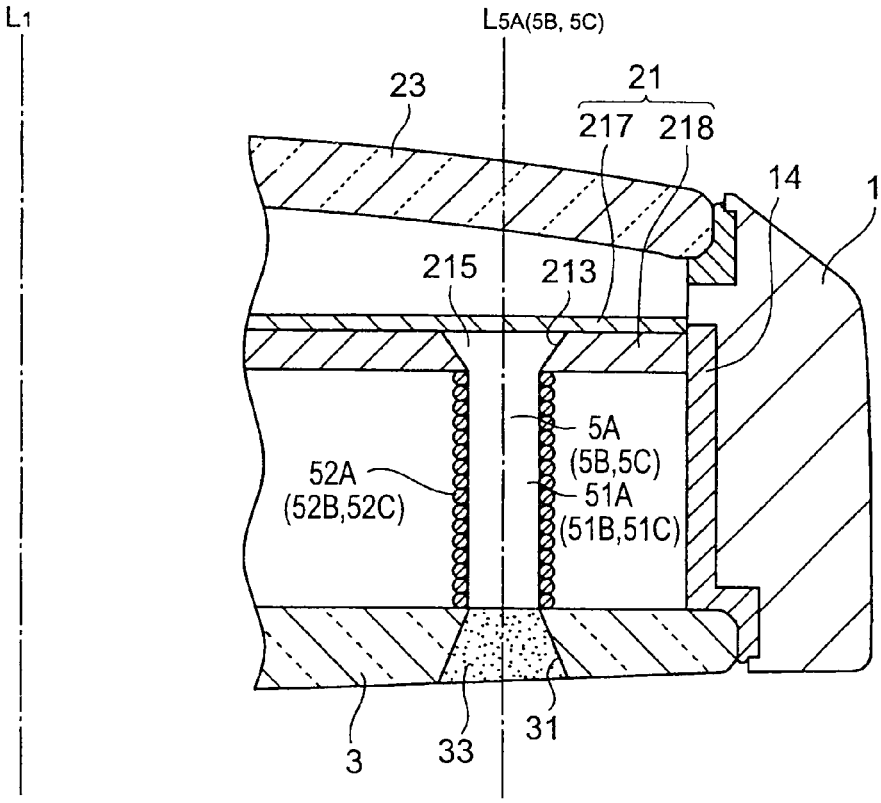
FIG. 24 shows an example in which the high permeability member is unified with the antenna core in the third variation.

As shown in FIG. 24, the dial 21 is composed of a dial top plate 217 and dial bottom plate 218. As described with reference to FIG. 23, through-holes 213, 31 tapered so as to increase in diameter from inside to outside are also formed in dial bottom plate 218 and the back cover 3. The high permeability member 215 on the dial 21 is formed unitarily with the antenna core 51A (51B, 51C), that is, the high permeability member 215 is rendered increasing in diameter continuously from one end of the core 51A. These cores 51A to 51C are then inserted from the large diameter side of the through-hole 213 in the dial bottom plate 218. A high permeability member 33 tapered to match the shape of the through-hole 31 is also fit into the through-hole 31 on the back cover 3 side.

The high permeability members 215, 33 are thus formed increasing in diameter to the outside. That is, the high permeability members 215, 33 are reduced in diameter smoothly to the antenna core 51A to 51C. A smooth, continuous magnetic path is thus formed from the high permeability member 215, 33 to the antenna core 51A to 51C. As a result, the magnetic field of electromagnetic waves inducted by the high permeability member 215, 33 is guided continuously to the antenna core 51A to 51C without any particular magnetic resistance. The flux linkage of antennae 5A to 5C is thus increased and antennae 5A to 5C reception performance is improved.

(Fourth Variation)

A fourth variation of a radio-controlled timepiece as an electronic timepiece with wireless information function according to the present invention is described below.

The third embodiment (FIG. 10) is described having through-holes 213, 31 formed in dial 21 and back cover 3, and a high permeability member 215, 33 fit into these through-holes 213, 31. In this fourth variation, however, a high permeability member is affixed in line with the antenna 5 axis on the non-conductive and non-magnetic dial 21 and back cover 3, main plate 46, and gear train holder 47 rather than forming through-holes 213, 31 in the dial 21 and back cover 3.

Alternatively, recesses opening into the inside of the timepiece are rendered in the dial 21 and back cover 3, and a high permeability member is disposed in the recesses.

In this case the high permeability member can be formed unified with antenna core 51.

Figure 25:
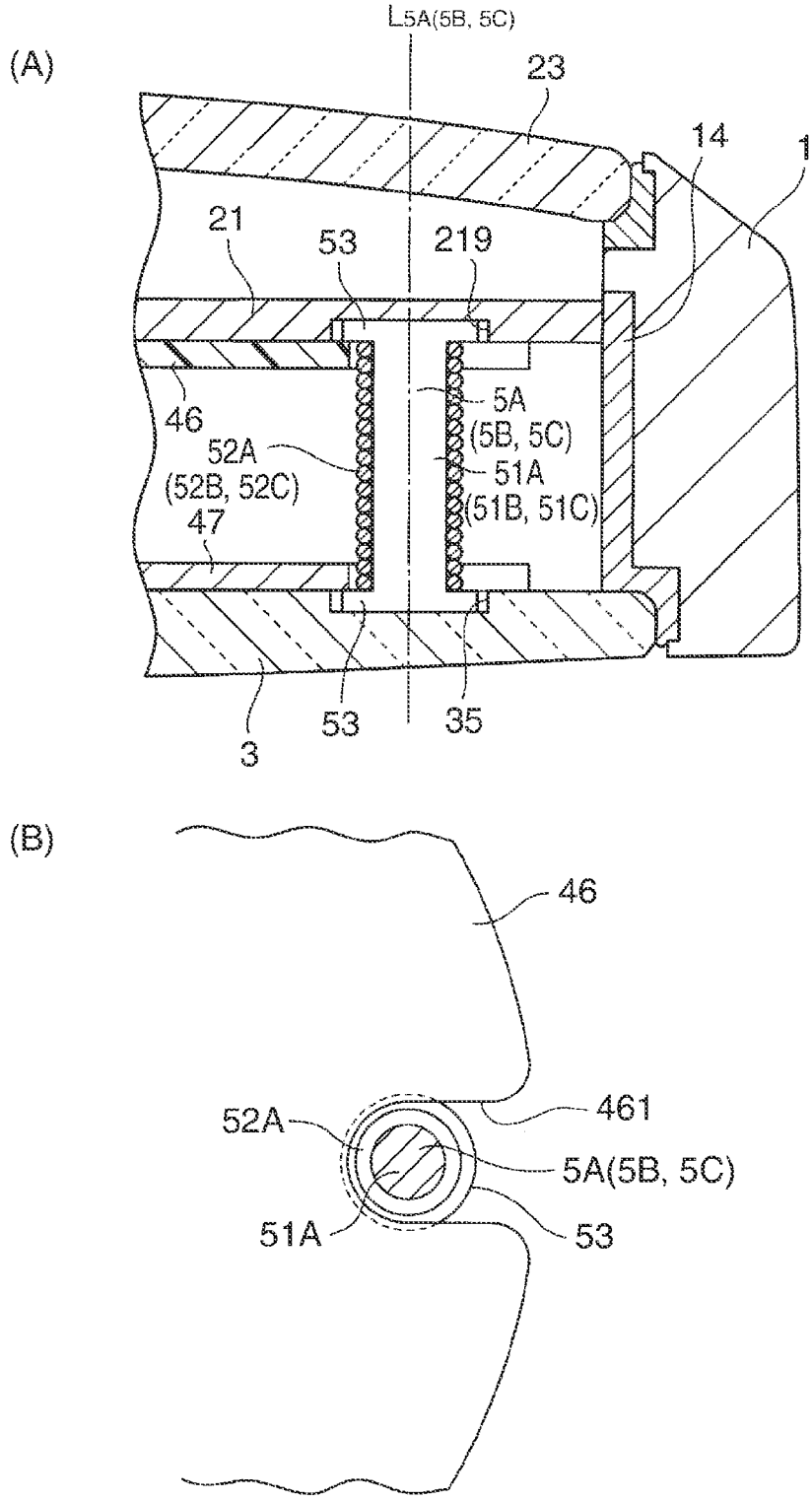
FIGS. 25(*a*) and (*b*) show a fourth variation of an electronic timepiece with wireless information function according to the present invention relating to the shape of the antenna core and the configuration of recesses in the dial and back cover.

For example, recesses 219, 35 open to the inside are formed in dial 21 and back cover 3 as shown in FIG. 25(A). The dial 21 is made from mineral glass or plastic, and the back cover 3 is made from mineral glass or plastic. Top and bottom flanges 53 projecting substantially perpendicularly to the axis are formed at the top and bottom of the antenna core 51A, and these flanges 53 are fit into the recesses 219, 35 in the dial 21 and back cover 3. A notch 461 is also cut into the outside edge of the main plate 46 and gear train holder 47, and the antenna 5 is inserted from this notch 461. FIG. 25(B) shows the flange 53 inserted from the outside edge to the notch 461 in the main plate 46 and gear train holder 47.

The flanges 53 in this configuration induct the magnetic field of the standard radio signal, thereby increasing the antenna 5 flux linkage and improving the reception performance of the antenna.

(Fifth Variation)

A fifth variation of a radio-controlled timepiece as an electronic timepiece with wireless information function according to the present invention is described below with reference to FIGS. 26, 27 and 28.

This fifth variation is similar to the above embodiment in having an antenna 5, but is characterized by affixing the antenna 5 using a coil bobbin.

In FIG. 26(A) the radio-controlled timepiece 100 is composed of a main plate 46 on which the drive unit (motor), gear train, and other movement components are mounted, a dial 21 and back cover 3 disposed to the front and back sides of the main plate 46, an antenna 5 for receiving a standard radio signal, and a magnetic plate 7 for inducting the magnetic field of the standard radio signal.

The main plate 46, dial 21, and back cover 3 are made from a non-conductive, non-magnetic material such as mineral glass or plastic. The main plate 46 is composed of a through-hole 464 in which the antenna 5 is insertion fit, a mounting recess 462 recessed on the back cover 3 side for affixing the antenna 5, and a positioning recess 463 on the dial 21 side for fitting the magnetic plate 7.

The antenna 5 is composed of a coil bobbin 54, core 51, and coil 52. As shown in FIG. 26(B), the coil bobbin 54 is composed of a tubular body 542 made of a non-conductive and non-magnetic member such as plastic having a cylindrical hole 543 with the coil 52 wound around the body, and a flange 541 projecting from the body 542. The core 51 is inserted to the cylindrical hole 543 of the coil bobbin 54, and the coil 52 is wound to the body 542.

The magnetic plate 7 is a flat member made of a high permeability material as described above.

The antenna 5 is inserted to the through-hole 464 of main plate 46, and is fastened to the main plate 46 by set screws 8 after fitting the flange 541 into the mounting recess 462. The magnetic plate 7 is set from the dial 21 into the positioning recess 463, and the main plate 46 and magnetic plate 7 are adhesively bonded with the magnetic plate 7 and core 51 touching. It should be noted that the magnetic plate 7 could be bonded to the core 51 or coil bobbin 54 instead of the main plate 46.

This configuration makes it simple to affix the antenna 5 to the main plate 46 by means of coil bobbin 54. Furthermore, the magnetic plate 7 inducts the magnetic field of the standard radio signal so that flux linkage to the core 51 is great and the reception performance of the antenna 5 is improved.

Figure 26:
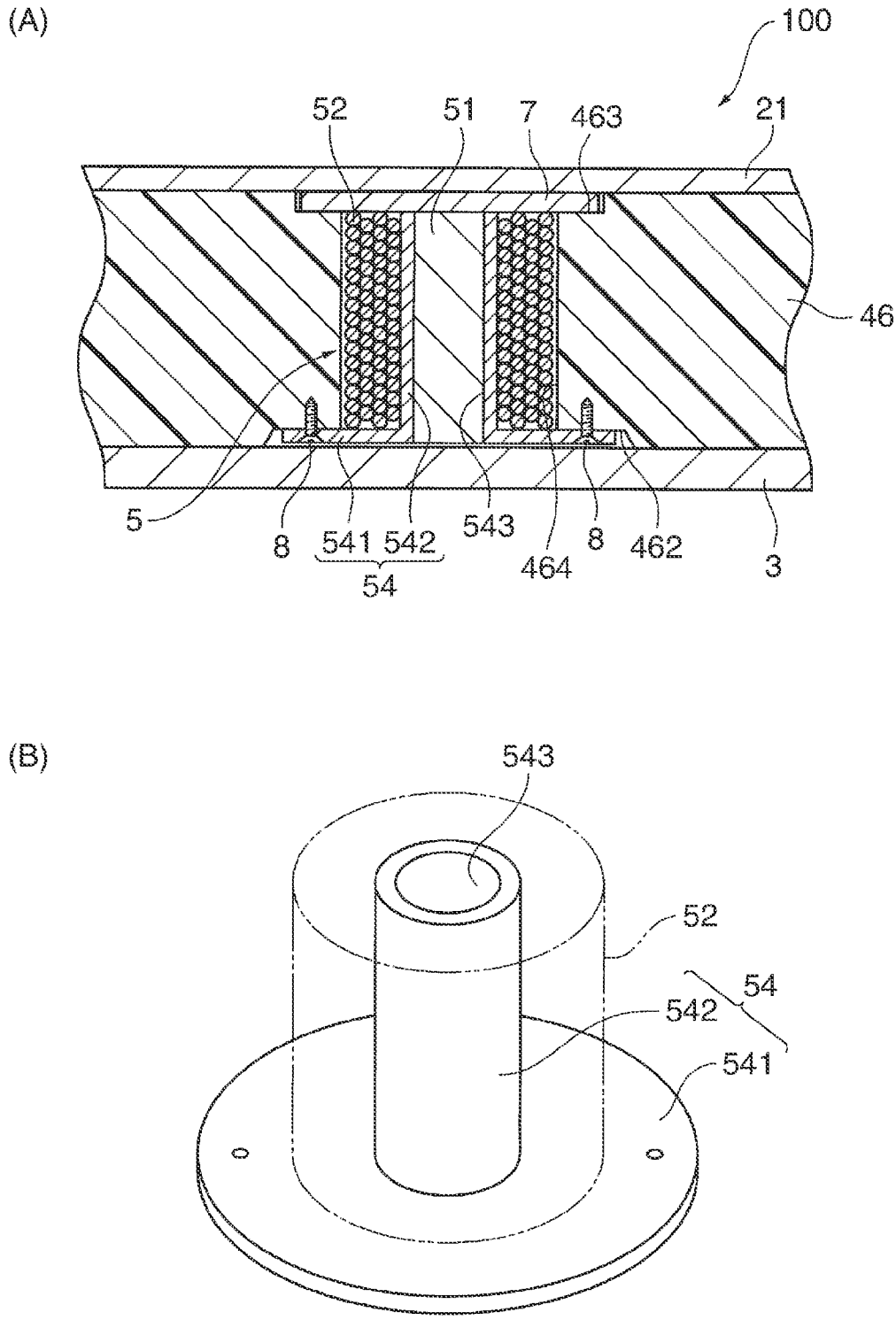
FIGS. 26(*a*) and (*b*) show a fifth variation of an electronic timepiece with wireless information function according to the present invention.
Figure 27:
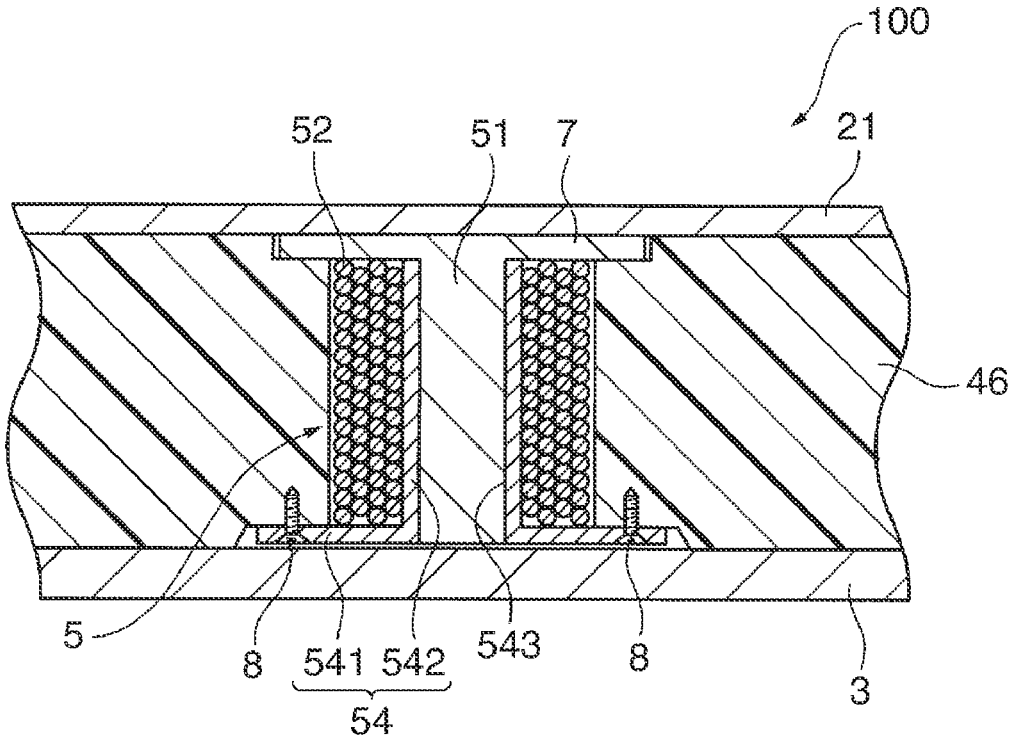
FIG. 27 shows a configuration in which the core and magnetic plate are unified in the fifth variation.
Figure 28:
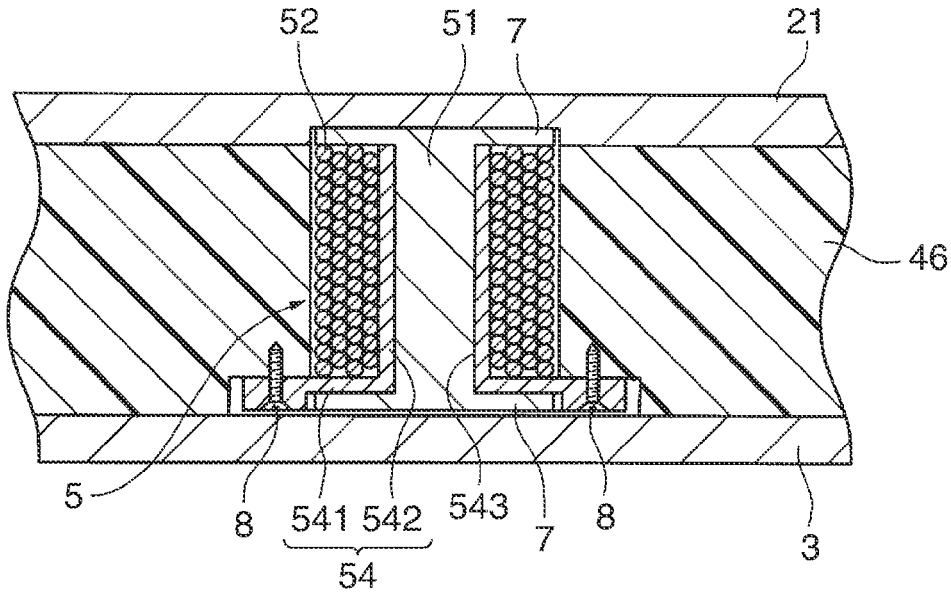
FIGS. 28(*a*) and (*b*) show a configuration in which a magnetic plate is unified with both ends of the core in the fifth variation.
Figure 28:
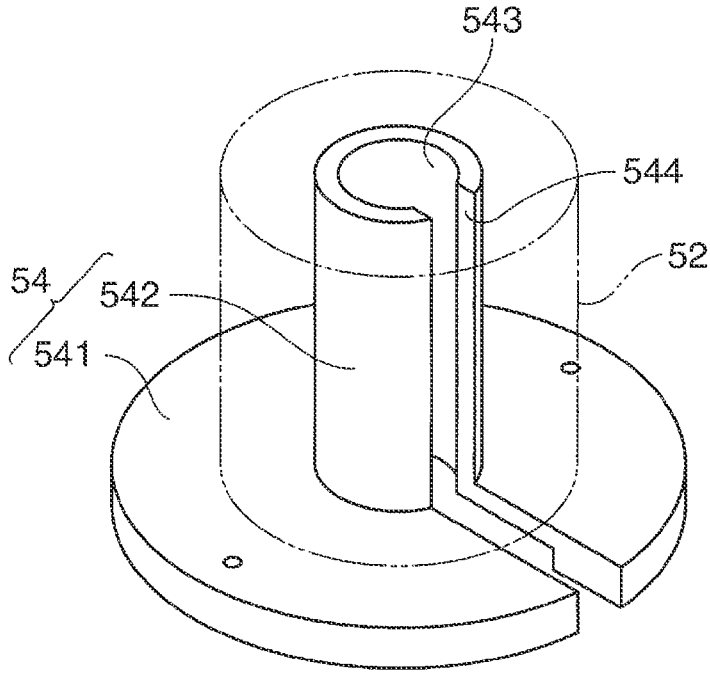

The core 51 and magnetic plate 7 are rendered discretely with the configuration shown in FIG. 26, but as shown in FIG. 27 the core 51 and magnetic plate 7 could be unitarily formed by injection molding, for example. By thus rendering the core 51 and magnetic plate 7 as a single component, the parts count is reduced and assembly is further simplified.

Further alternatively as shown in FIG. 28(A), the magnetic plate 7 can be rendered unified to both ends of the core 51. In this case a slit 544 is formed in the coil bobbin 54 as shown in FIG. 28(B), and the slit 544 in the coil bobbin 54 can be widened using the elasticity of the plastic so that the core 51 can be fit into the coil bobbin 54 using the widened gap of the slit 544. After thus fitting the core 51 into the coil bobbin 54, the coil 52 is wound to the coil bobbin 54, and this coil bobbin 54 is then assembled to the main plate 46 as shown in FIG. 28(A).

(Sixth Variation)

A sixth variation of a radio-controlled timepiece as an electronic timepiece with wireless information function according to the present invention is described below.

The basic configuration of this sixth variation (including the basic construction and part materials) is the same as in the first embodiment, but is characterized by the case having a thin metal plating.

Figure 29:
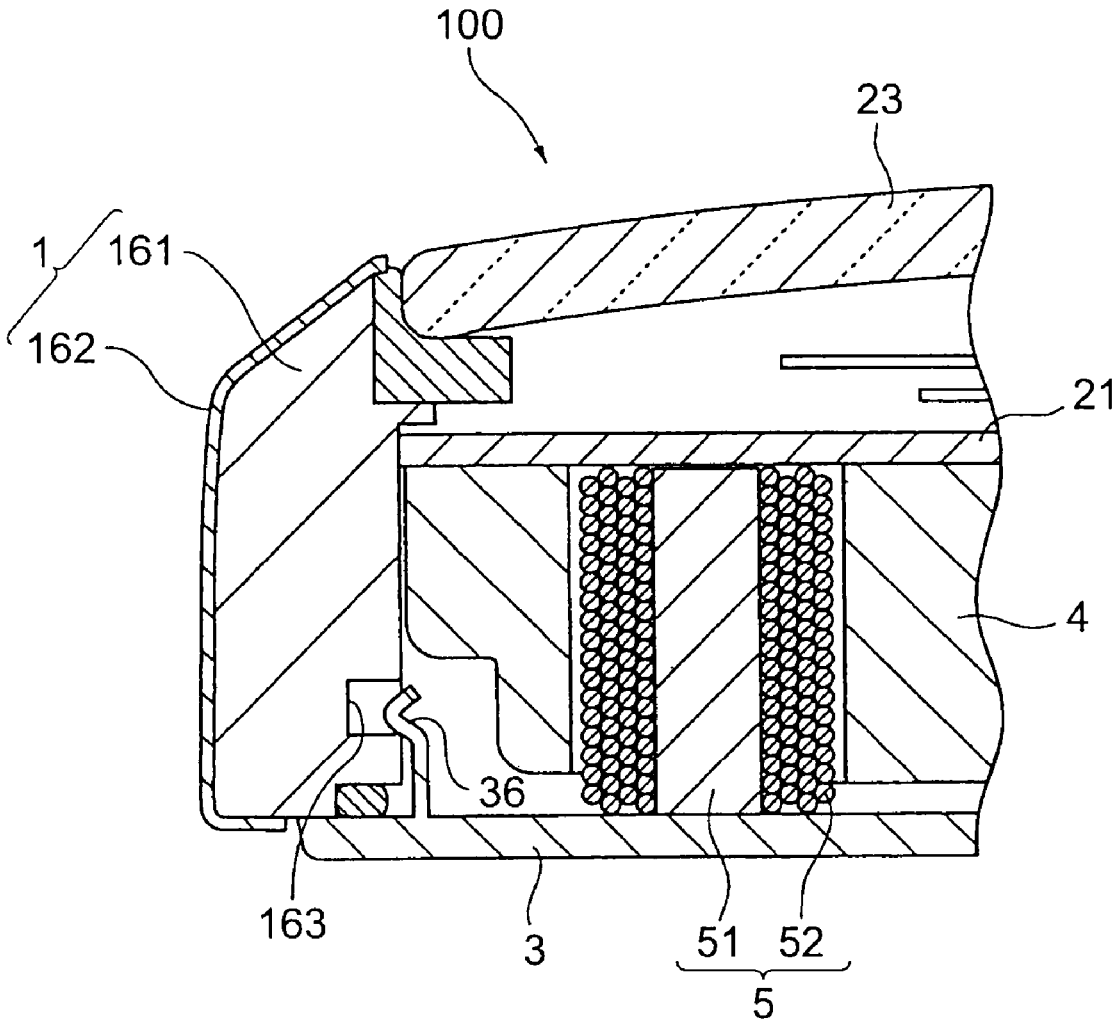
FIG. 29 shows a sixth variation of an electronic timepiece with wireless information function according to the present invention in which a metal cover is rendered on the surface of the case.

As shown in FIG. 29, this radio-controlled timepiece 100 is composed of a case 1, back cover 3, dial 21, crystal 23, movement 4, and antenna 5.

The case 1 is configured with thin metal plating 162 externally covering a base 161 made from a non-conductive, non-magnetic member such as plastic.

The back cover 3 is made from a non-conductive, non-magnetic member such as plastic, and is engaged with the case 1 by fitting a hook 36 rendered rising from the outside edge of the back cover 3 into a recessed channel 163 in the case 1.

Thus comprised, the antenna 5 can receive standard radio signals entering the case 1 from the openings in the case 1 even though the outside surface of the case 1 is covered with thin metal plating 162. The thin metal plating 162 thus affords luxurious ornamentation while good reception is also assured.

(Seventh Variation)

A seventh variation of a radio-controlled timepiece as an electronic timepiece with wireless information function according to the present invention is described below.

The basic configuration of this seventh variation (including the basic construction and part materials) is the same as in the second embodiment, but is characterized by the time display using a digital display to show the time.

Figure 30:
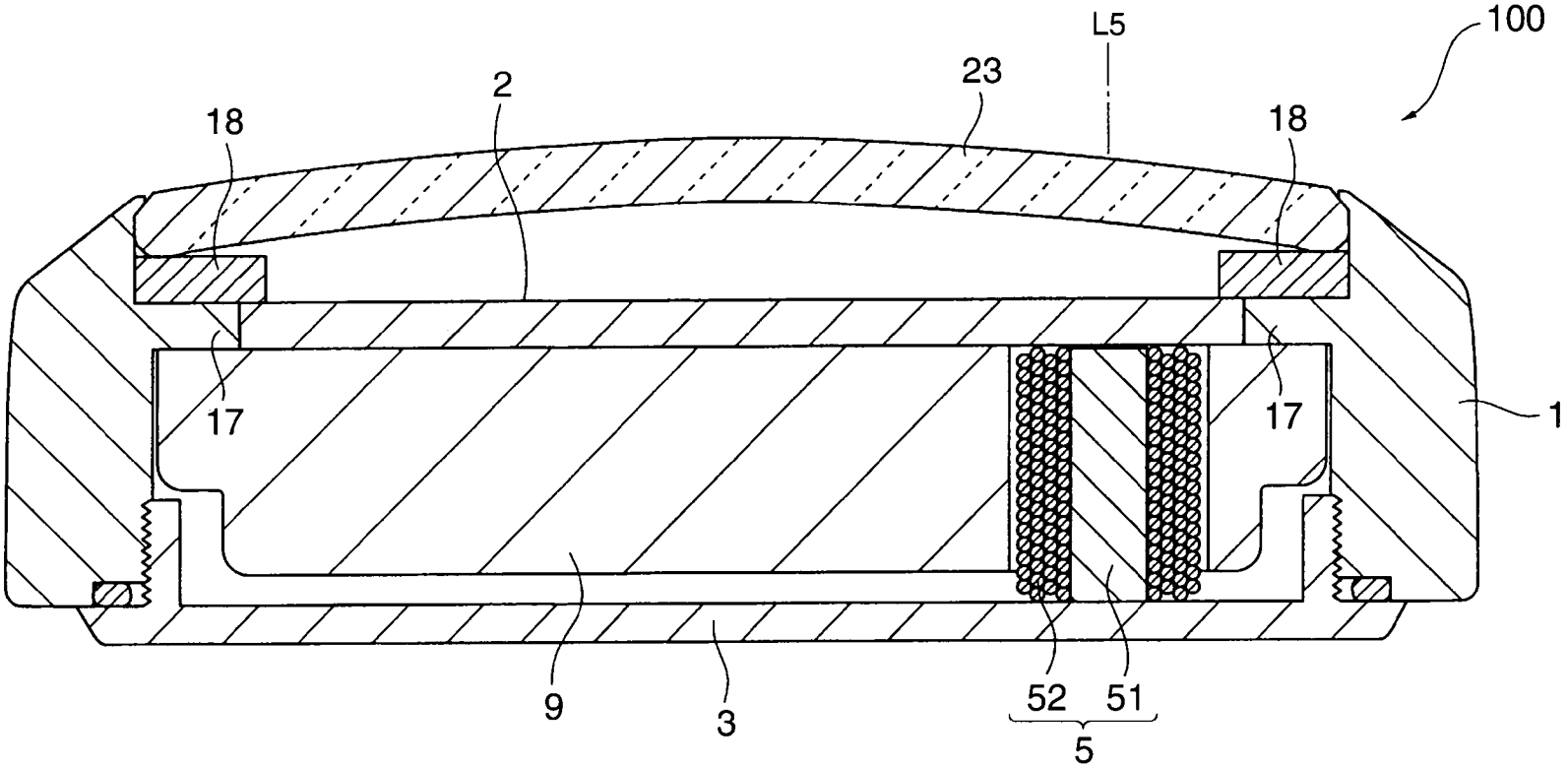
FIG. 30 shows a seventh variation of an electronic timepiece with wireless information function according to the present invention in which the time display means is a liquid crystal display panel.

As shown in FIG. 30, this radio-controlled timepiece 100 is composed of a case 1, time display 2, crystal 23, back cover 3, parting ring 18, clock module 9 including a clock circuit, and antenna 5.

The case 1 is a metal case as described above, and has an internal flange 17 projecting from the inside circumference. The crystal 23 and back cover 3 are made from a non-conductive and non-magnetic material such as mineral glass or plastic.

The time display 2 shows the time digitally using a liquid crystal display (LCD). The time display 2 is held surrounded by the flange 17.

The parting ring 18 is disposed between the flange 17 and crystal 23 so that the outside edge of the time display 2 cannot be seen through the crystal 23. The parting ring 18 can be made from a non-conductive and non-magnetic member such as plastic, or it could be metal.

The back cover 3 is screwed into the case 1.

If the parting ring 18 is metal, the antenna 5 is disposed to the inside from the inside edge of the parting ring 18 so that the line of the antenna 5 axis $L_5$ does not intersect the parting ring 18. The standard radio signal can therefore be received by the antenna 5 without being blocked by the parting ring 18.

(Eighth Variation)

An eighth variation of a radio-controlled timepiece as an electronic timepiece with wireless information function according to the present invention is described below with reference to FIG. 31.

The basic configuration of this eighth variation (including the basic construction and part materials) is the same as in the first embodiment, but is characterized by the back cover having a glass part and a metal ring being disposed to the back of the dial.

FIG. 31(A) is a main section view of this eighth variation, (B) is a plan view from the dial side, and (C) is a plan view from the back cover side.

Figure 31:
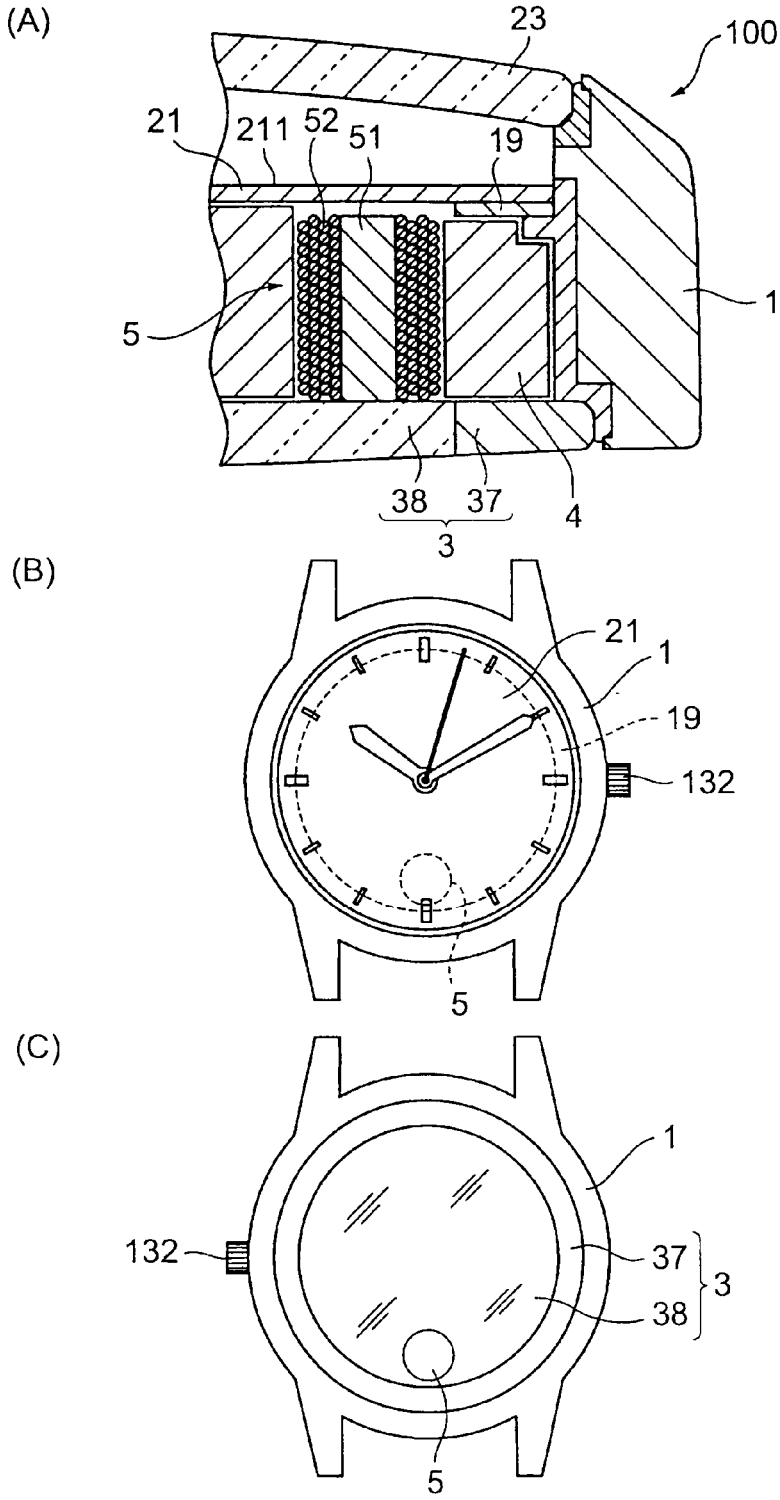
FIGS. 31(*a*), (*b*), and (*c*) show an eighth variation of an electronic timepiece with wireless information function according to the present invention in which the back cover has a glass part through which a magnetic field can pass.

As shown in FIG. 31, this radio-controlled timepiece 100 has a case 1, dial 21, movement 4, back cover 3, and antenna 5.

The dial 21 is a non-conductive and non-magnetic member, and is semi-transparent. As shown in FIG. 31(A), (B), a metal ring 19 is affixed to the outside edge of the dial 21 on the opposite side as the time display surface 211. This metal ring 19 has the effect of improving decorativeness by increasing light reflection by the dial 21. The metal ring 19 could alternatively be disposed to the time display surface 211 side.

The back cover 3 has a metal edge ring 37 and a glass plate 38 fit to the inside of the edge ring 37 to let the magnetic field of the standard radio signal pass.

As shown in FIG. 31(A) to (C), the antenna 5 is imposed on the surface of the mineral glass plate 38. That is, when the antenna 5 and glass plate 38 are projected from the dial side, the projected image of the antenna 5 is included in the projected image of the glass plate 38.

It should be noted that the glass plate 38 is preferably a circle of which the center is the center of the watch (that is, the hand arbor) from an aesthetic perspective, but the glass plate 38 could be disposed only at the part corresponding to the antenna 5.

The glass plate 38 thus functions to pass the magnetic field of the RF signal.

The area of the glass plate 38 is at least greater than the area of the antenna 5 end, and is preferably at least twice the area of the antenna 5 end.

The line of the antenna 5 axis also preferably does not intersect the metal ring 19.

Thus comprised, the antenna 5 receives the standard radio signal through the glass plate 38 through which the magnetic field passes. Furthermore, because the line of the antenna 5 axis passes the dial 21 through which the magnetic field also passes without intersecting the metal ring 19, the standard radio signal is received by the antenna 5 without the standard radio signal being blocked by the metal ring 19.

(Ninth Variation)

A ninth variation of a radio-controlled timepiece as an electronic timepiece with wireless information function according to the present invention is described below.

This ninth variation is similar to the above embodiments in having an antenna, but is characterized by the length-width ratio of the antenna (or antenna core).

Figure 32:
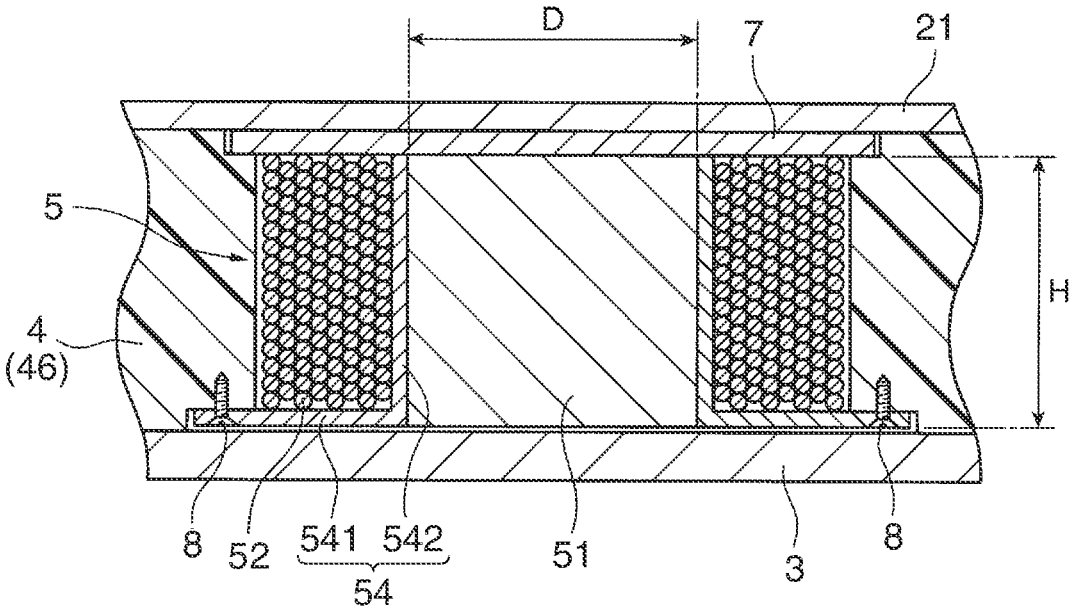
FIG. 32 shows the relationship between the inside diameter and height of the antenna in a ninth variation of an electronic timepiece with wireless information function according to the present invention.

More specifically, the inside diameter D of the antenna core 51 is greater than the height H of the antenna core 51 in the antenna 5 as shown in FIG. 32.

The inside diameter D of the antenna core 51 is defined on a plane perpendicular to the direction in which the time is viewed, that is, the cylindrical axis of the case 1. The height H of the antenna core 51 is defined lengthwise to the direction in which the time is viewed, that is, the direction parallel to the cylindrical axis $L_1$ of the case 1. This also applies when the axis of the antenna 5 is inclined to the cylindrical axis of the case 1.

By thus setting the inside diameter D of the antenna core 51 greater than the height H, flux linkage can be increased in a wristwatch that cannot be made very thick. The reception performance of the antenna 5 can therefore be improved. The thickness of the radio-controlled timepiece 100 can also be made thin by minimizing the height H of the antenna core 51.

As shown in the preceding embodiments, the axial length of the antenna 5 (vertical length) can also be greater than the diameter (horizontal width) in a plane orthogonal to the axis.

(Tenth Variation)

A tenth variation of a radio-controlled timepiece as an electronic timepiece with wireless information function according to the present invention is described below.

This tenth variation is a variation of the seventh embodiment and eighth embodiment in which the support substrate 62 of the photoelectric generator 6 is made from a high permeability material. The variation is that the support substrate 62 of the photoelectric generator 6 is a non-conductive and non-magnetic member such as polyimide resin or other plastic, mineral glass, ceramic, or paper, and the photoelectric conversion element 62 is disposed on this support substrate 62. Thus comprised, the magnetic field of the received signal can also pass through the support substrate 62.

A radio-controlled timepiece according to the present invention shall not be limited to the embodiments described above, and can be varied in many ways without departing from the scope of the accompanying claims.

For example, the number of antenna 5 in the preceding embodiments shall not be specifically limited as there can be only one antenna or multiple antennae. In addition, when multiple antennae 5 are used, the antenna coils can be connected in series, parallel connected, or connected using a combination of serial and parallel connections.

When a plurality of antennae 5 is used, the axes of a number of the antennae 5 are rendered substantially parallel to the cylindrical axis of the case 1 as described above, and other antennae 5 can be rendered with their axes substantially perpendicular to the cylindrical axis of the case.

The shape of the case 1 shall not be limited to a short cylindrical ring, and could be a short tube substantially rectangular, octagonal, or square in shape. Furthermore, the case 1 could be unified after molding the outside and inside as separate parts, or unified after molding the glass edge and body as separate parts.

Both ends along the axis of the case 1 are also not necessarily open, and the case 1 could be a single ring-shaped body with a bottom (a tube with a bottom). More specifically, the case 1 and back cover 3 could be formed as a single component (a one-piece design).

In this case the part of the back cover 3 opposite the core of the antenna 5 is preferably made from mineral glass or plastic. This mineral glass or plastic is the field-passing part.

To isolate the dial 21 and back cover 3 from the case 1 in the second embodiment, the inside surface of the case 1 could be made from a non-conductive member rather than using an intervening spacer ring 14.

The invention has been described with the scheduled reception time preset to 2:00 a.m. and the antenna 5 positioned where the hands will not overlap the antenna 5 at the scheduled reception time. An escape mechanism could also be provided to automatically move the hands from the antenna 5 axis if the hands overlap the antenna 5 axis when signal reception is forced by an unconditional signal reception operation.

It will also be obvious that a stepping motor could be used instead of a piezoelectric actuator in the second embodiment. In this case it is necessary to stop stepping motor drive during signal reception by the antenna.

The seventh embodiment is also not limited to using a piezoactuator 48 as the drive unit, and a stepping motor could obviously be used.

Furthermore, the main plate 46 and gear train holder 47 are described as non-conductive, non-magnetic plastic or ceramic members, but they could be brass or other metal if the area of the main plate 46 and gear train holder 47 is small when the main plate 46 and gear train holder 47 are viewed from the dial side.

Because the support substrate 62 and core 51 are both made from a high permeability material, they could be unified. That is, the antenna core 51 could be formed protruding contiguously from the support substrate 62.

The axis $L_5$ of the antenna 5 shall also not be limited to being substantially parallel to the cylindrical axis $L_1$ of the case, and it is sufficient if, for example, the line of the axis $L_5$ of the antenna 5 passes through the openings in the case 1. As a result, the standard radio signal will be pulled in by the support substrate 62 without being blocked by the body of the case 1, and can therefore link to the antenna 5. Furthermore, it is sufficient if the end surface of the antenna 5 faces the support substrate 62 disposed in an opening of the case 1. Therefore, if the support substrate 62 is shaped bent or curved toward the inside of the case 1, the orientation of the antenna 5 axis $L_5$ is not specifically limited insofar as the antenna 5 is disposed opposite the support substrate 62. For example, the antenna axis $L_5$ could be perpendicular to the cylindrical axis $L_1$ of the case 1.

Furthermore, a magnetically conductive member could be disposed between the support substrate 62 and end of the antenna 5 if the support substrate 62 and antenna 5 end are separated because it is only necessary to assure a magnetically conductive path between the support substrate 62 and end of the antenna 5. This magnetically conductive structure could be a magnetically conductive member made from a high permeability material and rendered with one end contacting the support substrate 62 and the other end contacting the end of the antenna core 51.

The antennae 5A, 5B, 5C, support substrate 62, and magnetic plate 7 are discretely rendered in the eighth embodiment. However, because it is sufficient if the antennae core 51A, 51B, and 51C, the support substrate 62, and the magnetic plate 7 are made from a high permeability material, antenna cores 51A, 51B and the support substrate 62 could be unified, and antenna core 51 and magnetic plate 7 could be unified.

Yet further, the timepiece is described as having three discrete pairs of photoelectric generator 6 and antenna 5, but the photoelectric generator 6 could be separated into four or five blocks, and two or three antennae 5 could be disposed to one block of the photoelectric generator 6.

The photoelectric generator 6 is also described as divided into three parts, but the photoelectric converter 61 could be rendered as a single piece while the support substrate 62 is divided into three parts.

The photoelectric generator 6 shall also not be limited to the configurations described above, and any construction that produces power from light can be used.

In each of the embodiments the core 51 of the antenna 5 can be made from a thin amorphous metal (such as an amorphous metal of cobalt or iron) wound in a spiral. In this case the central axis of the spiral preferably matches the axis of the antenna 5. Magnetic flux passes the core easily with this configuration, and the reception performance of the antenna is improved.

The antenna 5 is also described as having a core (magnetic core) 51, but the antenna 5 could be a coreless antenna, that is, an antenna that does not have a core.

A photoelectric generator 6 could also be disposed in place of the back cover 3, and a photoelectric generator 6 could be disposed to both ends of the case 1.

In addition to forming the dial 21 and back cover 3 from a high permeability material, the dial 21 and back cover 3 could be made from a conductive metal such as brass, titanium (or titanium alloy), stainless steel, or aluminum in the second variation described above. In this case the dial 3 and back cover 3 are preferably insulated from the case 1. When the dial 21 and back cover 3 are made from a conductive metal, the standard radio signal reaches the antenna 5 from the thin walled part of the first recess 219 and the thin walled part of the second recess 35.

The case 1 is made from a metal member in the above embodiments, but the material of the case 1 shall not be so limited. For example, the case 1 could be rendered from plastic, ceramic, or other non-conductive and non-magnetic material.

The case 1 is also not limited to having both axial ends open, and could have a bottom unified with a ring-shaped body (that is, a tube with a bottom), for example. The case 1 shall also not be limited to metal materials, and could be formed from a synthetic resin, for example.

The dial 21, back cover 3, main plate 46, and gear train holder 47 are preferably made from non-conductive and non-magnetic materials in the above embodiments so that they do not block radio waves, but they could in cases only be non-conductive.

Alternatively, the dial 21 and back cover 3 could be non-magnetic conductive members such as brass or aluminum. In this case the dial 21 and back cover 3 are preferably isolated from the case 1. This is because the radio wave field component can be pulled in by brass or aluminum depending on the properties of the signal field, and the reception performance of the antenna 5 can be improved. In this case the dial or back cover preferably has a thin wall in the area corresponding to the antenna so that the standard radio signal can pass easily.

A standard radio signal containing time information (time code) at a frequency of 40 kHz to 77.5 kHz is used by way of example as the radio signal received by the antenna of this electronic timepiece with wireless information function, but the signal could contain wireless information at a frequency of 125 kHz to 135 kHz, or wireless information on a different frequency band. Signals emitted from a wireless IC tag (RFID signals) could also be received by the antenna of the electronic timepiece with wireless information function.

The radio information received by the antenna could include, for example, weather reports, stock information, event information, and sales information. This information can be received by the antenna of this electronic timepiece with wireless information function when passing through a gate in an event park or public transportation station connected to an external network. The control unit decodes the received information and controls the operation of a controlled unit such as the time display to perform a specific function. For example, if the received signal is a standard time signal, the controller could control the time display to show the time, and if the received signal contains weather information or stock data, the controller could control a particular display to present the received information.

The present invention could be rendered as a wristwatch, mantle clock, wall clock, or clock located outdoors such as in a park or on the street. It could also be rendered as an electronic device with a clock unit, and is particularly suited to portable electronic devices such as cell phones, personal digital assistant (PDA) terminals, and pagers (portable wireless paging signal receivers).

The present invention can be used in electronic timepieces having a radio reception function, including, for example, radio-controlled timepieces.

What is claimed is:

1. An electronic wristwatch with wireless capability, comprising:

a cylindrical outer case having a metal portion on at least an outer peripheral surface of the case and having first and second ends;

a time display means having a hand and a dial disposed in the vicinity of the first end of the case, wherein the dial comprises a non-conductive and non-magnetic member;

a front cover disposed in the vicinity of the first end of the case, wherein the front cover comprises a non-conductive and non-magnetic member;

a movement having components including a drive unit for driving the hand;

a main plate comprising a non-conductive and non-magnetic member and on which the components of the movement are substantially mounted, the main plate having a hole formed therein, the hole having two openings, one opening toward the first end of the case and the other opening toward the second end of the case, such that the hole passes through the main plate, the main plate further being formed with one or more recesses on at least the metal-back-cover side of the main plate, the one or more recesses being connected to the hole, formed so as to not pass through the main plate;

an antenna comprising a coil and a core around which the coil is wound, the antenna being configured to receive radio signals, wherein at least a portion of the coil is positioned in the hole and at least a portion of the antenna extends into the one or more recesses on the metal-back-cover side of the main plate; and a metal back cover disposed in the vicinity of the second end of the case.

2. A wristwatch as recited in claim 1, wherein:

the hand comprises a metal minute hand that rotates above the dial; and the antenna is positioned such that, looking along the axis of the cylinder, it may overlap with the minute hand during time periods in which no radio reception is scheduled, but does not overlap with the minute hand during time periods in which radio reception is scheduled.

3. The wristwatch as recited in claim 1, wherein the case further comprises a thin, metal plating that covers a non-conductive and non-magnetic member.

4. The wristwatch as recited in claim 1, wherein the antenna further comprises one or more additional coils rendered in different positions in which the coils are configured either in parallel or in series.

5. A wristwatch as recited in claim 1, wherein a portion of the antenna extends out of the main plate.

6. A wristwatch as recited in claim 1, wherein the metal back cover is integrated with the cylindrical outer case.

7. A wristwatch as recited in claim 1, wherein the portion of the antenna is fastened to the one or more recesses.

8. A wristwatch as recited in claim 1, wherein the movement further comprises a control section and a gear train, the control section and the gear train being substantially mounted on the main plate.

* * * * *